US006933822B2

(12) United States Patent
Haugs et al.

(10) Patent No.: US 6,933,822 B2
(45) Date of Patent: Aug. 23, 2005

(54) MAGNETICALLY INFLUENCED CURRENT OR VOLTAGE REGULATOR AND A MAGNETICALLY INFLUENCED CONVERTER

(75) Inventors: Espen Haugs, Sperrebotn (NO); Frank Strand, Moss (NO)

(73) Assignee: Magtech AS, Moss (NO)

( * ) Notice: Subject to any disclaimer, the term of this patent is extended or adjusted under 35 U.S.C. 154(b) by 206 days.

(21) Appl. No.: 10/278,908

(22) Filed: Oct. 24, 2002

(65) Prior Publication Data

US 2003/0076202 A1 Apr. 24, 2003

Related U.S. Application Data

(63) Continuation of application No. PCT/NO01/00217, filed on May 23, 2001.

(60) Provisional application No. 60/330,562, filed on Oct. 25, 2001.

(30) Foreign Application Priority Data

May 24, 2000 (NO) ..... 2000 2652

(51) Int. Cl.[7] ..... H01F 27/00

(52) U.S. Cl. ..... 336/100; 336/188; 336/214; 336/83; 29/602.1; 323/44; 323/331; 323/48

(58) Field of Search ..... 336/100, 83, 188, 336/223, 234, 214, 173, 180, 184; 323/331, 48, 49, 44, 50, 56; 29/602.1

(56) References Cited

U.S. PATENT DOCUMENTS

| | | | |
|---|---|---|---|
| 2,284,406 A | 5/1942 | E'Entremont | |
| 2,333,015 A | 2/1943 | Kramer et al. | 171/242 |
| 2,716,736 A | 12/1955 | Rex | 336/155 |
| 2,825,869 A | 4/1958 | Ecker, Jr. et al. | 323/89 |
| 3,409,822 A | 11/1968 | Orthogonal | 323/22 |

(Continued)

FOREIGN PATENT DOCUMENTS

| | | |
|---|---|---|
| DE | 100 62 091 C1 | 7/2002 |
| EP | 0 018 296 A1 | 10/1980 |
| FR | 2 344 109 | 10/1977 |
| GB | 2 361 107 A | 10/2001 |
| JP | 0123105 | 9/1989 |
| JP | 07201587 | 8/1995 |
| JP | 07201588 | 8/1995 |
| JP | 07201590 | 8/1995 |
| RU | 2125310 C1 | 1/1999 |
| SU | 441601 | 6/1975 |
| SU | 877631 | 11/1981 |
| WO | WO 94/11891 | 5/1994 |
| WO | WO 97/34210 | 9/1997 |
| WO | WO 98/31024 | 7/1998 |
| WO | 02/059918 A1 | 8/2002 |

OTHER PUBLICATIONS

PCT Written Opinion PCT/NO 03/00417, Mailing Date Sep. 9, 2004.

(Continued)

*Primary Examiner*—Lincoln Donovan
*Assistant Examiner*—Jennifer A. Poker
(74) *Attorney, Agent, or Firm*—Testa, Hurwitz & Thibeault, LLP

(57) ABSTRACT

A magnetically influenced current or voltage regulator includes a body of an anisotropic magnetisable material that provides a closed magnetic circuit. A first electrical conductor is wound around the body along at least a part of the close circuit for at least one turn which forms a first main winding. At least one second electrical conductor is wound around the body along at least a part of the closed circuit for at least one turn which forms a control winding. The winding axis for the main winding is at right angles to the winding axis for the control winding. Orthogonal magnetic fields are generated in the body when the first main winding and the control winding are excited. A characteristic of the anisotropic magnetisable material relative to a field in the main winding is controlled by means of a field in the control winding.

44 Claims, 54 Drawing Sheets

U.S. PATENT DOCUMENTS

| | | | | | |
|---|---|---|---|---|---|
| 3,612,988 | A | | 10/1971 | Wanlass | 323/43.5 R |
| 3,757,201 | A | | 9/1973 | Cornwell | |
| 4,002,999 | A | | 1/1977 | Hesler et al. | |
| 4,004,251 | A | | 1/1977 | Hesler et al. | |
| 4,020,440 | A | | 4/1977 | Moerman | 336/155 |
| 4,163,189 | A | | 7/1979 | Smutny | |
| 4,202,031 | A | | 5/1980 | Hesler et al. | |
| 4,210,859 | A | * | 7/1980 | Meretsky et al. | 323/331 |
| 4,308,495 | A | | 12/1981 | Yasumura | 323/250 |
| 4,393,157 | A | | 7/1983 | Roberge et al. | 323/355 |
| 5,404,101 | A | | 4/1995 | Logue | 324/207.17 |
| 5,672,967 | A | | 9/1997 | Jensen et al. | 324/253 |
| 5,936,503 | A | | 8/1999 | Holmgren et al. | |
| 6,232,865 | B1 | | 5/2001 | Zinders et al. | |
| 6,307,468 | B1 | | 10/2001 | Ward, Jr. | 340/505 |
| 6,429,765 | B1 | | 8/2002 | Valdemarsson et al. | 336/212 |

OTHER PUBLICATIONS

Norwegian Search Report, 2001 5689, Mailing Date Jul. 10, 2002.

International Search Report, PCT/NO 02/00434, Mailing Date Mar. 4, 2003.

Norwegian Search Report, 2000 2652, Mailing Date Apr. 30, 2002.

International Search Report PCT/NO 02/00435 Mailing Date Mar. 6, 2003.

International Search Report PCT/NO 02/00004 Mailing Date May 16, 2003.

Norwegian Search Report 2002 5268 Mailing Date Jun. 30, 2003.

PCT Search Report PCT/NO 03/00417 Mailing Date Apr. 13, 2004.

Great Britain Search Report Mailing Date Feb. 26, 2004.

International Preliminary Examination Report, PCT/NO 02/00434, Mailing Date Mar. 16, 2004.

International Preliminary Examination Report, PCT/NO 02/00435, Mailing Date Mar. 16, 2004.

Fiorillo et al., "Comprehensive Model of Magnetization Curve, Hysteresis Loops, and Losses in Any Direction in Grain–Oriented Fe–Si." *IEEE Transactions of Magnetics*, vol. 38, No. 3 (May 2002), pp. 1467–1476.

Hubert et al. Magnetic Domains: the Analysis of Magnetic Microstructures, pp. 416–417 and pp. 532–533.

* cited by examiner

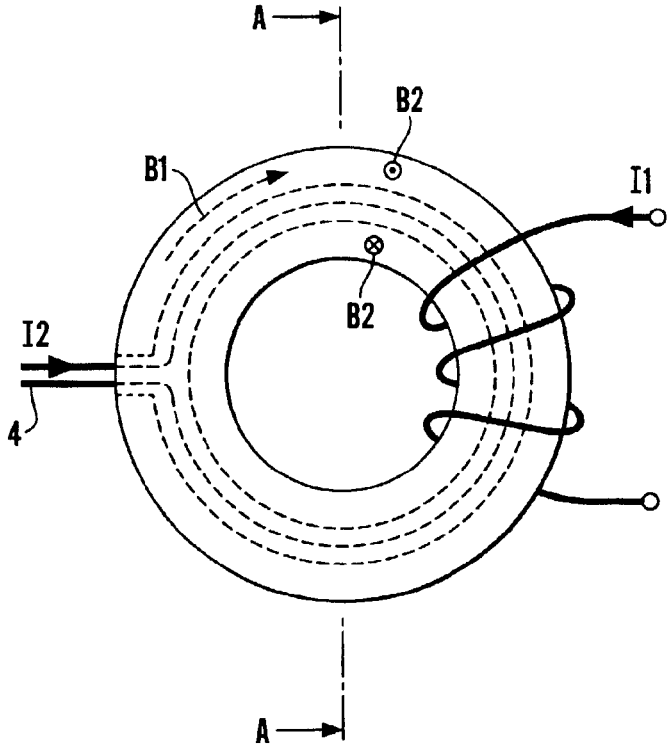
Fig.2a
Fig.2b
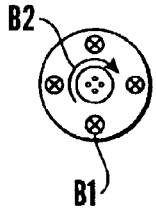
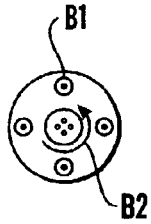
Fig.2c

MAGNETICALLY INFLUENCED CURRENT OR VOLTAGE REGULATOR AND A MAGNETICALLY INFLUENCED CONVERTER

CROSS REFERENCE TO RELATED APPLICATIONS

This application is a Continuation of PCT International Patent Application No. PCT/NO01/00217, filed May 23, 2001, which claims priority to Norwegian Patent Application No. 2000 2652, filed May 24, 2000, and the benefit of U.S. Provisional Application No. 60/330,562, filed Oct. 25, 2001, the contents of which are incorporated herein by reference.

The present invention relates to a magnetically influenced current or voltage regulator and a magnetically influenced converter for controlled connection and disconnection together with distribution of electrical energy as indicated in the introduction to the attached, independent patent claims.

The invention, which is a continuation of the known transductor technology, is particularly suitable as a voltage connector, current regulator or voltage converter in several areas of the field of power electronics. The feature which particularly characterises the invention is that the transformative or inductive connection between the control winding and the main winding is approximately 0 and that the inductance in the main winding can be regulated through the current in the control winding, and furthermore that the magnetic connection between a primary winding and a secondary winding in a transformer configuration can be regulated through the current in the control winding.

In the field of rectification, for example, the present invention can be employed in connection with regulation of the high-voltage input in large rectifiers, where the advantage will be full exploitation of a diode rectifier over the entire voltage range. For asynchronous motors, the use of the invention may be envisaged in connection with the soft start of high-voltage motors. The invention is also suitable for use in the field of power distribution in connection with voltage regulation of power lines, and may be used for continuously controlled compensation of reactive power in the network.

Even though it should not be considered limiting for the use of the device, it may, e.g., form part of a frequency converter for converting input frequency to randomly selected output frequency, preferably intended for operation of an asynchronous motor, where the frequency converter's input side has a three-phase supply which by means of its phase conductors feeds the input to at least one transformer intended for each of the converter's three-phase outputs, and where the outputs of such a transformer are connected via respective, selectively controllable voltage connectors, or via additional transformer-coupled voltage, connectors, in order to form one of the said three-phase outputs.

A second application of the device is as a direct converter of DC voltage to AC voltage whereby the AC voltage's frequency is continuously adjustable.

The use of this type of frequency converter in a subsea context, especially at great depths, will be where the use is required of high-capacity pumps with variable speeds. Pumping in a subsea system will typically be performed from the underwater site to a location above water (boosting) and with water injection from the underwater site down into the reservoir.

Variable speed engine controls are normally based on two principles; a) direct electronic frequency-regulated converters, and b) AC-DC-AC converters with pulse-width modulation, and with extended use of semiconductors such as thyristors and IGBT's. The latter represents the technology widely used in industrial applications and for use on board locomotives, etc.

Speed control has recently been introduced for motors in underwater environments. The main challenge has been the d packing and operation of such systems. In this context, operation refers to service, maintenance, etc. Complex electronic systems generally have to operate in controlled environments with regard to temperature and pressure. Marine-based versions of such systems have to be encapsulated in containers filled with nitrogen maintaining a pressure of 1 atm. On account of heat generation as a result of heat loss in the electronics, a substantial amount of heat may be generated, thus resulting in the need for forced air cooling. This is usually solved by the use of fans. The fans introduce a component which dramatically reduces the working life of the system and represents a highly unsuitable solution.

The sensitivity of the electronics and the electronic power semiconductors is high and requires protective circuits. This complicates the system and forces up the costs.

At great depths (over 300 metres) a protective container for such a system will be extremely heavy, representing a fairly significant proportion of the total weight of the system. In addition, maintenance of a system more often than not will require the entire frequency converter to be raised, since even simpler maintenance is difficult to perform with a remotely operated vehicle (ROV).

Thus it has been a co-ordinate object of the device according to the present invention to offer the possibility of providing a frequency converter which is suitable for underwater pumping operations, particularly with the focus on operational reliability, stability and minimum maintenance requirements. The operational requirement will be approximately 25 years at 3000 m depth.

The standard frequency converters which are based on semiconductor technology convert alternating current (AC) power with a given frequency to alternating current power in the other selected frequency without any intermediate DC connection. The conversion is carried out by forming a connection between given input and output terminals during controlled time intervals. An output voltage wave with an output frequency F0 is generated by sequentially connecting selected segments of the voltage waves on the AC input source with the input frequency F1 to the terminals. Such frequency converters exist in the form of the standard symmetrical cycloconverter circuits for supplying power from a three-phase network to a three-phase motor. The standard cycloconverter module consists of a dual converter in each motor phase. Thus the normal method is to employ three identical, essentially independent dual converters which provide a three-phase output.

Amongst other known types of frequency converters is a symmetrical 12-pulse centre cycloconverter consisting of three identical 4-quadrant 12-pulse centre converters, with one for each output phase. All three converters share common secondary windings on the input transformer. The neutral conductor can be omitted for a balanced 3-phase loaded Y-coupled motor.

Another known frequency converter based on semiconductor technology is the so-called symmetrical 12-pulse bridge circuit which has three identical 4-quadrant 12-pulse bridge converters with one for each output phase. The input terminals on each of the six individual 6-pulse converters are fed from separate secondary windings on the input transformer. It should be noted that it is not permitted to use the same secondary winding for more than one converter. This is due to the fact that each 12-pulse converter in itself requires two completely insulated transformer secondary windings.

It has therefore been a secondary, but nevertheless essential object of the invention to avoid primarily semiconductor components in the frequency converter which has to be located at great depths and for this purpose the use has therefore been proposed according to the invention of the new magnetic converter technology based on an entirely untraditional concept.

Thus the invention comprises a magnetically influenced current or voltage regulator, which in a first embodiment is characterized in that it comprises: a body which is composed of a magnetisable material and provides a closed, magnetic circuit, at least one first electrical conductor wound round the body along at least a part of the closed circuit for at least one turn which forms a first main winding, at least one second electrical conductor wound around the body along at least a part of the closed circuit to at least one turn which forms a second main winding or control winding, where the winding axis for the turn or turns in the main winding is at right angles to the winding axis for the turn or turns in the control winding. The object of this is to provide orthogonal magnetic fields in the body and thereby control the behaviour of the magnetisable material relative to the field in the main winding by means of the field in the control winding. In a preferred version of this first embodiment, the axis for the turn(s) in the main winding is parallel to or coincident with the body's longitudinal direction, while the turn(s) in the control winding extend substantially along the magnetisable body and the axis for the control winding is therefore at right angles to the body's longitudinal direction. A second possible variant of the first embodiment consists in the axis for the turn(s) in the control winding being parallel to or coincident with the body's longitudinal direction, while the turn(s) in the main winding extend substantially along the magnetisable body and the axis for the main winding is therefore at right angles to the body's longitudinal direction.

This first embodiment of the device can be adapted for use as a transformer by being equipped with a third electrical conductor wound around the body along at least a part of the closed circuit for at least one turn, forming a third main winding, the winding axis for the turn or turns in the third main winding coinciding with or being parallel to the winding axis for the turn or turns in the first main winding, thus providing a transformer effect between the first and the third main windings when at least one of them is excited. A second possibility for adapting the first embodiment of the invention for use as a transformer is to equip it with a third electrical conductor wound around the body along at least a part of the closed circuit for at least one turn, forming a third main winding, the winding axis for the turn or turns in the third main winding being coincident with or parallel to the winding axis for the turn or turns in the control winding, thus providing a transformer effect between the third main winding and the control winding when at least one of them is excited.

A second embodiment of the invention comprises a magnetically influenced current or voltage regulator, characterized in that it comprises a first body and a second body, each of which is composed of a magnetisable material which provides a closed, magnetic circuit, the said bodies being juxtaposed, at least one first electrical conductor wound along at least a part of the closed circuit for at least one turn which forms a first main winding, at least one second electrical conductor wound around at least a part of the first and/or second body for at least one turn which forms a second main winding or control winding, where the winding axis for the turn or turns in the main winding is at right angles to the winding axis for the turn or turns in the control winding. The object of this is to provide orthogonal magnetic fields in the body and thereby control the behaviour of the magnetisable material relative to the field in the main winding by means of the field in the control winding. The main and control windings may of course be interchanged, thus providing a magnetically influenced current or voltage regulator, characterized in that it comprises at least one first electrical conductor wound round at least a part of the first and/or the second body for at least one turn which forms a first main winding, at least one second electrical conductor wound along at least a part of the closed circuit for at least one turn which forms a second main winding or control winding, where the winding axis for the turn or turns in the main winding is at right angles to the winding axis for the turn or turns in the control winding with the object of providing orthogonal magnetic fields in the body and thereby controlling the behaviour of the magnetisable material relative to the field in the main winding by means of the field in the control winding.

A preferred variant of this second embodiment comprises first and second magnetic field connectors which together with the bodies form the closed magnetic circuit.

This second embodiment of the device can also be adapted for use as a transformer by equipping it with a third electrical conductor wound for one turn which forms a third main winding, the winding axis for the turn or turns in the third main winding being coincident with or parallel to the winding axis A2 for the turn or turns in the first main winding or in the control winding, thus providing a transformer effect between the third main winding and the first main winding or the control winding when at least one of this is excited.

In a preferred version of this second embodiment of the invention, the first and the second body are tubular, thus enabling the first conductor or the second conductor to extend through the first and the second body. In this version the magnetic field connectors preferably comprise apertures for the conductors. In a more preferred version of the invention, each magnetic field connector comprises a gap to facilitate the insertion of the first or the second conductor. In an even more preferred embodiment the device is equipped with an insulating film placed between the end surfaces of the tubes and the magnetic field connectors with the object of insulating the connecting surfaces from each other in order to prevent induced eddy currents from being produced in the connecting surfaces by short-circuiting of the layer of film. For a core made of ferrite or compressed powder, an insulation film will not be necessary. Furthermore, it is particularly advantageous that each tube in this second embodiment comprises two or more core parts and that in addition an insulating layer is provided between the core parts. The tubes in this second embodiment of the invention, moreover, may have circular, square, rectangular, triangular or hexagonal cross sections.

A third embodiment of the invention relates to a magnetically influenced current or voltage regulator, characterized in that it comprises a first, external tubular body and a second, internal tubular body, each of which is composed of a magnetisable material and provides a closed, magnetic circuit, the said bodies being concentric relative to each other and thus having a common axis, at least one first electrical conductor wound round the tubular bodies for at least one turn which forms a first main winding, at least one second electrical conductor provided in the space between the bodies and wound around the bodies' common axis for at least one turn which forms a second main winding or control winding, where the winding axis for the turn or turns in the main winding is at right angles to the winding axis for the turn or turns in the control winding. The object again is to provide orthogonal magnetic fields in the bodies and thereby control the behaviour of the magnetisable material relative to the field in the main winding by means of the field in the control winding. The main winding and the control winding will also be interchangeable in this third embodiment of the invention, thus providing a magnetically influenced current or voltage regulator, where at least one first electrical conductor is provided in the space between the bodies and wound round the bodies' common axis for at least one turn which forms a first main winding, at least one second electrical conductor is wound around the tubular bodies for at least one turn which forms a second main winding or control winding, and the winding axis for the turn or turns in the main winding is at right angles to the winding axis for the turn or turns in the control winding.

A preferred variant of this third embodiment of the invention comprises first and second magnetic field connectors which together with the bodies form the closed magnetic circuit.

This third embodiment of the device can also be adapted for use as a transformer by equipping the device with a third electrical conductor wound for at least one turn which forms a third main winding. In this case too the winding axis for the turn or turns in the third main winding may either be coincident with or parallel to the winding axis for the turn or turns in the first main winding, thus providing a transformer effect between the first and the third main windings when at least one of this is excited, or the winding axis for the turn or turns in the third main winding may be coincident with or parallel to the winding axis for the turn or turns in the control winding, thus providing a transformer effect between the third main winding and the control winding when at least one of this is excited A fourth embodiment of the invention relates to a magnetically influenced current or voltage regulator, characterized in that in the same manner as in the third embodiment of the invention it comprises a first, external tubular body and a second, internal tubular body, each of which is composed of a magnetisable material and forms a closed, magnetic circuit or internal core. The device also comprises an additional tubular body which provides an external core mounted on the outside of the first, external tubular body, where the bodies are concentric relative to each other and thus have a common axis, at least one first electrical conductor wound round the tubular bodies for at least one turn which forms a first main winding, at least one second electrical conductor provided in the space between the first and the second body and wound around the bodies' common axis for at least one turn which forms a second main winding or control winding, where the winding axis for the turn or turns in the main winding is at right angles to the winding axis for the turn or turns in the control winding. The object again is to provide orthogonal magnetic fields in the body and thereby control the behaviour of the magnetisable material relative to the field in the main winding by means of the field in the control winding. In the same way as in the second embodiment of the invention, the main winding and the control winding may be interchangeable, thus providing a device where at least one first electrical conductor is provided in the space between the first and the second bodies and wound round the bodies' common axis for at least one turn which forms a second main winding or control winding, at least one second electrical conductor is wound around the tubular bodies for at least one turn which forms a second main winding or control winding.

A preferred variant of this fourth embodiment of the invention comprises first and second magnetic field connectors which together with the bodies form the closed magnetic circuit.

This fourth embodiment of the device can also be adapted for use as a transformer by equipping it with a third electrical conductor wound around the external core for one turn which forms a third main winding. In this case too there will be two alternatives: one where the winding axis for the turn or turns in the third main winding is coincident with or parallel to the winding axis for the turn or turns in the first main winding, thus providing a transformer effect between the first and the third main windings when at least one of this is excited, and one where the winding axis for the turn or turns in the third main winding is coincident with or parallel to the winding axis for the turn or turns in the control winding, thus providing a transformer effect between the third main winding and the control winding when at least one of this is excited.

It is, of course, possible to implement this fourth embodiment of the invention in such a manner that the two tubular bodies which form the internal core are mounted on the outside of the tubular body forming the external core, thus providing an internal core with one tubular body and an external core with two tubular bodies.

In a preferred variant of this fourth embodiment of the invention, the device is characterized in that the external core consists of several annular parts, and that the first and/or the third main winding forms individual windings around each annular part. A second possibility is that the control winding and/or the third main winding form individual windings around each annular part.

The fourth embodiment will be the one which will be preferred in principle.

The device according to the invention will have many interesting applications, of which we shall mention only a few. These are: a) as a component in a frequency converter for converting input frequency to randomly selected output frequency preferably intended for operation of an asynchronous motor, in a cycloconverter connection, b) as a connector in a frequency converter for converting input frequency to randomly selected output frequency and intended for operation of an asynchronous motor, for addition of parts of the phase voltage generated from a 6 or 12-pulse transformer to each motor phase, c) as a DC to AC converter which converts DC voltage/current to an AC voltage/current of randomly selected output frequency, d) as in c) but where three such variable inductance voltage converters are interconnected in order to generate a three-phase voltage with randomly selected output frequency which is connected to the said asynchronous machine, e) for converting AC voltage to DC voltage within the processing industry, where the device is used as a reluctance-controlled variable transformer where the output voltage is proportional to the reluctance change in a core which is magnetically connected in parallel or in series to an external or internal core with a separate secondary winding, and where three or more such reluctance-controlled transformers are connected to the known three-phase rectifier connections for 6 or 12-pulse rectifier connections for diode output stage, f) for use in a rectifier for converting AC voltage to DC voltage for use in the processing industry, where the device forms voltage connectors which are used as variable inductances in series with primary windings on known transformer connectors, and where three or more such transformers are connected to three-phase rectifier connectors for 6 or 12-pulse rectifier connectors for diode output stage, g) for AC/DC or DC/AC converters for use in the field of switched power supply, for reduction of the size of the magnetic voltage converter, where the device forms a reluctance-controlled variable transformer where the output voltage is proportional to the reluctance change in a core which is magnetically connected in parallel or in series to an external or internal core with a separate secondary winding, preferably by filters in which inductance is included being formed with a variable inductance, h) as a component in a controllable voltage compensator in the high voltage distribution network, where the device forms a linear variable inductance, i) as a component in a controllable reactive power compensator (VAR compensator), where the device creates linear variable inductance in connection with known filter circuits in which at least one condenser also forms an element, the device in the form of a reluctance-controlled transformer being employed as an element in a compensator connection where capacitance or inductance are automatically connected and adjusted to the extent required to compensate for the reactive power, j) in a system for reluctance-controlled direct conversion of an AC voltage to a DC voltage, k) in a system for reluctance-controlled direct conversion of a DC voltage to an AC voltage.

The voltage connector is without movable parts for absorbing electrical voltage between a generator and a load. The function of the connector is to be able to control the voltage between the generator and the load from 0–100% by means of a small control current. A second function will be as a pure voltage switch or as a current regulator. A further function could be forming and converting of a voltage curve.

The new technology according to the invention will be able to be used for upgrading existing diode rectifiers where there is a need for regulation. In connection with 12-pulse or 24-pulse rectifier systems, it will be possible to balance voltages in the system in a simple manner while having controllable diode rectification from 0–100%.

The current or voltage regulator according to the invention is implemented in the form of a magnetic connector substantially without movable parts, and it will be able to be used for connecting and thereby transferring electrical energy between a generator and a load. The function of the magnetic connector is to be capable of closing and opening an electrical circuit.

The connector will therefore act in a different way to a transductor where the transformer principle is employed in order to saturate the core. The present connector controls the working voltage by bringing the main core with a main winding in and out of saturation by means of a control winding. The connector has no noticeable transformative or inductive connection between the control winding and the main winding (in contrast to a transductor), i.e. no noticeable common flux is produced for the control winding and the main winding.

This new magnetically controlled connector technology will be capable of replacing semiconductors such as GTO's in high-powered applications, and MosFet or IGBT in other applications, except that it will be limited to applications which can withstand stray currents which are produced by the main winding's magnetisation no-load current. As mentioned in the introduction, the new converter will be particularly suitable for realising a frequency converter which converts alternating current power with a given frequency to alternating current power which has a different selected output frequency. No intermediate DC connection will be necessary in this case.

As mentioned at the beginning, the device according to the invention is capable of being employed in connection with frequency converters, such as those based on the cycloconverter principle, but also frequency converters based on 12-pulse bridge converters, or by direct conversion of DC voltage to AC voltage of variable frequency.

The principle of the device according to the invention, where a variable reluctance is employed in a magnetisable body or main core, is based on the fact that magnetisation current in a main winding, which is wound round a main core, is limited by the flux resistance according to Faraday's Law. The flux which has to be established in order to generate counter-induced voltage is dependent on the flux resistance in the magnetic core. The magnitude of the magnetisation current is determined by the amount of flux which has to be established in order to balance applied voltage.

The flux resistance in a coil where the core is air is of the order of 1.000–900.000 times greater than for a winding which is wound round a core of ferromagnetic material. In the case of low flux resistance (iron core) little current is required to establish a flux which is necessary to generate a bucking voltage to the applied voltage, according to Faraday's Law. In the case of high flux resistance (air core) a large current is required in order to establish the flux necessary to generate the same induced bucking voltage.

By controlling the flux resistance, the magnetisation current or the load current in the circuit can be controlled. In order to control the flux resistance, according to the invention a saturation of the main core is employed by means of a control flux which is orthogonal relative to the flux generated by the main winding. As already mentioned, the above-mentioned principle forms the basis of the invention, which relates to a magnetically influenced current or voltage regulator (connector) and a magnetically influenced converter device.

It will be appreciated that both the connector and the converter can be produced by means of suitable production equipment for toroidal cores. From the technical point of view, the converter can be produced by magnetic material such as electroplating being wound up in suitably designed cylindrical cores or used for higher frequencies with compressed powder or ferrite. It is, of course, also advantageous to produce ferrite cores or compressed powder cores according to the dictates of the application.

The invention will now be described in greater detail with reference to the attached drawings, in which:

FIGS. 1 and 2 illustrate the basic principle of the invention and a first embodiment thereof.

Figure 59:
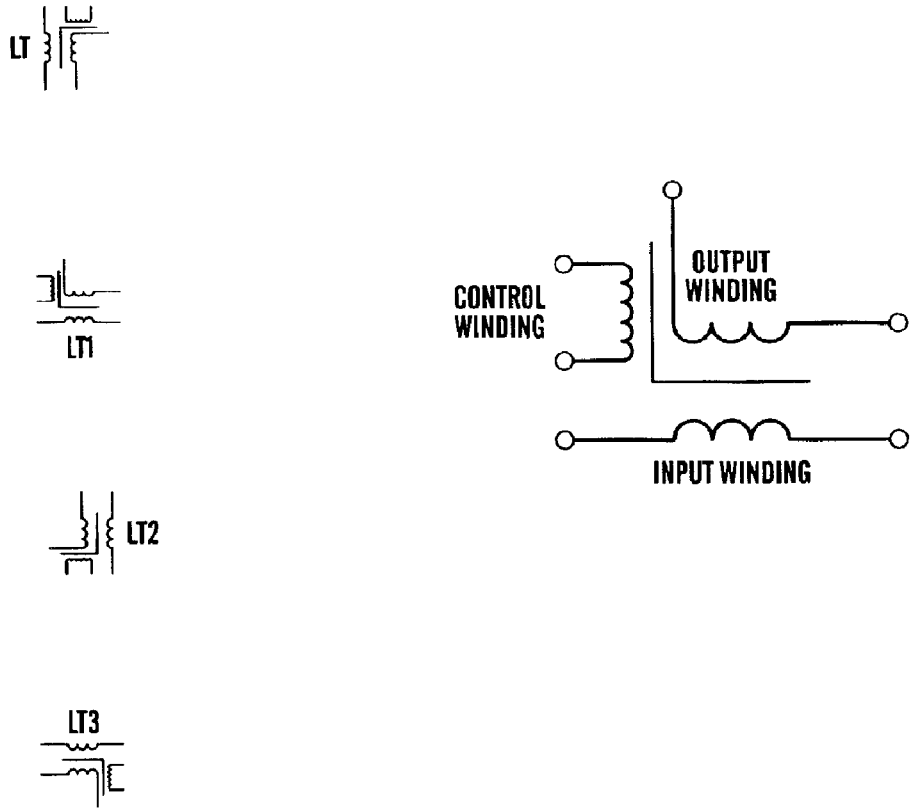
Figure 60:
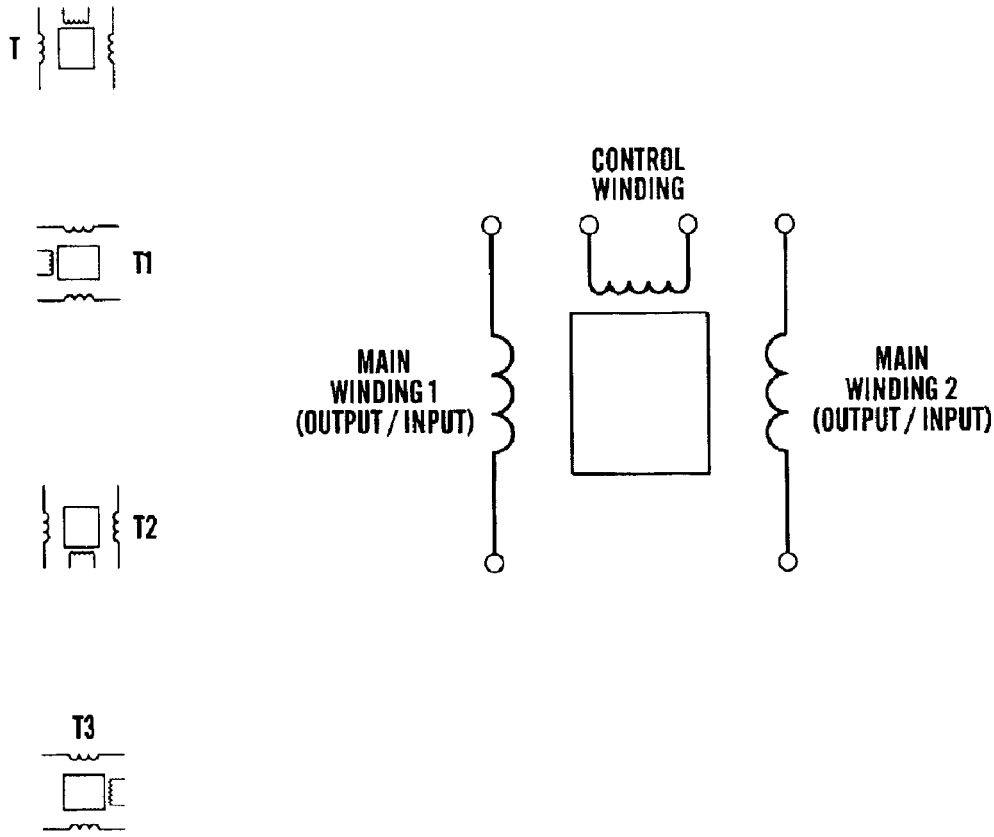

In FIGS. 59 and 60 there are proposals for electro-technical schematic symbols for the voltage converter according to the invention.

Figure 61:
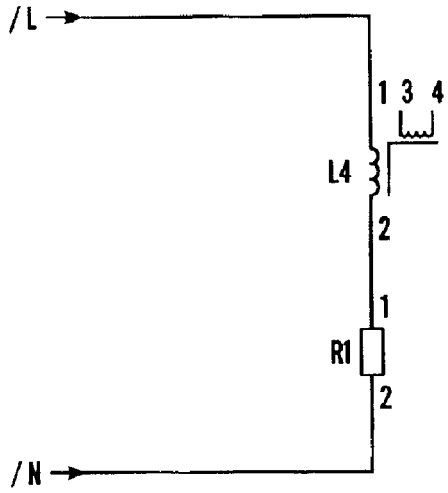

FIG. 61 illustrates the use of the invention in an alternating current circuit.

Figure 62:
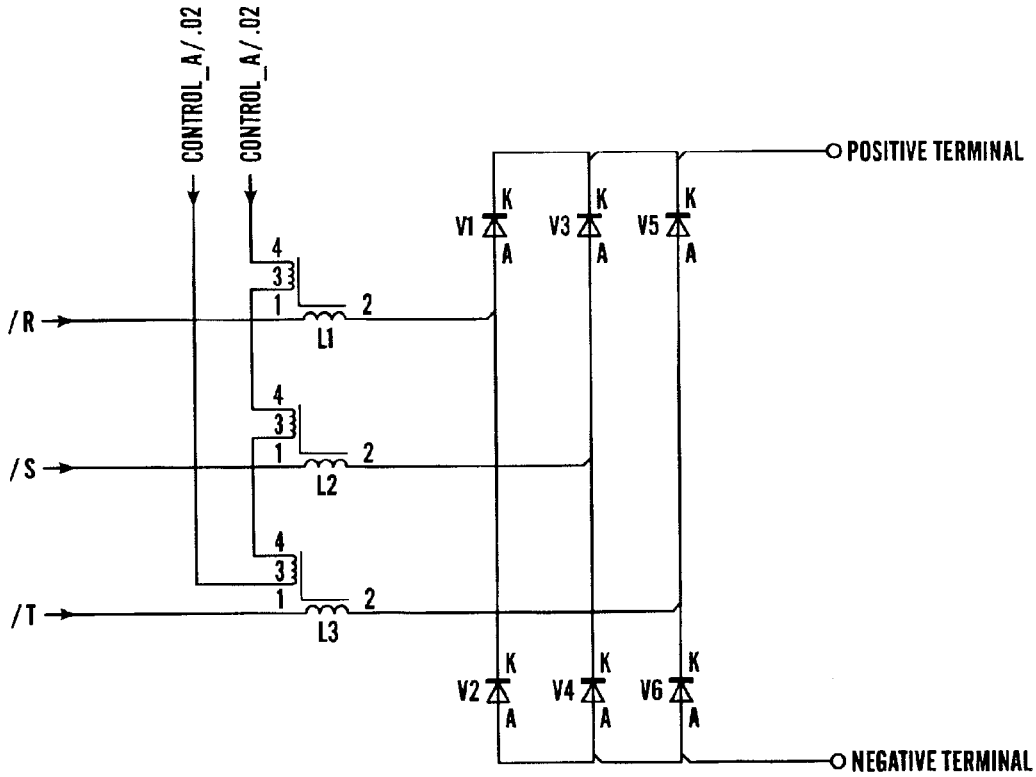
Figure 62A:
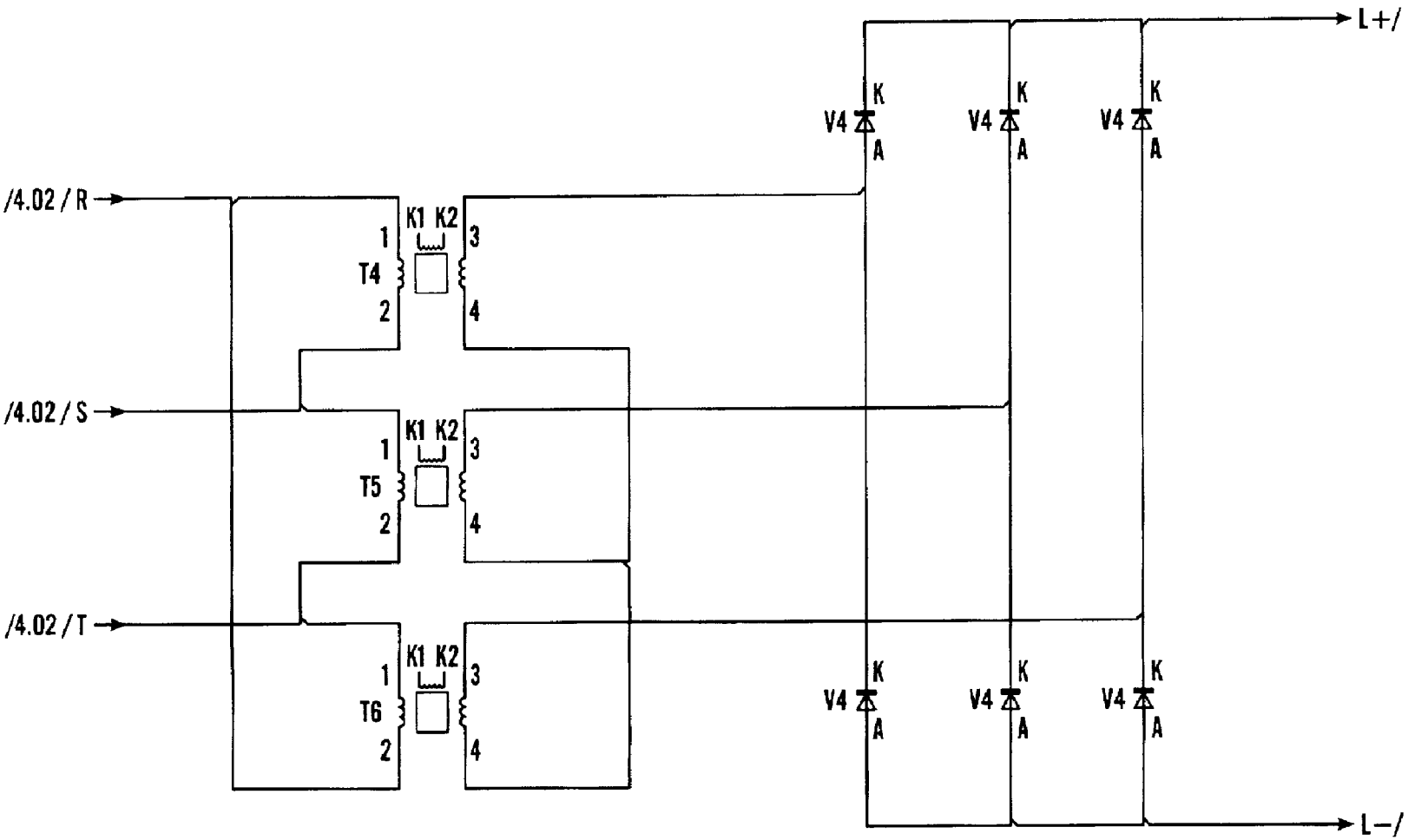

FIG. 62 illustrates the use of the invention in a three-phase system.

Figure 63:
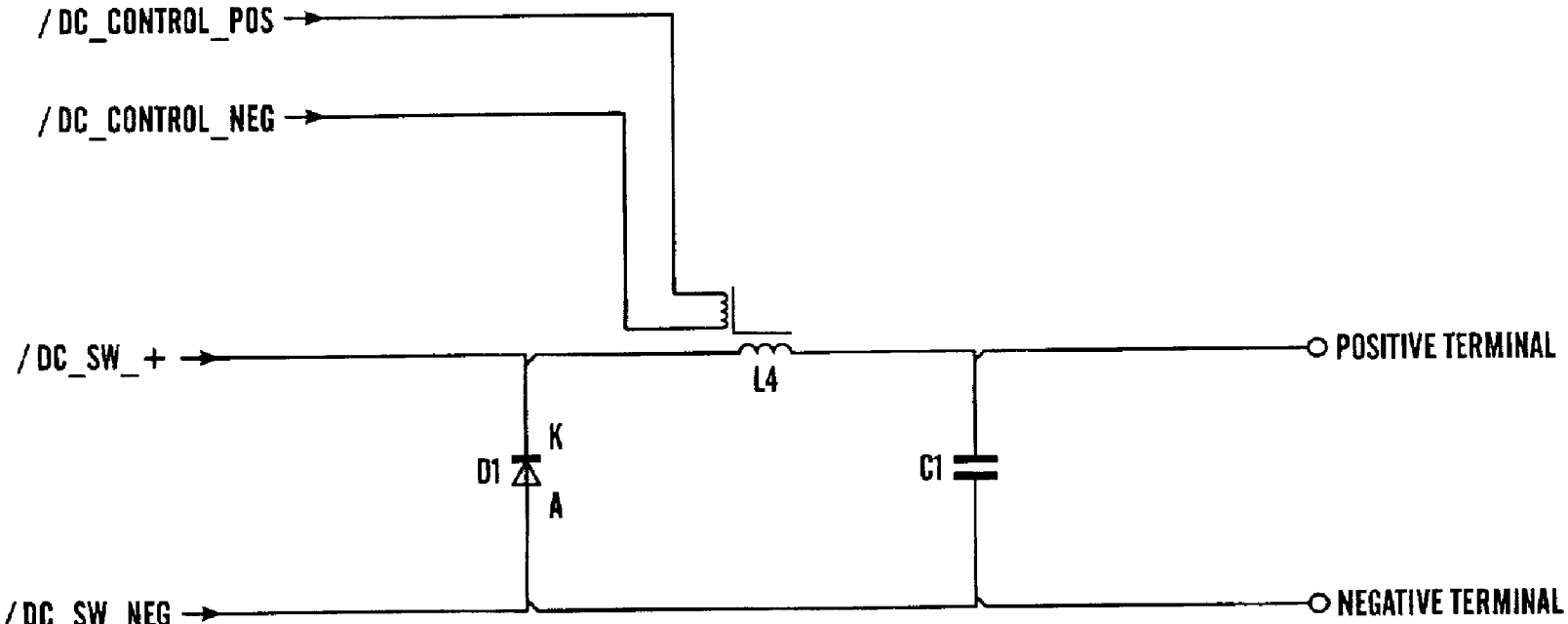

FIG. 63 illustrates a use as a variable choke in DC—DC converters.

Figure 64A:
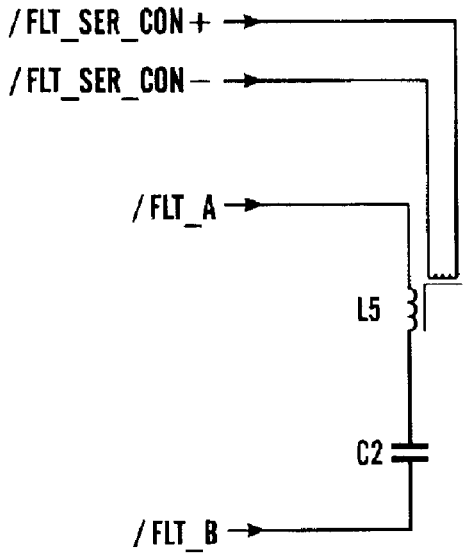
Figure 64B:
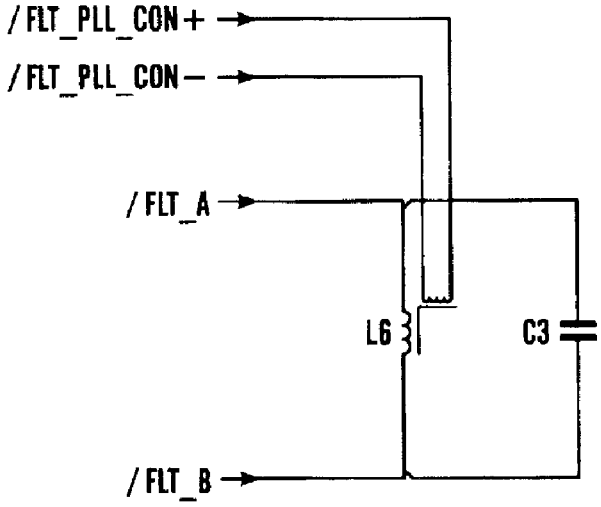

FIG. 64 illustrates a use as a variable choke in a filter together with condensers.

Figure 65A:
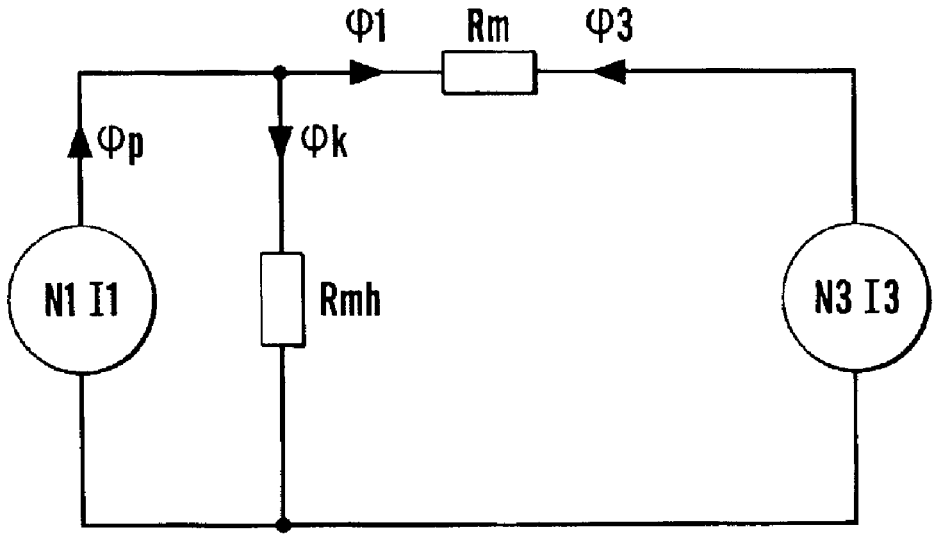

FIG. 65 illustrates a simplified reluctance model for the device according to the invention and a simplified electrical equivalent diagram for the connector according to the invention.

Figure 66:
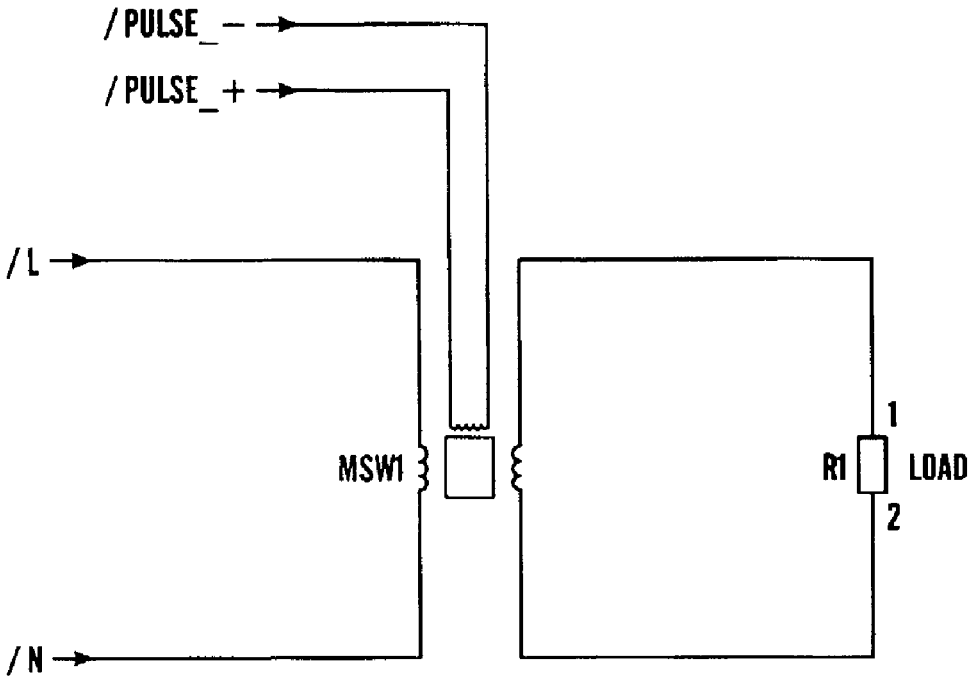

FIG. 66 illustrates the connection for a magnetic switch.

Figure 67:
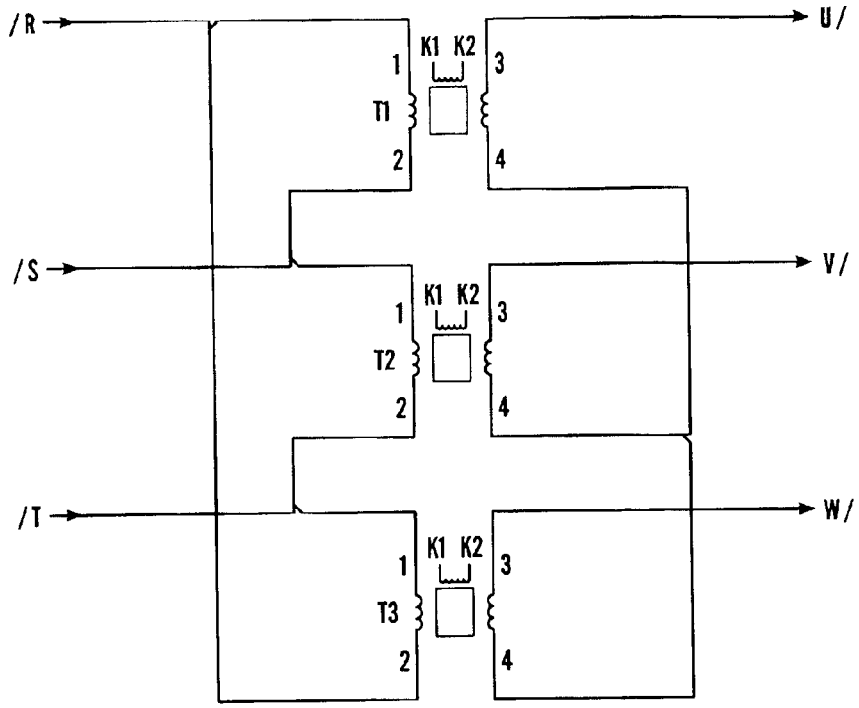

FIG. 67 illustrates examples of a three-phase use of the invention.

Figure 68:
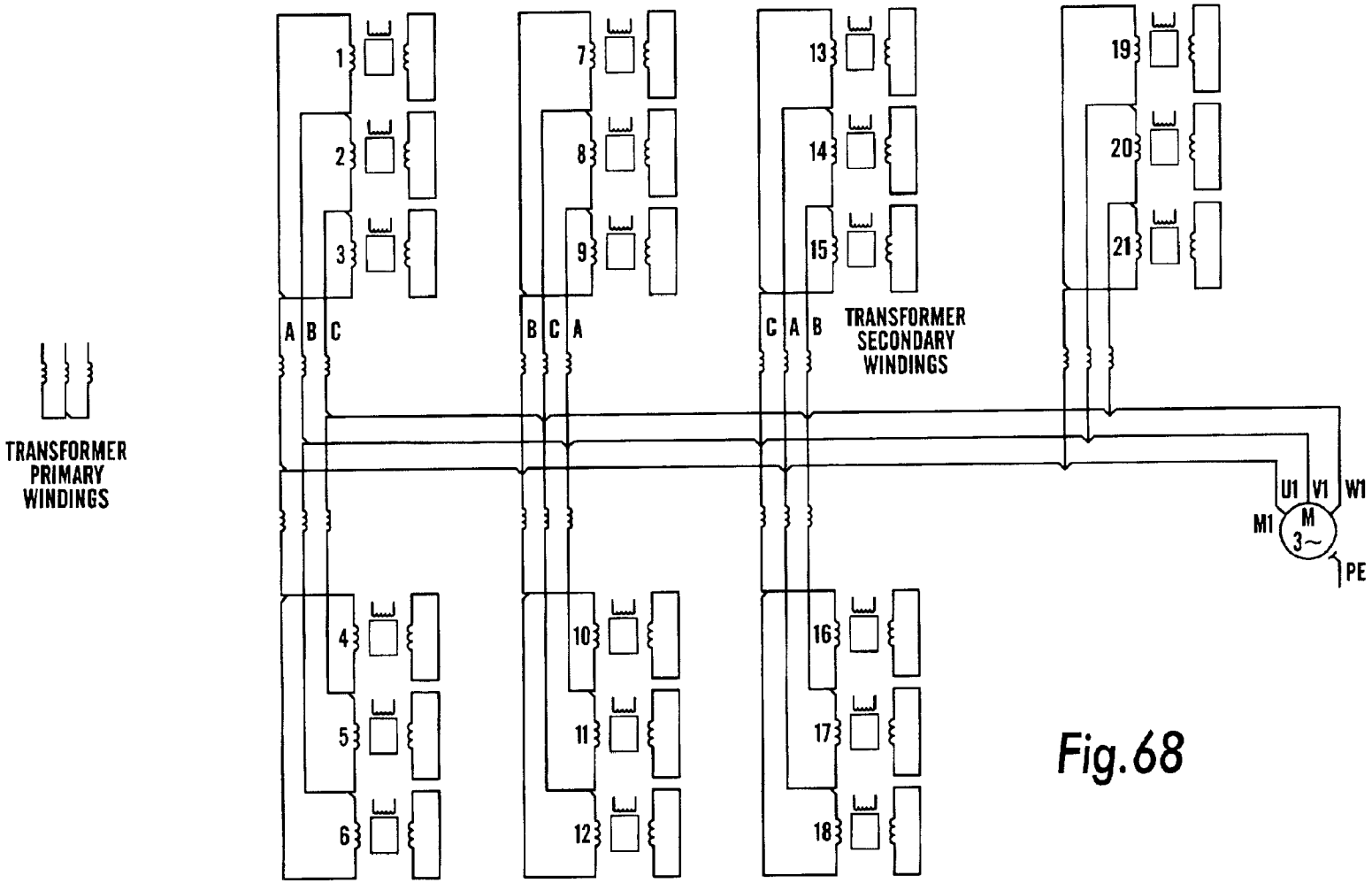

FIG. 68 illustrates the device employed as a switch.

Figure 69:
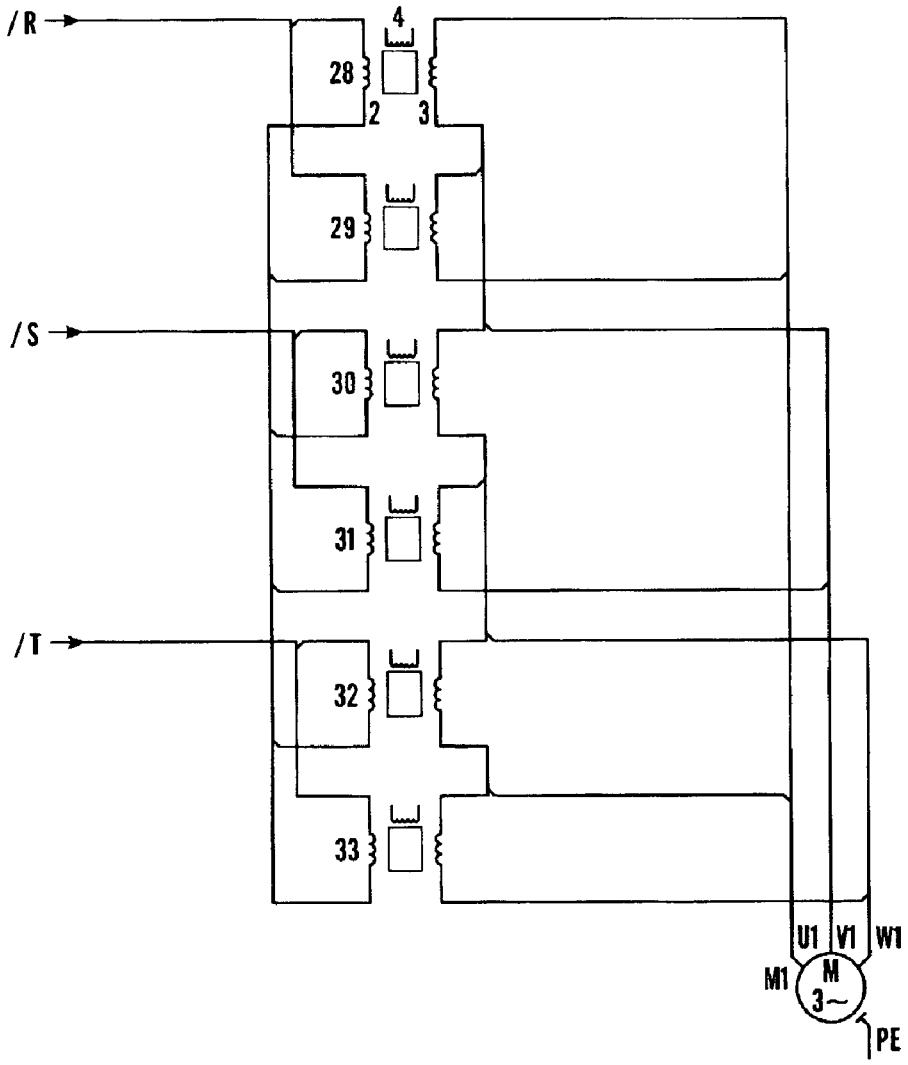

FIG. 69 illustrates a circuit comprising 6 devices according to the invention.

Figure 70:
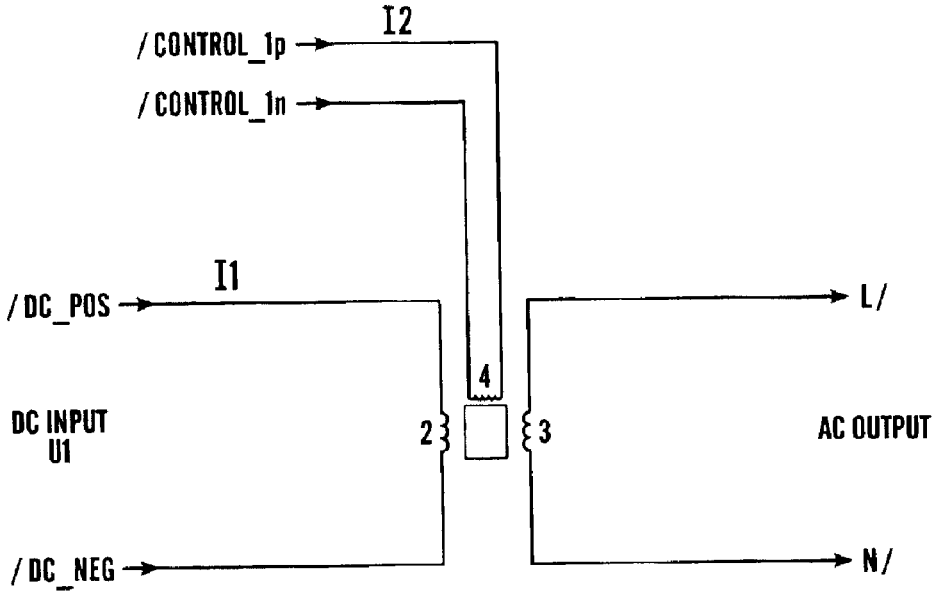
Figure 70A:
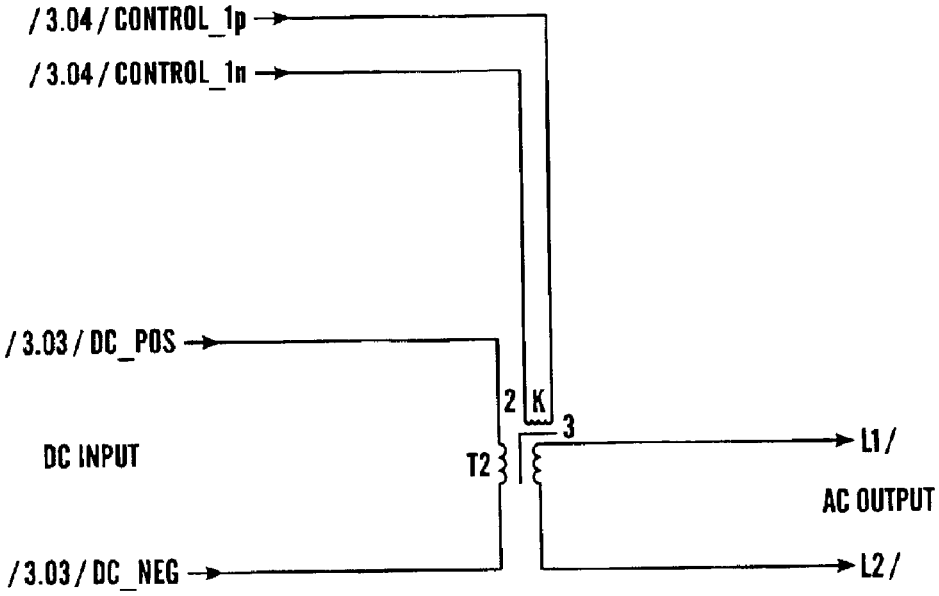

FIG. 70 illustrates the use of the device according to the invention as a DC-AC converter.

Figure 71:
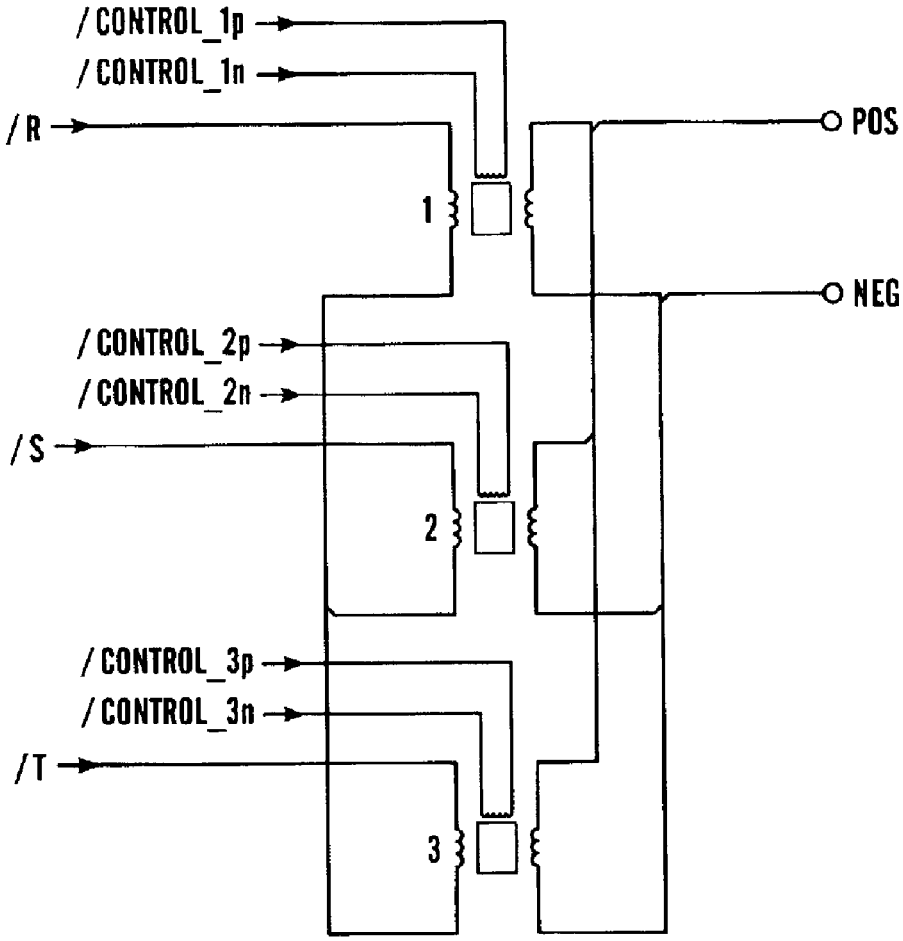
Figure 71A:
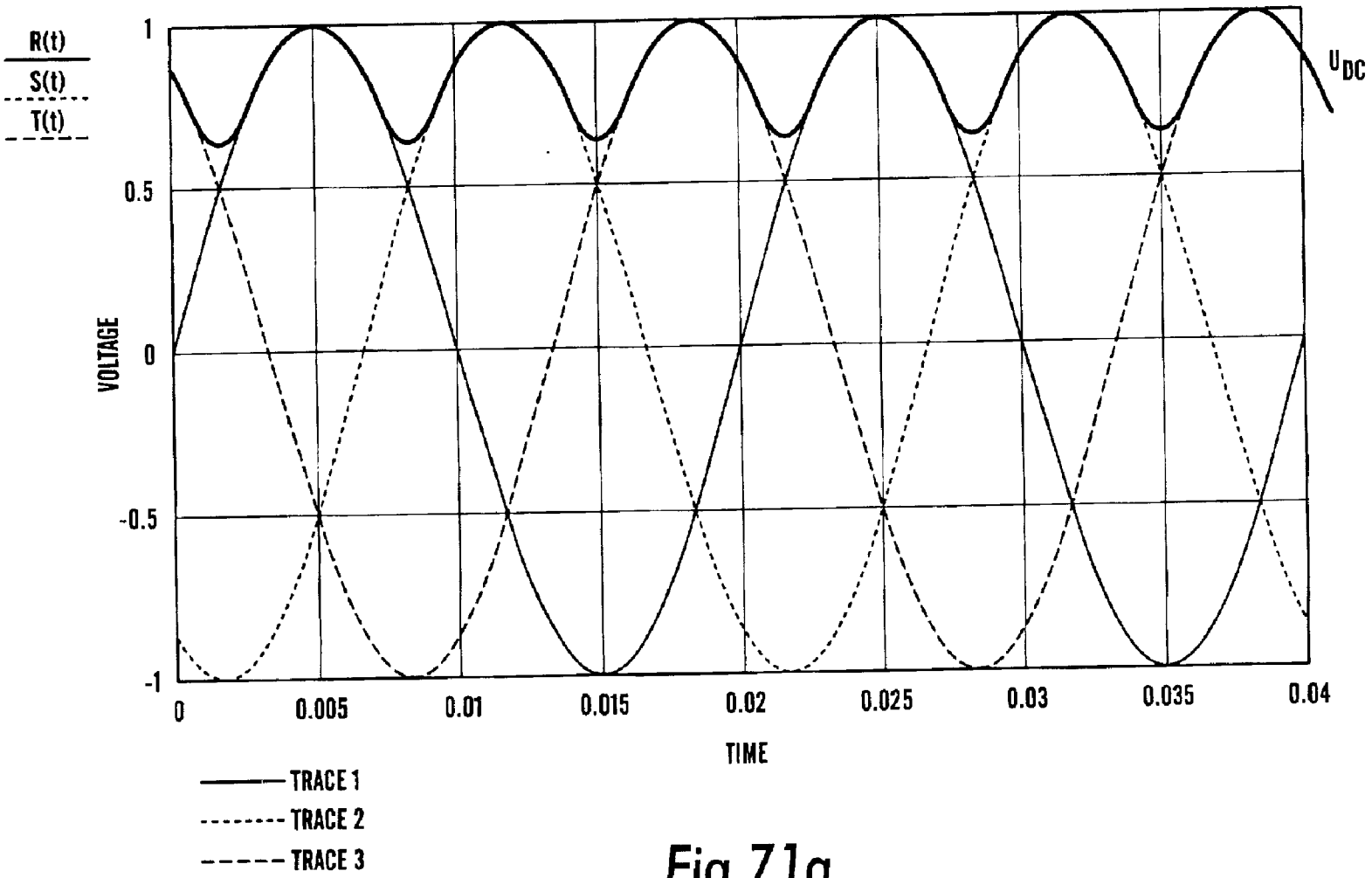

FIG. 71 illustrates a use of the device according to the invention as an AC-DC converter.

The invention will now be explained in principle in connection with FIGS. 1*a* and 1*b*.

In the entire description, the arrows associated with magnetic field and flux will substantially indicate the directions thereof within the magnetic material. The arrows are drawn on the outside for the sake of clarity.

Figure 1A:
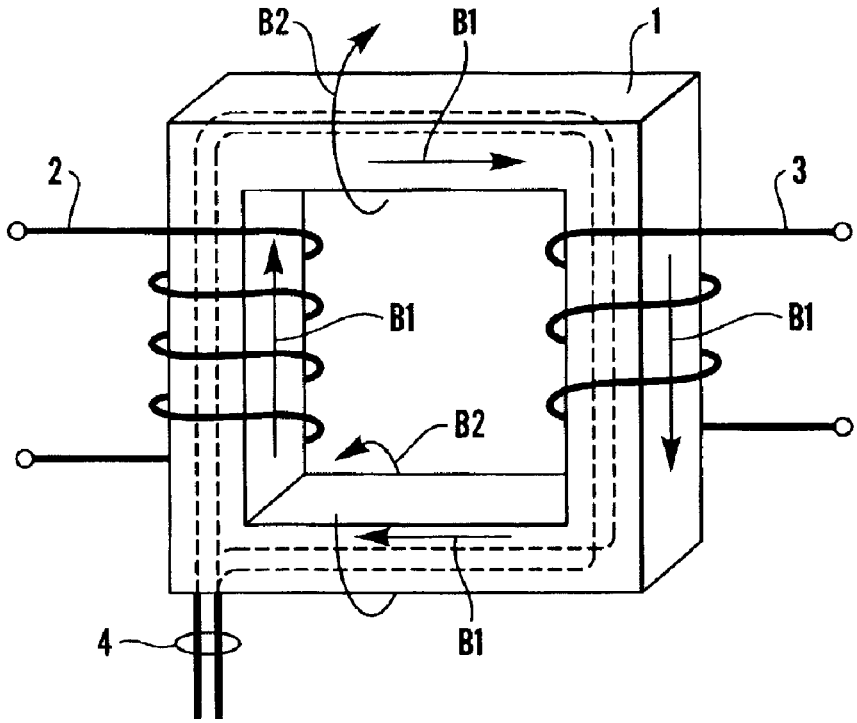
Figure 1B:
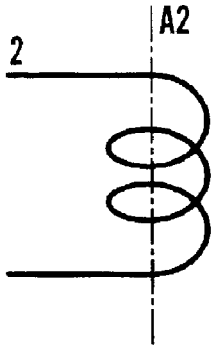
Figure 1C:
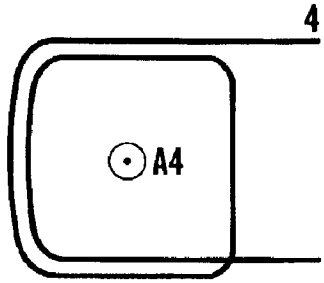
Figure 1D:
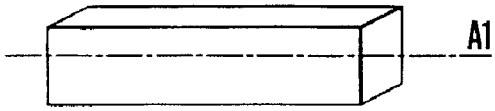
Figure 1E:
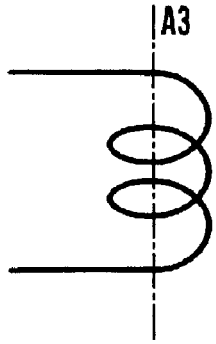
Figure 1F:
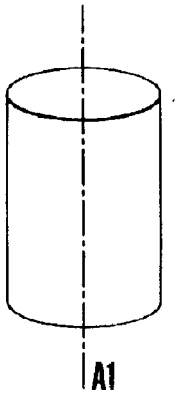
Figure 1G:
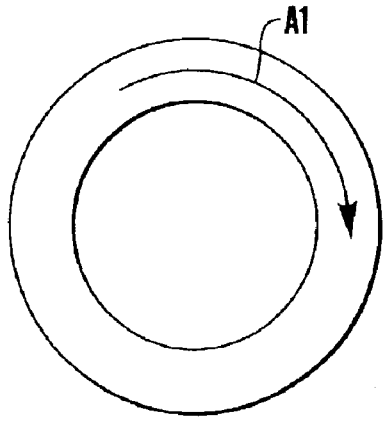
Figure 3:
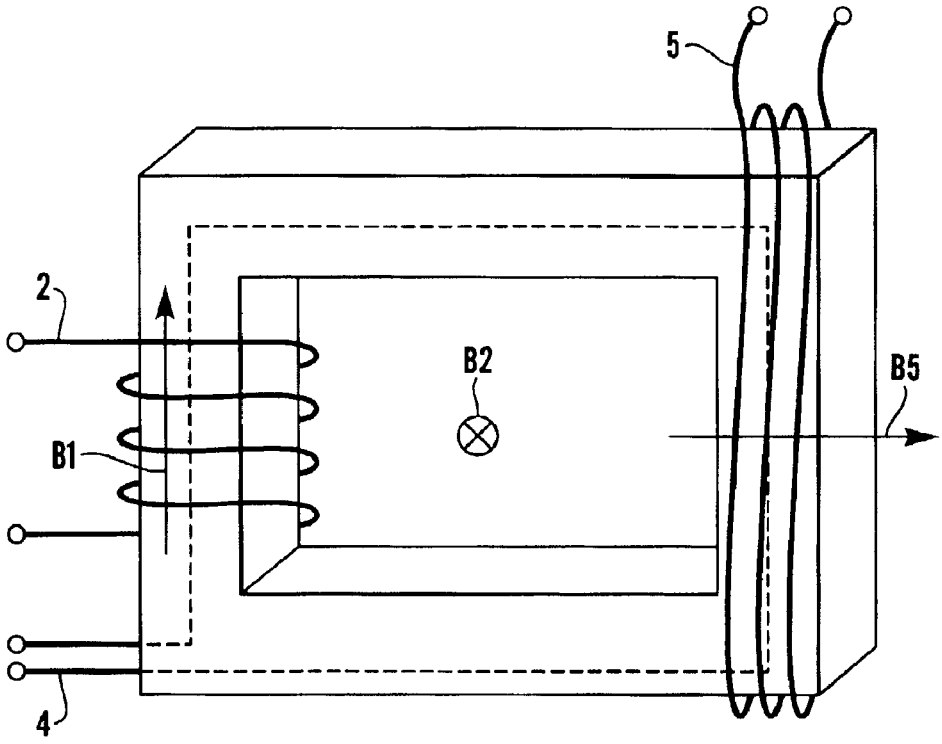
FIG. 3 is a schematic illustration of an embodiment of the device according to the invention.

FIG. 1*a* illustrates a device comprising a body 1 of a magnetisable material which forms a closed magnetic circuit. This magnetisable body or core 1 may be annular or of another suitable shape. Round the body 1 is wound a first main winding 2, and the direction of the magnetic field H1 (corresponding to the direction of the flux density B1) which will be created when the main winding 2 is excited will follow the magnetic circuit. The main winding 2 corresponds to a winding in an ordinary transformer. In an embodiment the device includes a second main winding 3 which in the same way as the main winding 2 is wound round the magnetisable body 1 and which will thereby provide a magnetic field which extends substantially along the body 1 (i.e. parallel to H1, B1). The device finally includes a third main winding 4 which in a preferred embodiment of the invention extends internally along the magnetic body 1. The magnetic field H2 (and thus the magnetic flux density B2) which is created when the third main winding 4 is excited will have a direction which is at right angles to the direction of the fields in the first and the second main winding (direction of H1, B1). The invention may also include a fourth main winding 5 which is wound round a leg of the body 1. When the fourth main winding 5 is excited, it will produce a magnetic field with a direction which is at right angles both to the field in the first (H1), the second and the third main winding (H2) (FIG. 3). This will naturally require the use of a closed magnetic circuit for the field which is created by the fourth main winding. This circuit is not illustrated in the figure, since the figure is only intended to illustrate the relative positions of the windings.

In the topologies which are considered to be preferred in the present description, however, it is the case that the turns in the main winding follow the field direction from the control field and the turns in the control winding follow the field direction to the main field.

FIGS. 1*b*–1*g* illustrate the definition of the axes and the direction of the different windings and the magnetic body. With regard to the windings, we shall call the axis the perpendicular to the surface which is restricted by each turn. The main winding 2 will have an axis A2, the main winding 3 an axis A3 and the control winding 4 an axis A4.

With regard to the magnetisable body, the longitudinal direction will vary with respect to the shape. If the body is elongated, the longitudinal direction A1 will correspond to the body's longitudinal axis. If the magnetic body is square as illustrated in FIG. 1*a*, a longitudinal direction A1 can be defined for each leg of the square. Where the body is tubular, the longitudinal direction A1 will be the tube's axis, and for an annular body the longitudinal direction A1 will follow the ring's circumference.

The invention is based on the possibility of altering the characteristics of the magnetisable body 1 in relation to a first magnetic field by altering a second magnetic field which is at right angles to the first. Thus, for example, the field H1 can be defined as the working field and control the body's 1 characteristics (and thereby the behaviour of the working field H1) by means of the field H2 (hereinafter called control field H2). This will now be explained in more detail.

The magnetisation current in an electrical conductor which is enclosed by a ferromagnetic material is limited by the reluctance according to Faraday's Law. The flux which has to be established in order to generate counterinduced voltage depends on the reluctance in the magnetic material enclosing the conductor.

The extent of the magnetisation current is determined by the amount of flux which has to be established in order to balance applied voltage.

In general the following steady-state equation applies for sinusoidal voltage:

1) Flux:

$$\Phi = -j\frac{1}{N\cdot\omega}\cdot E$$

E=applied voltage

ω=angular frequency

N=number of turns for winding where the flux Φ through the magnetic material is determined by the voltage E. The current required in order to establish necessary flux is determined by:

2) Current $$I = \Phi \cdot \frac{Rm}{N} \quad \Phi = \frac{I}{Rm} \cdot N$$

3) Reluctance (Flux Resistance)

$$Rm = \frac{1j}{\mu_0 \cdot \mu r \cdot Aj}$$

lj=length of flux path
$\mu r$=relative permeability
$\mu o$=permeability in vacuum
Aj=cross-sectional area of the flux path Where there is low reluctance (iron enclosure), according to expression 2) above, little current will be required in order to establish the necessary flux, and supplied voltage will overlay the connector. In the case of high reluctance (air) on the other hand, a large current will be required in order to establish the necessary flux. In this case the current will then be limited by the voltage over the load and the voltage induced in the connector. The difference between reluctance in air and reluctance in magnetic material may be of the order of 1.000–900.000.

The magnetic induction or flux density in a magnetic material is determined by the material's relative permeability and the magnetic field intensity. The magnetic field intensity is generated by the current in a winding arranged round or through the material.

For the systems which have to be evaluated the following applies:

The field intensity $$\int \overline{H}.\overline{ds} = I.N$$

$\overline{H}$=field intensity
s=the integration path
I=current in winding
N=number of windings Flux Density or Induction:

$$\overline{\beta} = \mu_0 \mu r \, \bar{H}$$

$\overline{H}$=magnetic field intensity

The ratio between magnetic induction and field intensity is non-linear, with the result that when the field intensity increases above a certain limit, the flux density will not increase and on account of a saturation phenomenon which is due to the fact that the magnetic domains in a ferromagnetic material are in a state of saturation. Thus it is desirable to provide a control field H2 which is perpendicular to a working field H1 in the magnetic material in order to control the saturation in the magnetisable material, while avoiding magnetic connection between the two fields and thereby avoiding transformative or inductive connection. Transformative connection means a connection where two windings "share" a field, with the result that a change in the field from one winding will lead to a change in the field in the other winding.

One will avoid increasing H to saturation as by a transformative connection where the fluxes will have a common path and will be added together. If the fluxes are orthogonal they will not be added together. For example, by providing the magnetic material as a tube where the main winding or the winding which carries the working current is located inside the tube and is wound in the tube's longitudinal direction, and where the control winding or the winding which carries the control current is wound round the circumference of the tube, the desired effect is achieved. Depending on the tube dimensions, a small area for the control flux and a large area for the working flux are thereby also achieved.

In the said embodiment, the working flux will travel in the direction along the tube's circumference and have a closed magnetic circuit. The control flux on the other hand will travel in the tube's longitudinal direction and will have to be connected in a closed magnetic circuit, either by two tubes being placed in parallel and a magnetic material connecting the control flux between the two tubes, or by a first tube being placed around a second tube, with the result that the control winding is located between the two tubes, and the end surfaces of the tubes are magnetically interconnected, thereby obtaining a closed path for the control flux. These solutions will be described in greater detail later.

The parts which provide magnetic connection between the tubes or the core parts will hereinafter be called magnetic field connectors or magnetic field couplings.

The total flux in the material is given by $$\Phi = B \cdot Aj \qquad 4)$$

Figure 4A:
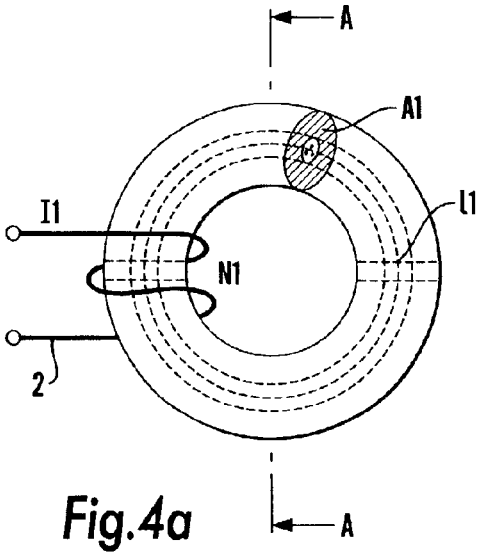
FIG. 4 illustrates the areas of the different magnetic fluxes which form part of the device according to the invention.
Figure 4B:
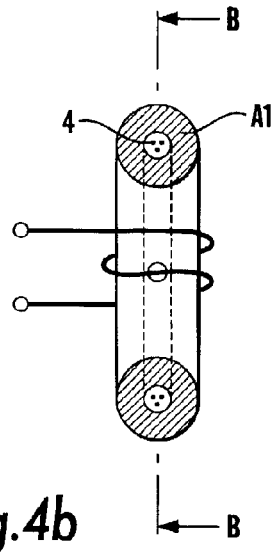
Figure 4C:
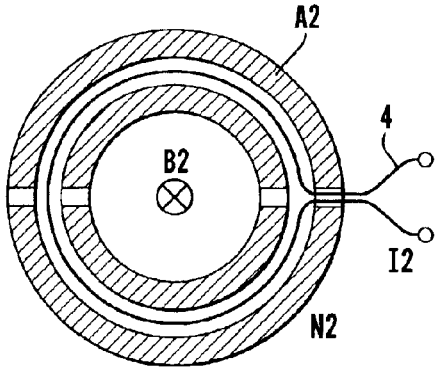
Figure 4D:
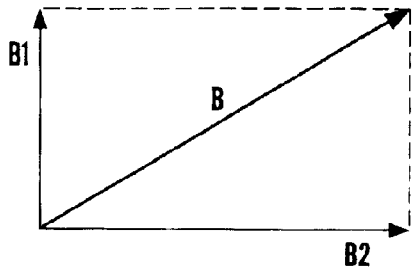

The flux density B is composed of the vector sum of B1 and B2 (FIG. 4*d*). B1 is generated by the current I1 in the first main winding 2, and B1 has a direction tangentially to the conductors in the main winding 2. The main winding 2 has N1 turns and is wound round the magnetisable body 1. B2 is generated by the current I2 in the control winding 4 with N2 number of turns and where the control winding 4 is wound round the body 1. B2 will have a direction tangentially to the conductors in the control winding 4.

Since the windings 2 and 4 are placed at 90° to each other, B1 and B2 will be orthogonally located. In the magnetisable body 1, B1 will be oriented transversally and B2 longitudinally. In this connection we refer particularly to what is illustrated in FIGS. 1–4.

$$\overline{B} = \bar{B}_1 + \bar{B}_2 \qquad 5)$$

It is considered an advantage that the relative permeability is higher in the working field's (H1) direction than in the control field's (H2) direction, i.e. the magnetic material in the magnetisable body 1 is anisotropic, but of course this should not be considered limiting with regard to the scope of the invention.

The vector sum of the fields H1 and H2 will determine the total field in the body 1, and thus the body's 1 condition with regard to saturation, and will be determining for the magnetisation current and the voltage which is divided between a load connected to the main winding 2 and the connector. Since the sources for B1 and B2 will be located orthogonally to each other, none of the fields will be able to be decomposed into the other. This means that B1 cannot be a function of B2 and vice versa. However, B, which is the vector sum of B1 and B2 will be influenced by the extent of each of them.

B2 is the vector which is generated by the control current. The cross-sectional surface A2 for the B2 vector will be the transversal surface of the magnetic body 1, cf. FIG. 4*c*. This may be a small surface limited by the thickness of the magnetisable body 1, given by the surface sector between the internal and external diameters of the body 1, in the case of an annular body. The cross-sectional surface A1 (see FIGS. 4*a, b*) for the B1 field on the other hand is given by the length of the magnetic core and the rating of applied voltage. This surface will be able to be 5–10 times larger than the surface of the control flux density B2, without this being considered limiting for the invention.

When B2 is at saturation level, a change in B1 will not result in a change in B. This makes it possible to control which level on B1 gives saturation of the material, and thereby control the reluctance for B.

The inductance for the control winding 4 (with N2 turns) will be able to be rated at a small value suitable for pulsed control of the regulator, i.e. enabling a rapid reaction (of the order of milliseconds) to be provided.

6)

$$Ls = N2^2 \cdot \mu_{r-sat} \cdot \mu_0 \cdot \frac{A2}{l2}$$

N2=Number of turns for control winding

A2=Area of control flux density B2 l2=Length of flux path for control flux

A simplified mathematical description will now be given of the invention and its applications, based on Maxwell's equations.

For simple calculations of magnetic fields in electrical power technology, Maxwell's equations are used in integral form.

In a device of the type which will be analysed here (and to some extent also in the invention), the magnetic field has low frequency.

The displacement current can thus be neglected compared with the current density.

Maxwell's equation $$curl(\overline{H}) = \overline{J} + \frac{d}{dt}\overline{D} \quad 7)$$

is simplified to $$curl(\overline{H}) = \overline{J} \quad 8)$$

The integral form is found in Toke's theorem:

$$\int(\overline{H})\overline{dl} = I \quad 9)$$

presents a solution for the system in FIG. 4, where the main winding 2 establishes the H1 field. The calculations are performed here with concentrated windings in order to be able to focus on the principle and not an exact calculation.

The integration path coincides with the field direction and an average field length 11 is chosen in the magnetisable body 1. The solution of the integral equation then becomes:

$$H_1 I_1 = N_1 \cdot I_1 \quad 11)$$

This is also known as the magnetomotive force MMK.

$$F_1 = N_1 \cdot I_1 \quad 12)$$

The control winding 4 will establish a corresponding MMK generated by the current I2:

$$H_2 \cdot I_2 = N_2 \cdot I_2 \quad 13)$$

$$F_2 = N_2 \cdot I_2 \quad 14)$$

The magnetisation of the material under the influence of the H field which is generated from the source windings 2 and 4 is expressed by the flux density B. For the main winding 2:

$$\overline{B_1} = \mu_0 \mu r_1 \cdot \overline{H}_1 \quad 15)$$

For the control winding 4:

$$\overline{B_2} = \mu_0 \mu r_2 \cdot \overline{H}_2 \quad 16).$$

The permeability in the transversal direction is of the order of 1 to 2 decades less than for the longitudinal direction. The permeability for vacuum is:

$$\mu_0 = 4 \cdot \pi \cdot 10^{-7} \cdot \frac{H}{m} \quad 17)$$

The capacity to conduct magnetic fields in iron is given by $\mu_r$, and the magnitude of $\mu$ is from 1000 to 100.000 for iron and for the new Metglas materials up to 900.000.

By combining equations 11) and 15), for the main winding 2 we get:

$$B_1 = \mu_o \cdot \mu_r \cdot \frac{N_1 \cdot I_1}{l_1} \quad 18)$$

The flux in the magnetisable body 1 from the main winding 2 is given by equation:

$$\Phi_1 = \int_{Aj}{}^{0}\overline{B}_1 \cdot \overline{n} ds \quad 19)$$

Assuming the flux is constant over the core cross section:

$$\Phi_1 = B_1 \cdot A_1 = \mu_0 \cdot \mu_r \frac{N_1 I_1 A_1}{l_1} \quad 20)$$

Here we recognise the expression for the flux resistance Rm or the reluctance as given under 3):

$$\Phi_1 = \frac{N_1 I_1}{Rml} \quad 21)$$

$$Rm_1 = \frac{l_1}{\mu_0 \cdot \mu_r \cdot A_1} \quad 22)$$

In the same way we find flux and reluctance for the control winding 4:

$$\Phi_2 = \frac{N_2 \cdot I_2}{Rm_2} \quad 23)$$

$$Rm_2 = \frac{l_2}{\mu_0 \cdot \mu r_2 \cdot A_2} \quad 24)$$

The invention is based on the physical fact that the differential of the magnetic field intensity which has its source in the current in a conductor is expressed by curl to the H field. Curl to H says something about the differential or the field change of the H field across the field direction of H. In our case we have calculated the field on the basis that the surface perpendicular of the differential field loop has the same direction as the current. This means that the fields from the current-carrying conductors forming the windings which are perpendicular to each other are also orthogonal. The fact that the fields are perpendicular to each other is important in relation to the orientation of the domains in the material.

Before examining this more closely, let us introduce self-inductance which will play a major role in the application of the new magnetically controlled power components.

According to Maxwell's equations, a time-varying magnetic field will induce a time-varying electrical field, expressed by $$\int \overline{E} \cdot \overline{dl} = \frac{d}{dt}\left(\int_S \overline{B} \cdot \overline{n} ds\right) \quad 25)$$

Figure 5A:
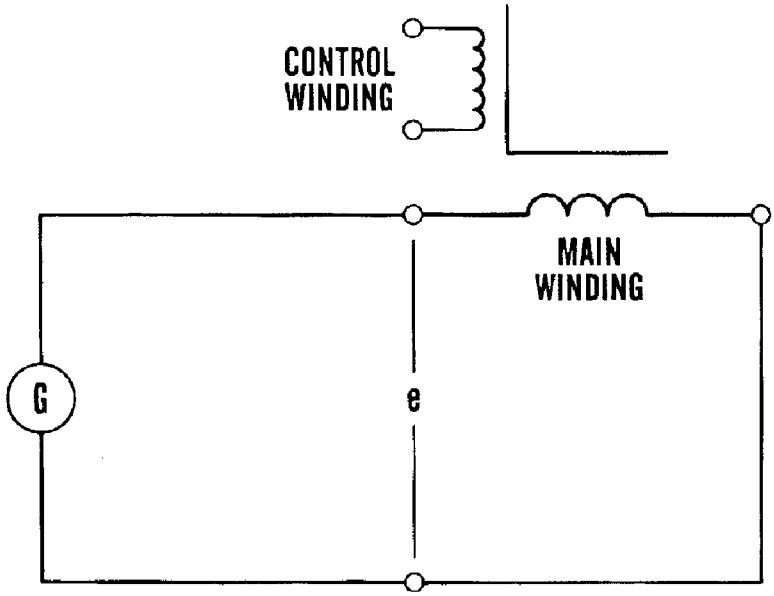
FIG. 5 illustrates a first equivalent circuit for the device according to the invention.
Figure 5B:
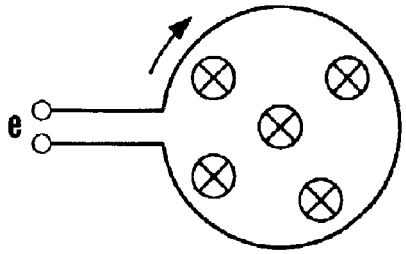

The left side of the integral is an expression of the potential equation in integral form. The source of the field variation may be the voltage from a generator and we can express Faraday's Law when the winding has N turns and all flux passes through all the turns, see FIG. 5:

$$e = N \cdot A_j \cdot \frac{d}{dt}B = N \cdot \frac{d}{dt}\Phi = \frac{d}{dt}\lambda \quad 26)$$

λ (Wb) gives an expression of the number of flux turns and is the sum of the flux through each turn in the winding. If one envisages the generator G in FIG. 5 being disconnected after the field is established, the source of the field variation will be the current in the circuit and from circuit technology we have, see FIG. 5*a*:

$$e = L \cdot \frac{di}{dt} \quad 27)$$

From equation 21 we have:

$$\Phi = k \cdot I \quad 28)$$

When L is constant, the combination of equations 26 and 27 gives:

$$\frac{d\lambda}{dt} = L\frac{di}{dt} \quad 29)$$

The solution of 29 is:

$$\lambda = L \cdot i + C \quad 30)$$

From 28 we derive that C is 0 and:

$$L = \frac{\lambda}{i} \quad 31)$$

This is an expression of self-inductance for the winding N (or in our case the main winding 2). The self-inductance is equal to the ratio between the flux turns established by the current in the winding (the coil) and the current in the winding (the coil).

The self-inductance in the winding is approximately linear as long as the magnetisable body or the core are not in saturation. However, we shall change the self-inductance through changes in the permeability in the material of the magnetisable body by changing the domain magnetisation in the transversal direction by the control field (i.e. by the field H2 which is established by the control winding 4).

From equation 21) combined with 31) we obtain:

$$L = N^2/Rm \quad 32)$$

The alternating current resistance or the reactance in an electrical circuit with self-inductance is given by $$X_L = jwL \quad 33)$$

By magnetising the domains in the magnetisable body in the transversal direction, the reluctance of the longitudinal direction will be changed. We shall not go into details here in the description of what happens to the domains during different field influences. Here we have considered ordinary commercial electroplate with a silicon content of approximately 3%, and in this description we shall not offer an explanation of the phenomenon in relation to the Metglas materials, but this, of course, should not be considered limiting for the invention, since the magnetic materials with amorphous structure will be able to play an important role in some applications of the invention.

In a transformer we employ closed cores with high permeability where energy is stored in magnetic leakage fields and a small amount in the core, but the stored energy does not form a direct part in the transformation of energy, with the result that no energy conversion takes place in the sense of what occurs in an electromechanical system where electrical energy is converted to mechanical energy, but energy is transformed via magnetic flux through the transformer. In an inductance coil or choke with an air gap, the reluctance in the air gap is dominant compared to the reluctance in the core, with approximately all the energy being stored in the air gap.

In the device according to the invention a "virtual" air gap is generated through saturation phenomena in the domains. In this case the energy storage will take place in a distributed air gap comprising the whole core. We consider the actual magnetic energy storage system to be free for losses, and any losses will thus be represented by external components.

The energy description which we use will be based on the principle of conservation of energy.

Figure 6:
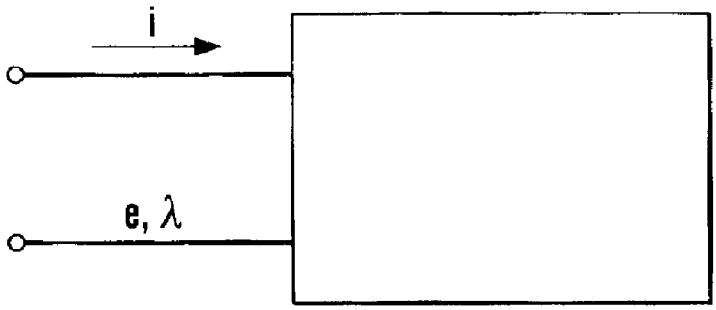
FIG. 6 is a simplified block diagram of the device according to the invention.

The first law of thermodynamics applied to the loss-free electromagnetic system above gives, see FIG. 6:

$$dWelin = dWfld \quad 34)$$

where dWelin=differential electrical energy supply
dWfld=differential change in magnetically stored energy
From equation 26) we have $$e = d/dt\lambda$$

Now our inductance is variable through the orthogonal field or the control field H2, and equation 31) inserted in 26) gives:

$$e = d(L \cdot i)/dt = L \cdot di/dt + i \cdot dL/dt \quad 35)$$

The effect within the system is $$p = i \cdot e = i \cdot d/dt\lambda \quad 36)$$

Thus we have $$dW_{elin} = i \cdot d\lambda \quad 37)$$

For a system with a core where the reluctance can be varied and which only has a main winding, equation 35) inserted in equation 37) will give $$dW_{elm} = i \cdot d(L \cdot i) = i \cdot (L \cdot di + i \cdot dl) \quad 38)$$

In the device according to the invention L will be varied as a function of $\mu r$, the relative permeability in the magnetisable body or the core 1, which in turn is a function of I2, the control current in the control winding 4.

When L is constant, i.e. when I2 is constant, we can disregard the section i×dL since dL is equal to 0, and thus the magnetic field energy will be given by:

$$W_{flt} = \frac{1}{2} \cdot L \cdot i^2 \quad 39)$$

When L is varied by means of I2, the field energy will be altered as a result of the altered value of L, and thereby the current I will also be altered since it is associated with the field value-through the flux turns λ. Since i and λ are variable and functions of each other, while being non-linear functions, we shall not go into the solution here since it will involve mathematics which exceed the bounds of the description of the invention.

However, we can draw the conclusion that the field energy and the energy distribution will be controllable via $\mu r$ and influence how energy stored in the field is increased and decreased. When the field energy is decreased, the surplus portion will be returned to the generator. Or if we have an extra winding (e.g. winding 3, FIG. 1) in the same winding window as the first main winding 2 and with the same winding axis as it has, this will provide a transformative transfer of energy from the first winding 2 to the second main winding 3.

Figure 7:
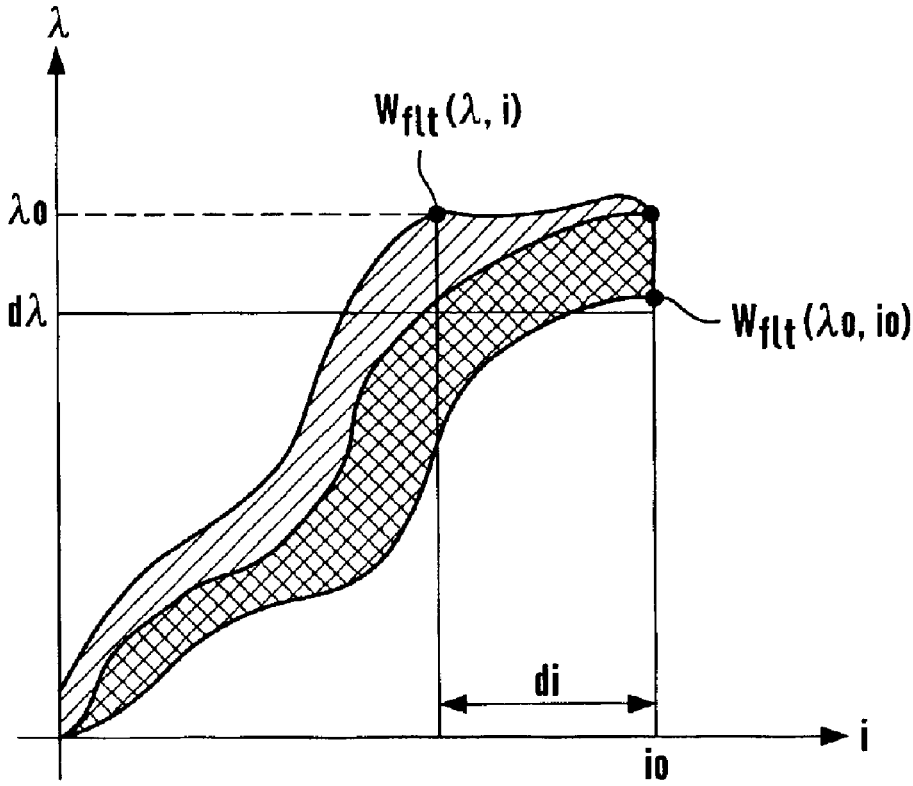
FIG. 7 is a diagram for flux versus current.
Figure 8A:
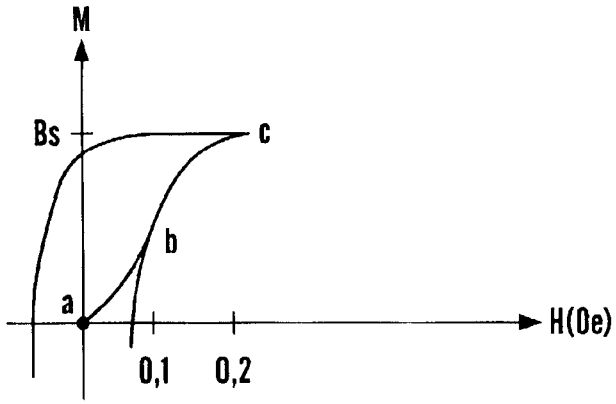
FIGS. 8 and 9 illustrate magnetisation curves and domains for the magnetic material in the device according to the invention.
Figure 8B:
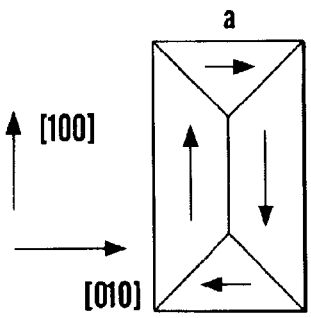
Figure 8B:
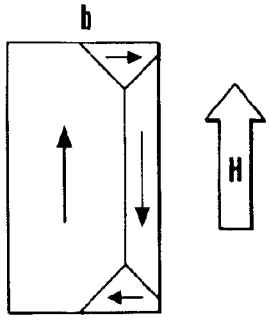
Figure 8D:
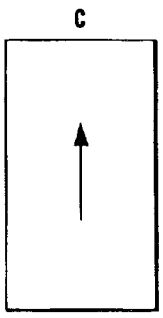
Figure 9A:
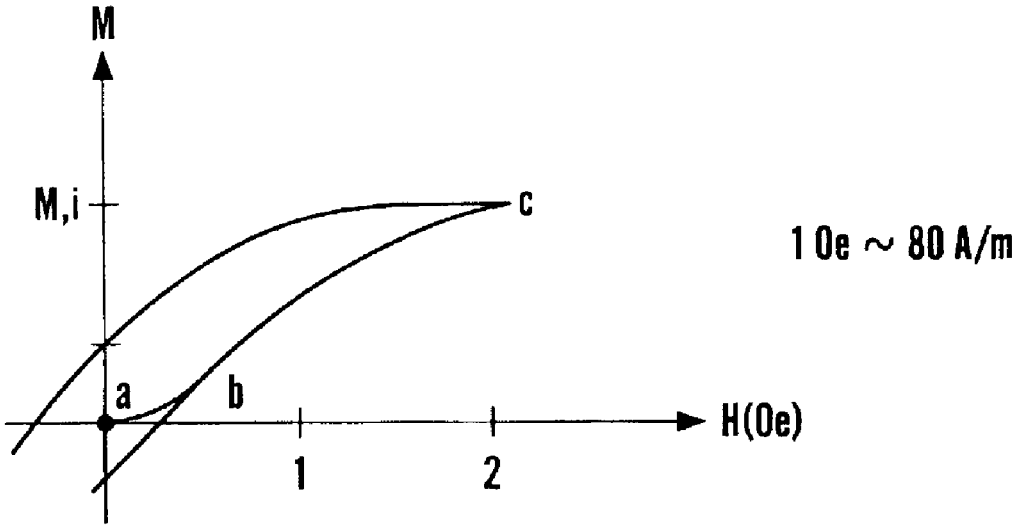
Figure 9B:
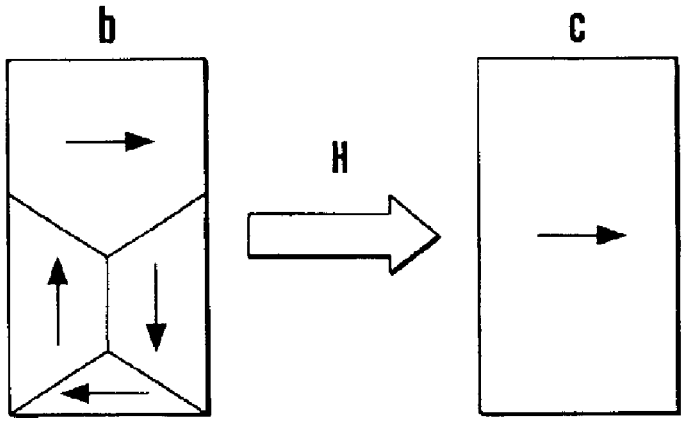

This is illustrated in FIG. 7 where an alteration of λ results in an alteration of the energy in the field Wflt which originally is Wflt(λo, io). A variation is envisaged here which is so small that i is approximately constant during the alteration of λ. In the same way an alteration of i will give an alteration of λ. When we look at our variable inductance, therefore, we can say the following:

The substance of what takes place is illustrated in FIG. 8 and FIG. 9.

FIG. 8 illustrates the magnetisation curves for the entire material of the magnetisable body 1 and the domain change under the influence of the H1 field from the main winding 2.

FIG. 9 illustrates the magnetisation curves for the entire material of the magnetisable body 1 and the domain change under the influence of the H2 field in the direction from the control winding 4.

Figure 10A:
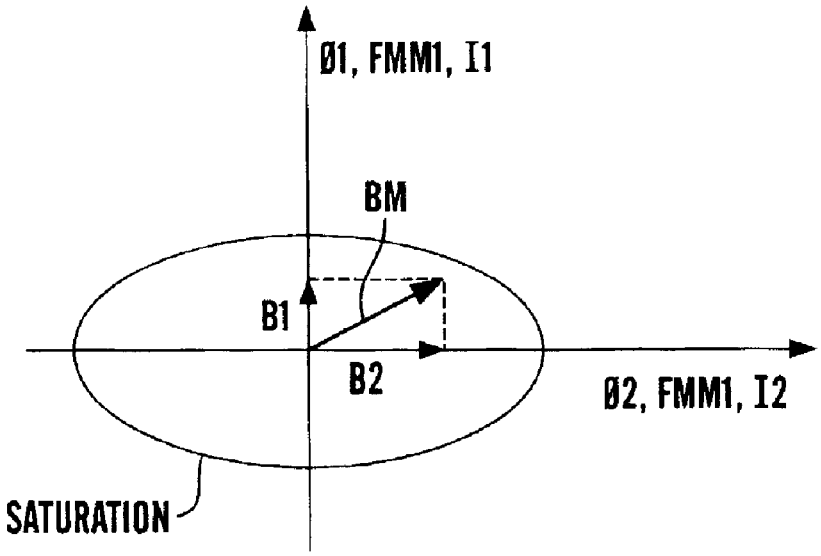
FIG. 10 illustrates flux densities for the main and control windings.
Figure 10B:
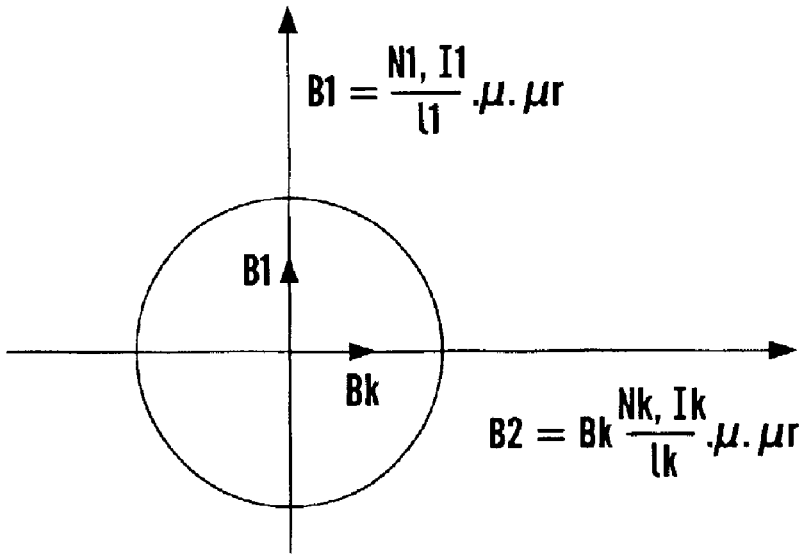

FIGS. 10*a* and 10*b* illustrate the flux densities B1 (where the field H1 is established by the working current), and B2 (corresponding to the control current). The ellipse illustrates the saturation limit for the B fields, i.e. when the B field reaches the limit, this will cause the material of the magnetisable body 1 to reach saturation. The form of the ellipse's axes will be given by the field length and the permeability of the two fields B1 (H1) and B2 (H2) in the core material of the magnetisable body 1.

By having the axes in FIG. 10 express the MMK distribution or the H field distribution, a picture can be seen of the magnetomotive force from the two currents I1 and I2.

We now refer back to FIGS. 8 and 9. By means of a partial magnetisation of the domains by the control field B2 (H2), an additional field B1 (H1) from the main winding 2 will be added vectorially to the control field B2 (H2), further magnetising the domains, with the result that the inductance of the main winding 2 will start from the basis given by the state of the domains under the influence of the control field B2 (H2).

The domain magnetisation, the inductance L and the alternating current resistance XL will thereby be varied linearly as a function of the control field B2.

We shall now describe the various embodiments of the device according to the invention, with reference to the remaining figures.

Figure 11E:
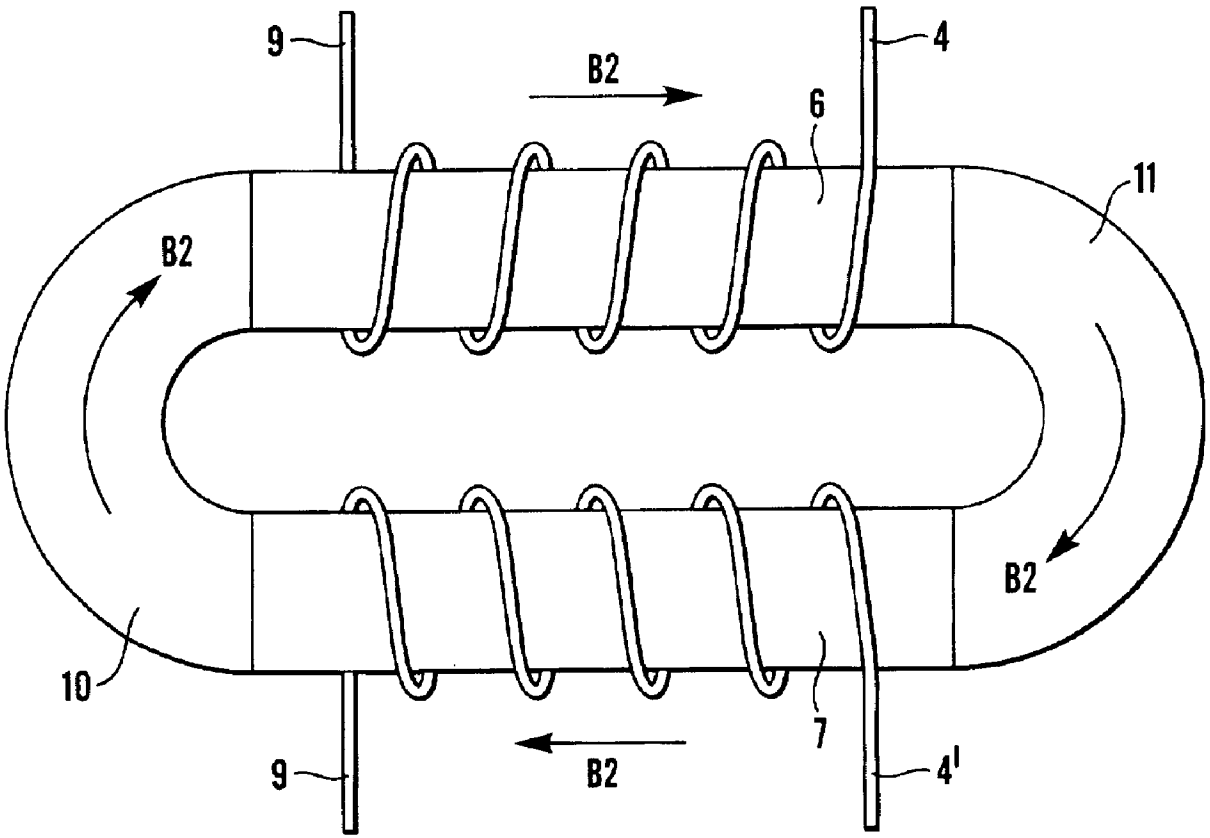
FIG. 11 illustrates a second embodiment of the invention.
Figure 11A:
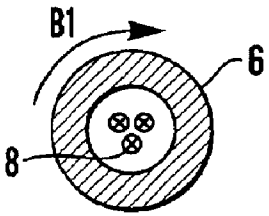
Figure 11B:
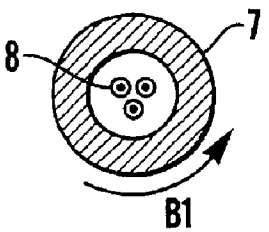

FIG. 11 is a schematic illustration of a second embodiment of the invention.

Figure 12B:
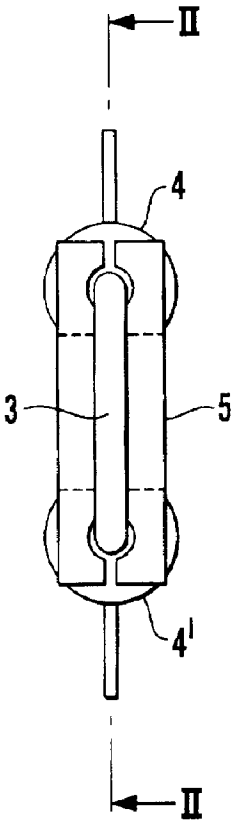
FIG. 12 illustrates the same second embodiment of the invention.
Figure 12A:
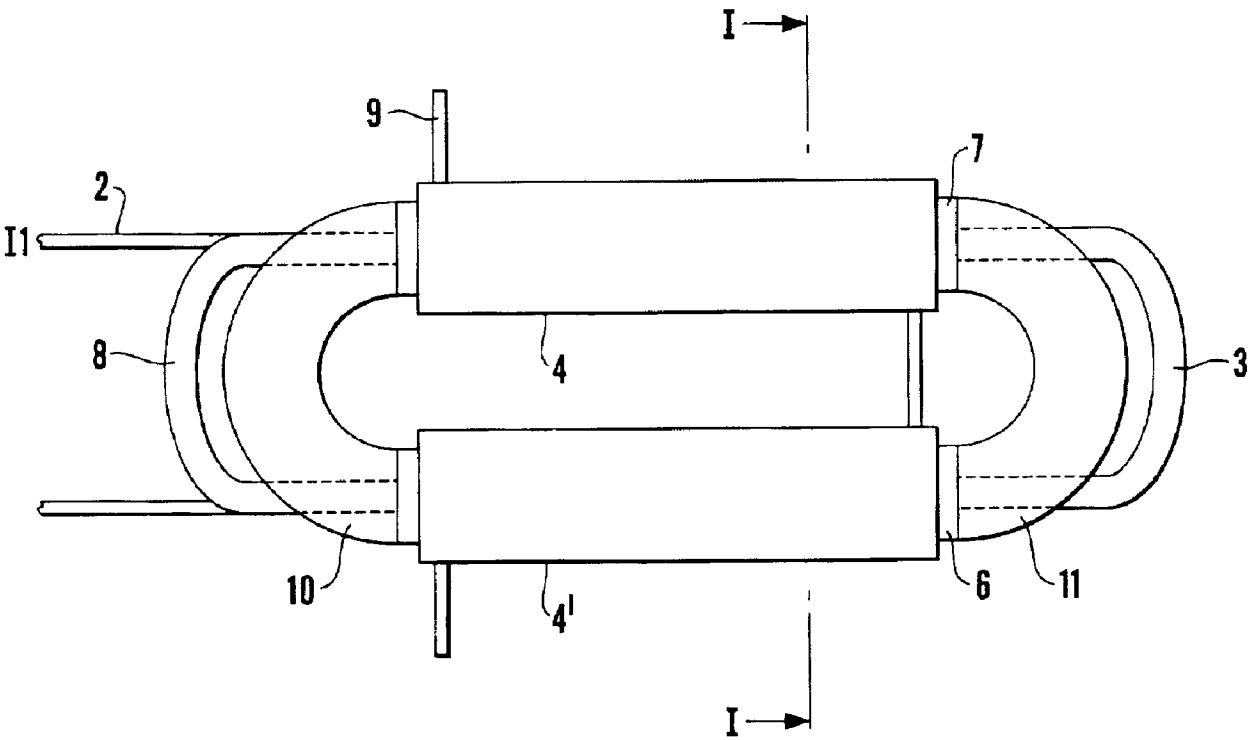

FIG. 12 illustrates the same embodiment of a magnetically influenced connector according to the invention, where FIG. 12*a* illustrates the assembled connector and FIG. 12*b* illustrates the connector viewed from the end.

Figure 13:
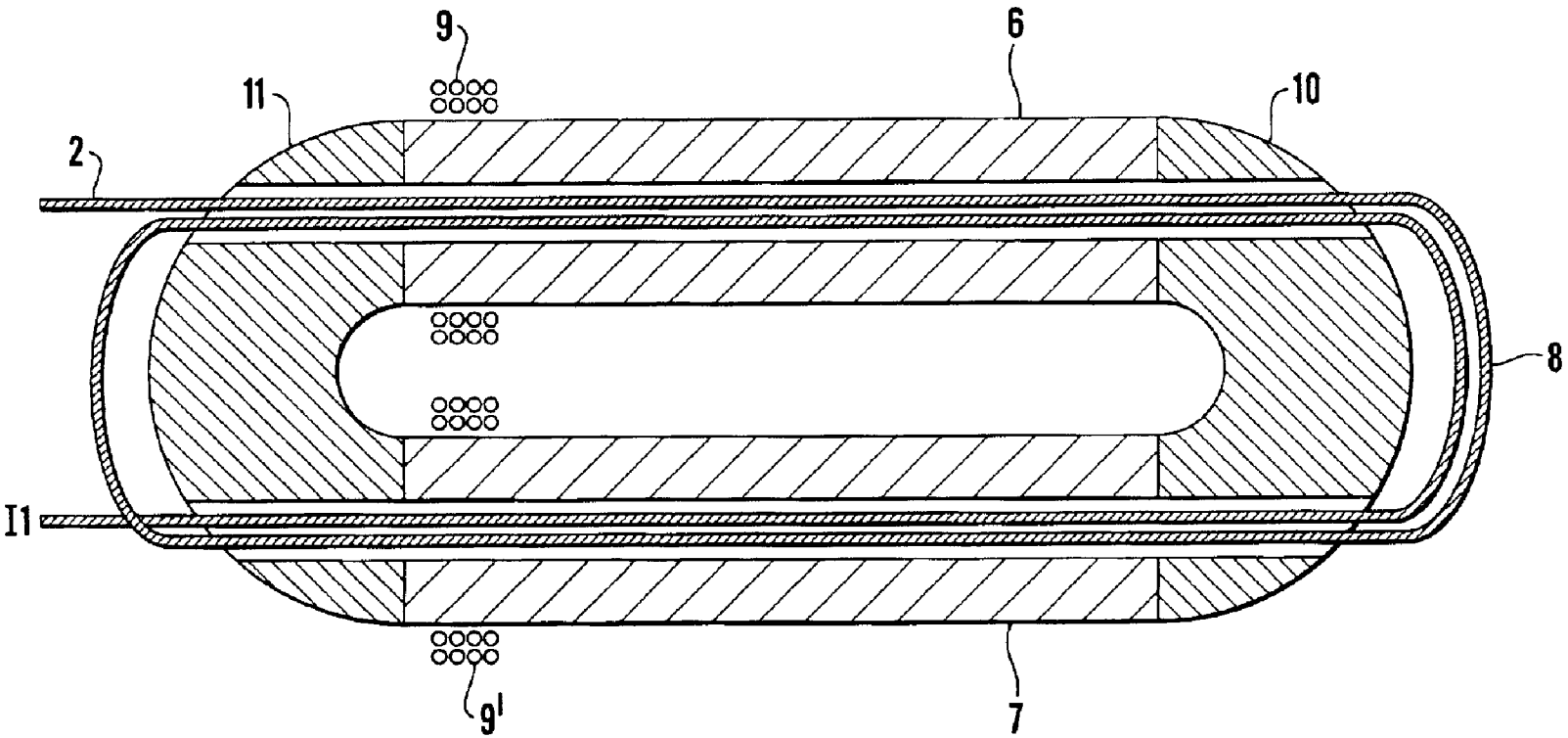
FIGS. 13 and 14 illustrate the second embodiment in section.

FIG. 13 illustrates a section along line II in FIG. 12*b*.

As illustrated in the figures the magnetisable body 1 is composed of inter alia two parallel tubes 6 and 7 made of magnetisable material. An electrically insulated conductor 8 (FIGS. 12*a*, 13) is passed continuously in a path through the first tube 6 and the second tube 7 N number of times, where N=1, . . . r, forming the first main winding 2, with the conductor 8 extending in the opposite direction through the two tubes 6 and 7, as is clearly illustrated in FIG. 13. Even though the conductor 8 is only shown extending through the first tube 6 and the second tube 7 twice, it should be self-explanatory that it is possible for the conductor 8 to extend through respective tubes either only once or possibly several times (as indicated by the fact that the winding number N can vary from 0 to r), thus creating a magnetic field H1 in the parallel tubes 6 and 7 when the conductor is excited. A combined control and magnetisation winding 4, 4', composed of the conductor 9, is wound round the first tube and the second tube (6 and 7 respectively) in such a manner that the direction of the field H2 (B2) which is created in the said tubes when the winding 4 is excited will be oppositely directed, as indicated by the arrows for the field B2 (H2) in FIG. 11. The magnetic field connectors 10, 11 are mounted at the ends of the respective pipes 6, 7 in order to interconnect the tubes fieldwise in a loop. The conductor 8 will be able to carry a load current 11 (FIG. 12*a*). The tubes' 6, 7 length and diameter will be determined on the basis of the power and voltage which have to be connected. The number of turns N1 on the main winding 2 will be determined by the reverse blocking ability for voltage and the cross-sectional area of the extent of the working flux ϕ2. The number of turns N2 on the control winding 4 is determined by the fields required for saturation of the magnetisable body 1, which comprises the tubes 6, 7 and the magnetic field connectors 10, 11.

Figure 14:
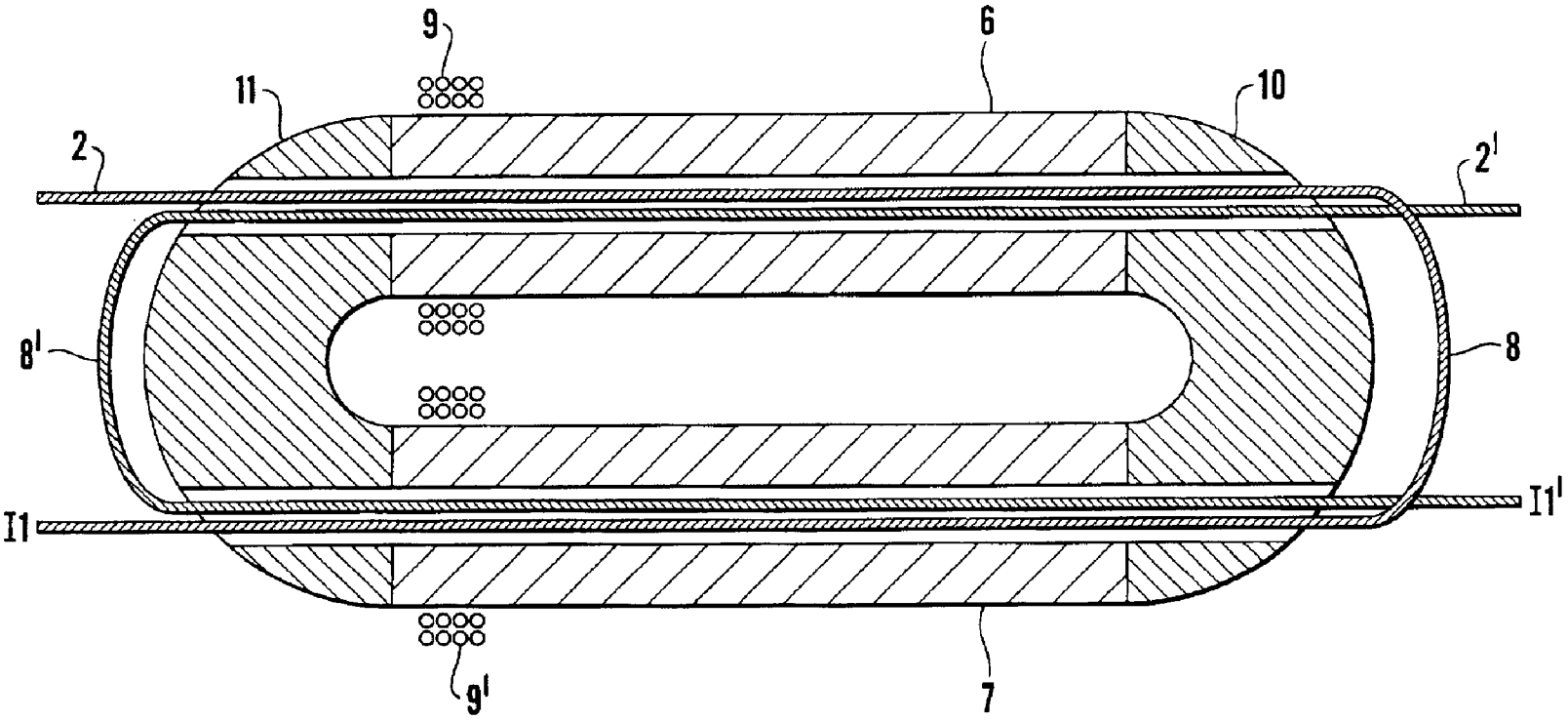

FIG. 14 illustrates a special design of the main winding 2 in the device according to the invention. In reality, the solution in FIG. 14 differs from that illustrated in FIGS. 12 and 13 only by the fact that instead of a single insulated conductor 8 which is passed through the pipes 6 and 7, two separate oppositely directed conductors, so-called primary conductors 8 and secondary conductors 8' are employed, in order thereby to achieve a voltage converter function for the magnetically influenced device according to the invention. This will now be explained in more detail. The design is basically similar to that illustrated in FIGS. 11, 12 and 13. The magnetisable body 1 comprises two parallel tubes 6 and 7. An electrically insulated primary conductor 8 is passed continuously in a path through the first tube 6 and the second tube 7 N1 number of times, where N1=1, . . . r, with the primary conductor 8 extending in the opposite direction through the two tubes 6 and 7. An electrically insulated secondary conductor 8' is passed continuously in a path through the first tube 6 and the second tube 7 N1' number of times, where N1'=1, . . . r, with the secondary conductor 8' extending in the opposite direction relative to the primary conductor 8 through the two tubes 6 and 7. At least one combined control and magnetisation winding 4 and 4' is wound round the first tube 6 and the second tube 7 respectively, with the result that the field direction created on the said tube is oppositely directed. As for the embodiment according to FIGS. 11, 12 and 13, magnetic field connectors 10, 11 are mounted on the end of respective tubes (6, 7) in order to interconnect the tubes 6 and 7 fieldwise in a loop, thereby forming the magnetisable body 1. Even though for the sake of simplicity the primary conductor 8 and the secondary conductor 8' are illustrated in the drawings with only one pass through the tubes 6 and 7, it will be immediately apparent that both the primary conductor 8 and the secondary conductor 8' will be able to be passed through the tubes 6 and 7 N1 and N1' number of times respectively. The tubes' 6 and 7 length and diameter will be determined on the basis of the power and voltage which have to be converted. For a transformer with a conversion ratio (N1:N1') equal to 10:1, in practice ten conductors will be used as primary conductors 8 and only one secondary conductor 8'.

Figure 15A:
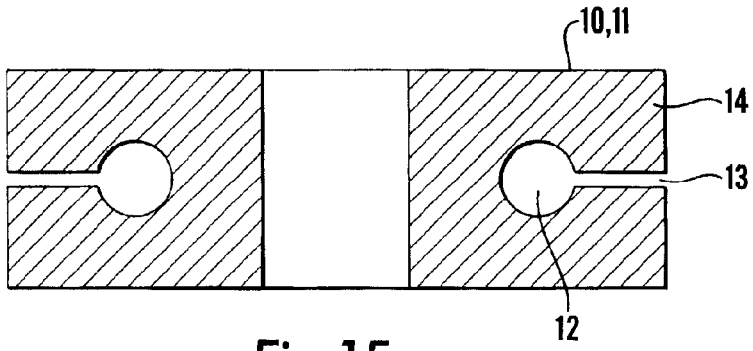
FIGS. 15–18 illustrate different embodiments of the magnetic field connectors in the said second embodiment of the invention.
Figure 15B:
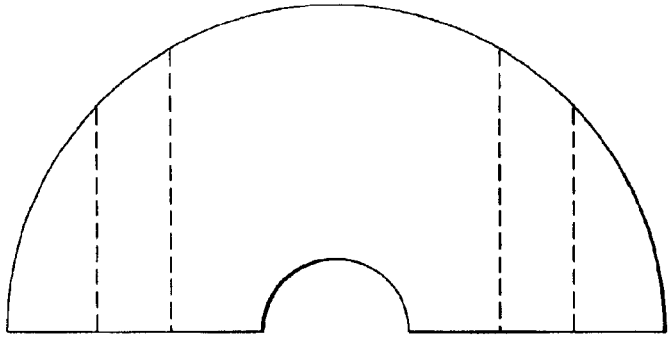
Figure 15C:
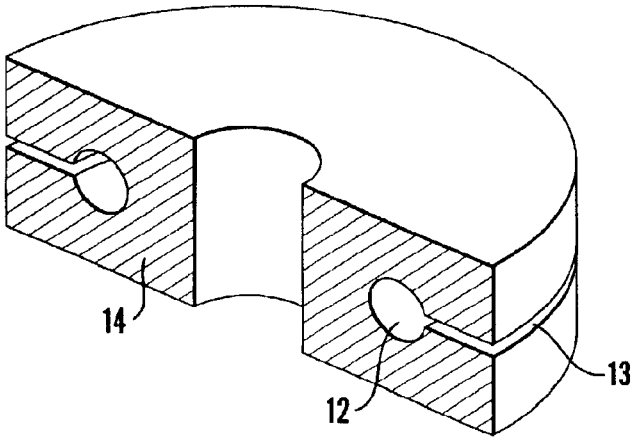

An embodiment of magnetic field connectors 10 and/or 11 is illustrated in FIG. 15. A magnetic field connector 10, 11 is illustrated, composed of a magnetically conducting material, wherein two preferably circular apertures 12 for the conductor 8 in the main winding 2 (see, e.g. FIG. 13) are machined out of the magnetic material in the connectors 10, 11. Moreover, there is provided a gap 13 which interrupts the magnetic field path of the conductor 8. End surface 14 is the connecting surface for the magnetic field H2 from the control winding 4 consisting of conductors 9 and 9' (FIG. 13).

Figure 16:
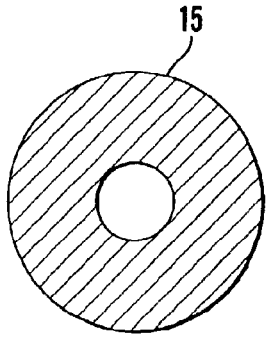

FIG. 16 illustrates a thin insulating film 15 which will be placed between the end surface on tubes 6 and 7 and the magnetic field connector 10, 11 in a preferred embodiment of the invention.

Figure 17A:
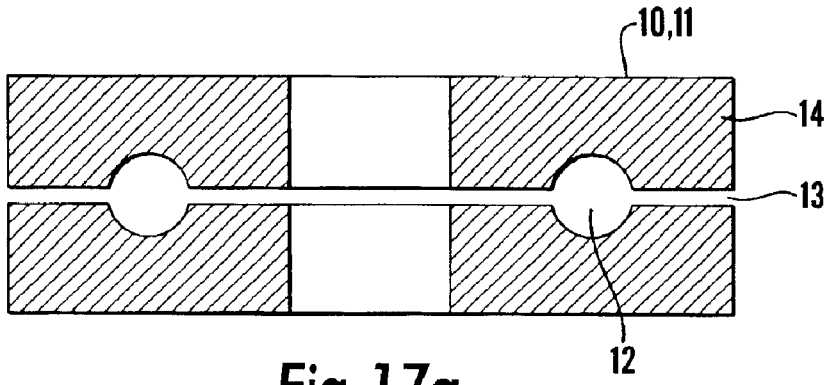
Figure 17B:
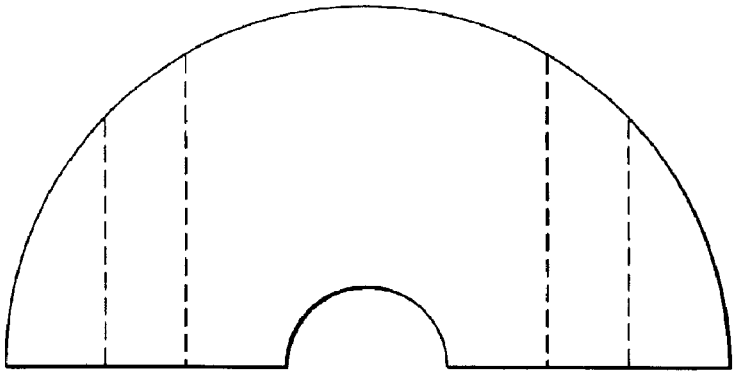
Figure 17C:
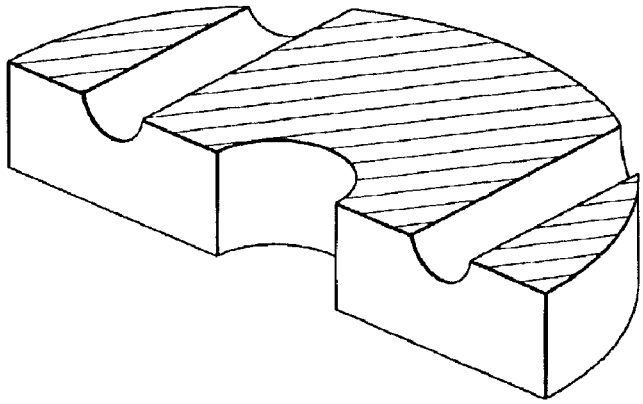
Figure 18A:
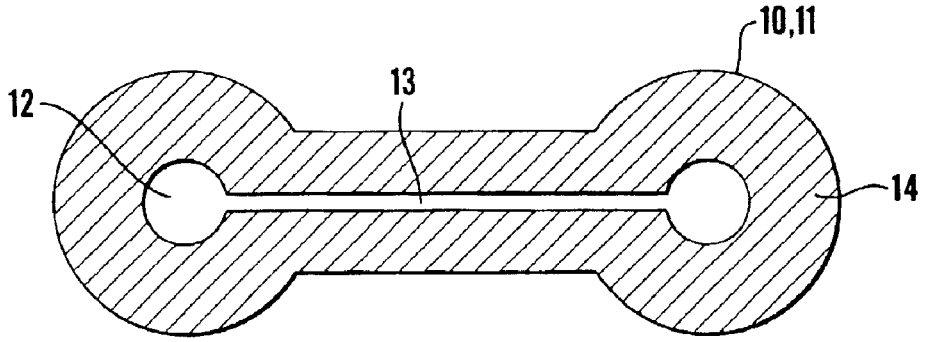
Figure 18B:
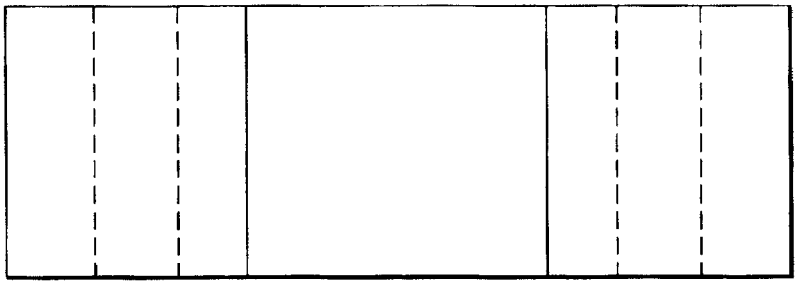
Figure 18C:
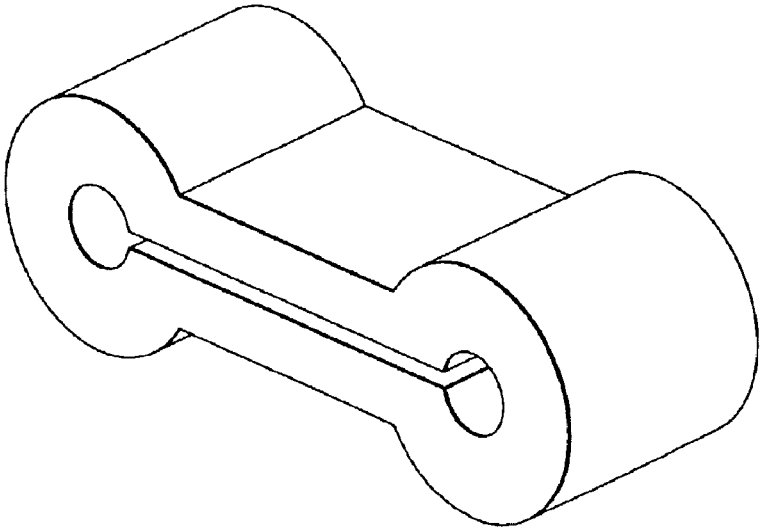

FIGS. 17 and 18 illustrate other alternative embodiments of the magnetic field connectors 10, 11.

FIGS. 19–32 illustrate various embodiments of a core 16 which in the embodiment illustrated in FIGS. 12, 13 and 14 forms the main part of the tubes 6 and 7 which preferably together with the magnetic field connectors 10 and 11 form the magnetisable body 1.

Figure 19:
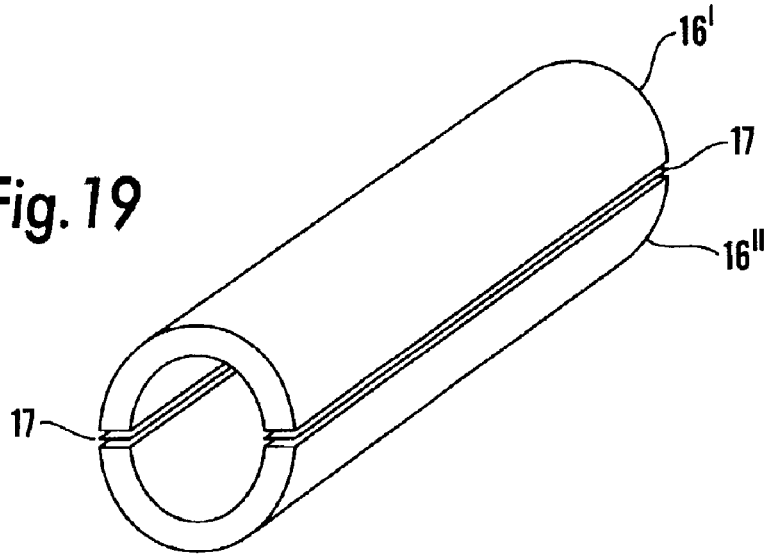
FIGS. 19–32 illustrate different embodiments of the tubular bodies in the second embodiment of the invention.

FIG. 19 illustrates a cylindrical core part 16 which is divided lengthwise as illustrated and where there are placed one or more layers 17 of an insulating material between the two core halves 16', 16".

Figure 20:
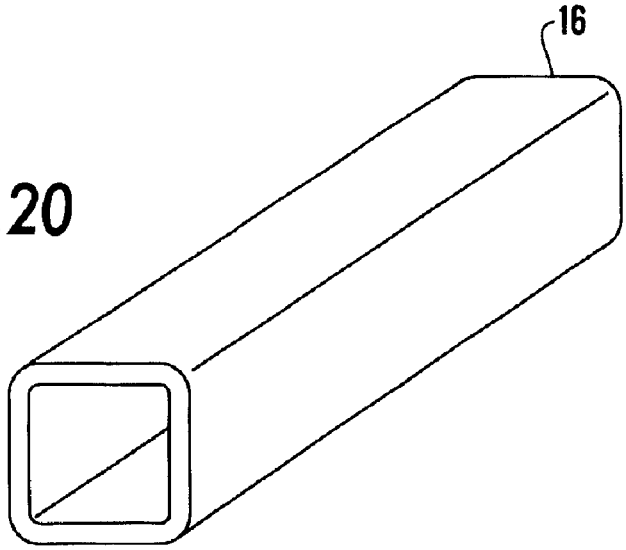
Figure 21:
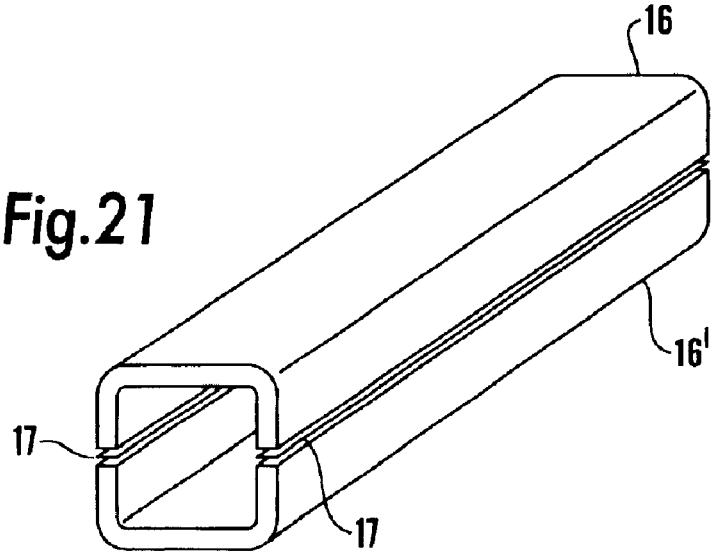
Figure 22:
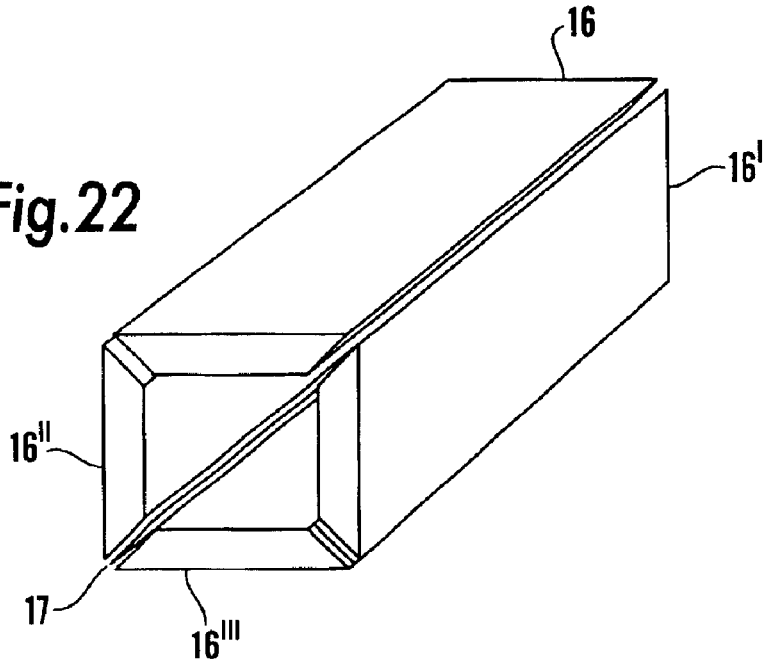

FIG. 20 illustrates a rectangular core part 16 and FIG. 21 illustrates an embodiment of this core part 16 where it is divided in two with partial sections in the lateral surface. In the embodiment illustrated in FIG. 21, one or more layers of an insulating material 17 are provided between the core halves 16, 16'. A further variant is illustrated in FIG. 22 where the partial section is placed in each corner.

Figure 23:
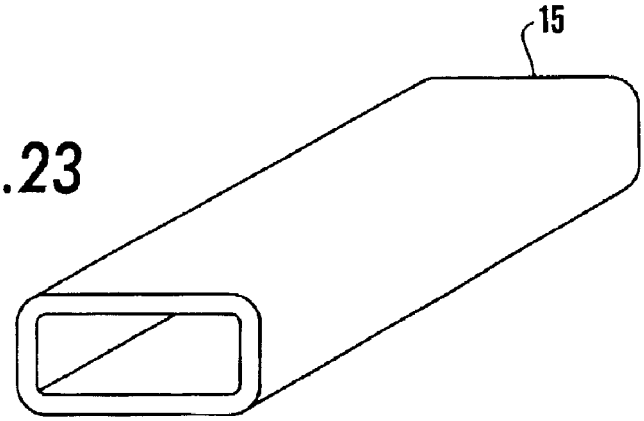
Figure 24:
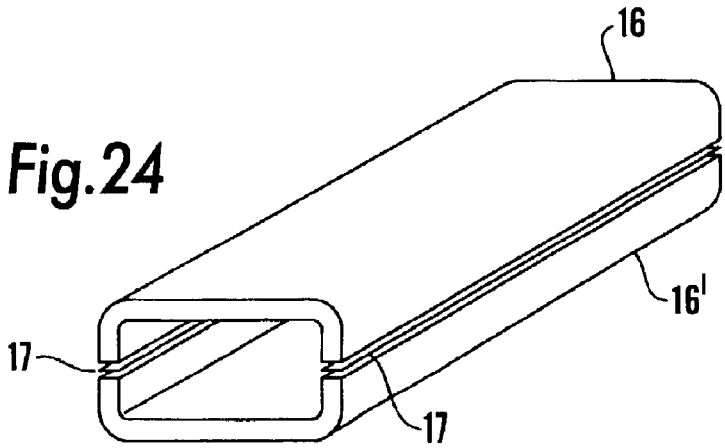
Figure 25:
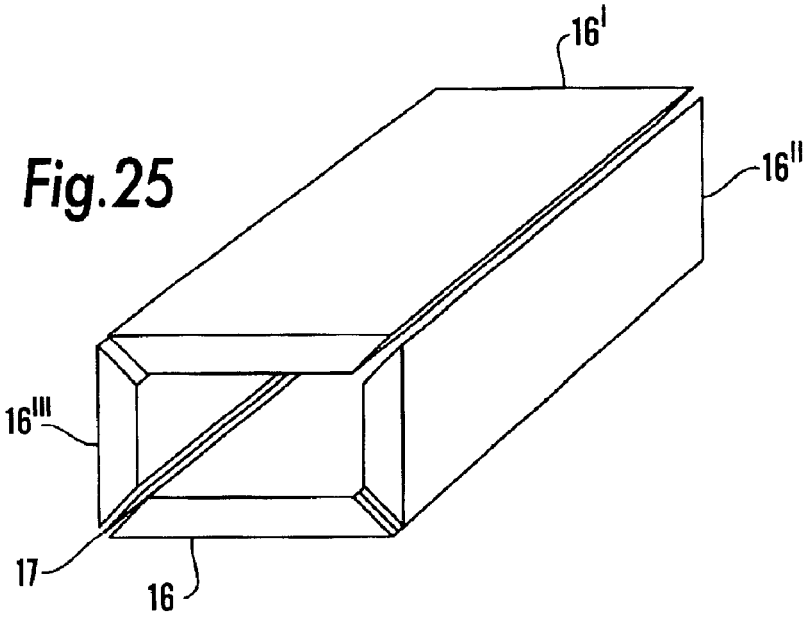
Figure 26:
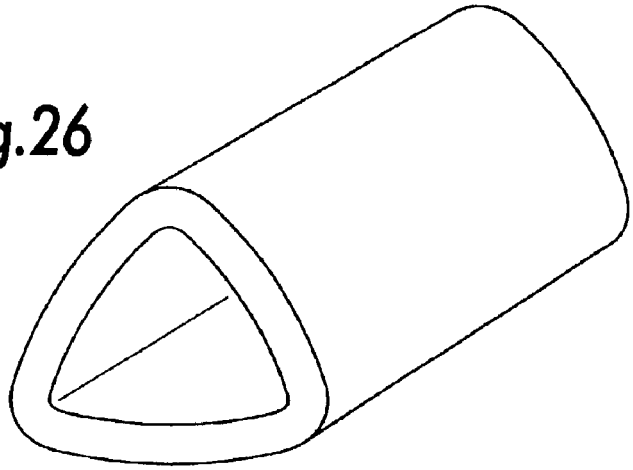
Figure 27:
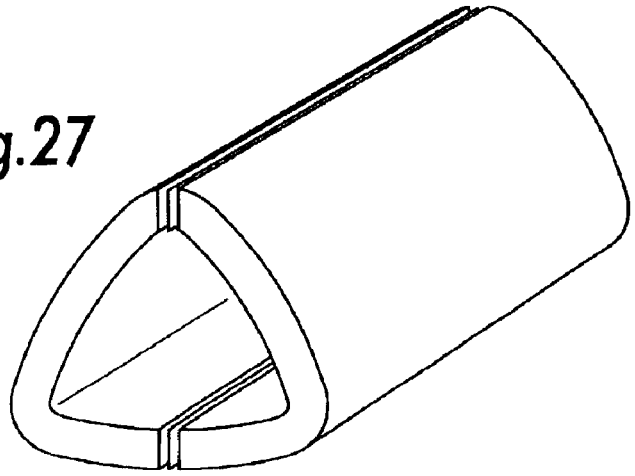
Figure 28:
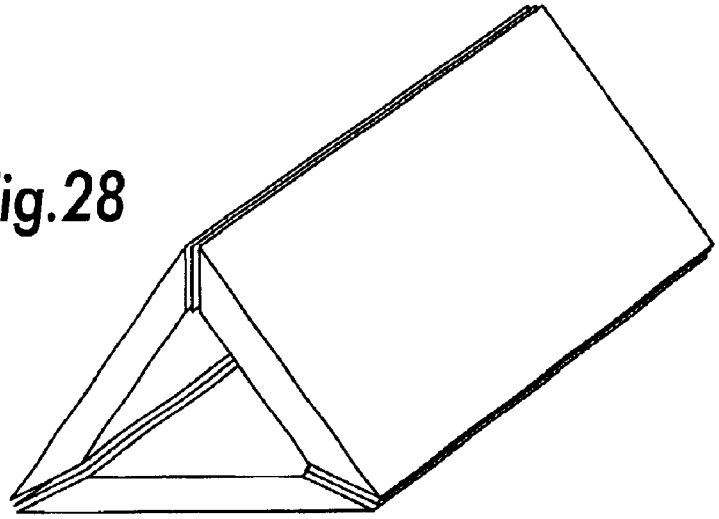
Figure 29:
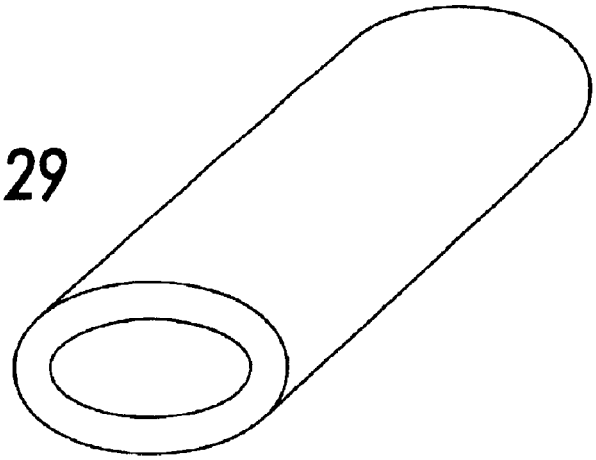
Figure 30:
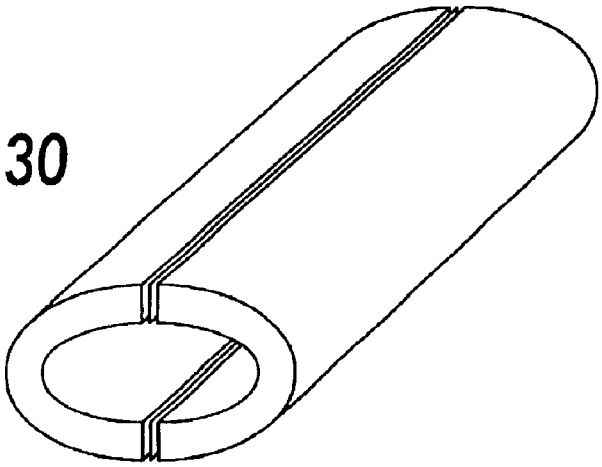
Figure 31:
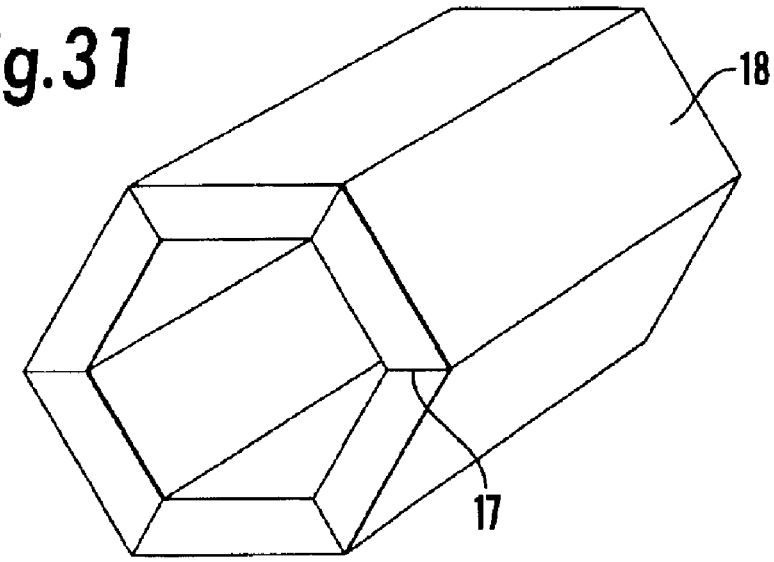
Figure 32:
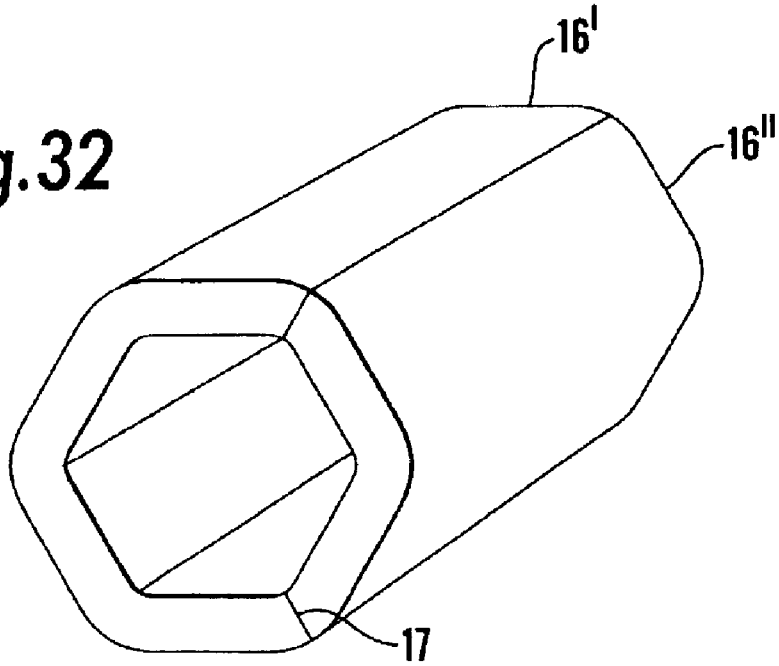
Figure 33A:
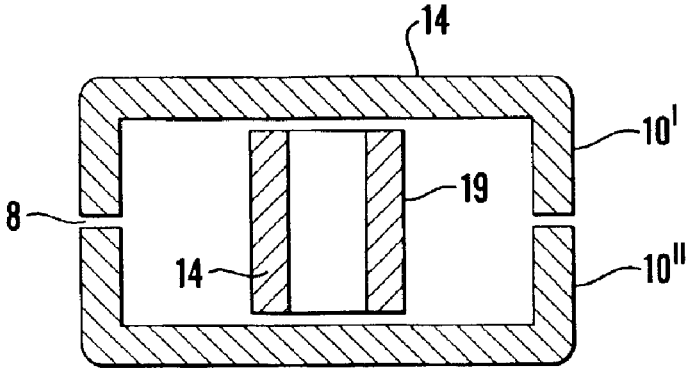
FIGS. 33–38 illustrate different aspects of the magnetic field connectors for use in the second embodiment of the invention.
Figure 33B:
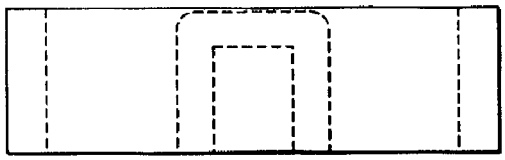
Figure 33C:
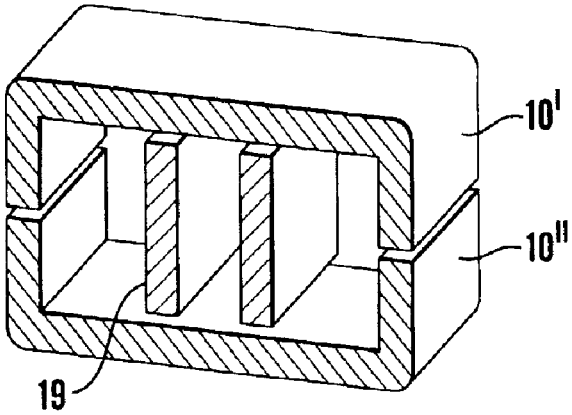
Figure 33D:
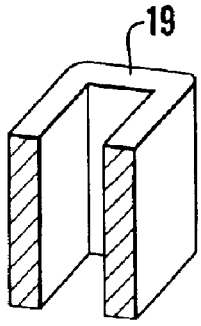

FIGS. 23, 24 and 25 illustrate a rectangular shape. FIGS. 26, 27 and 28 illustrate the same for a triangular shape. FIGS. 29 and 30 illustrate an oval variant, and finally FIGS. 31 and 32 illustrate a hexagonal shape. In FIG. 31 the hexagonal shape is composed of 6 equal surfaces 18 and in FIG. 30 the hexagon consists of two parts 16' and 16". Reference numeral 17 refers to a thin insulating film.

Figure 34:
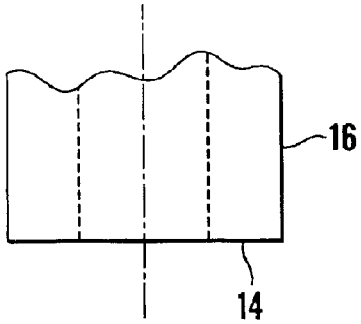

FIGS. 33 and 34 illustrate a magnetic field connector 10, 11 which can be used as a control field connector between the rectangular and square main cores 16 (illustrated in FIGS. 20–21 and 23–25 respectively). This magnetic field connector comprises three parts 10', 10" and 19.

FIG. 34 illustrates an embodiment of the core part or main core 16 where the end surface 14 or the connecting surface for the control flux is at right angles to the axis of the core part 16.

Figure 35:
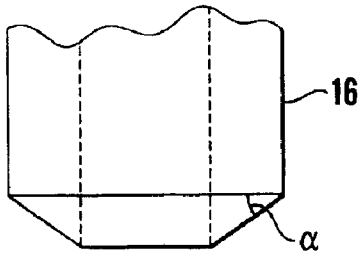

FIG. 35 illustrates a second embodiment of the core part 16 where the connecting surface 14 for the control flux is at an angle $\alpha$ to the axis of the core part 16.

Figure 36:
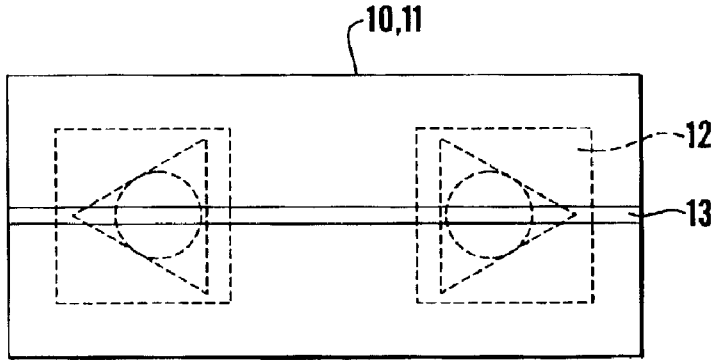
Figure 37:
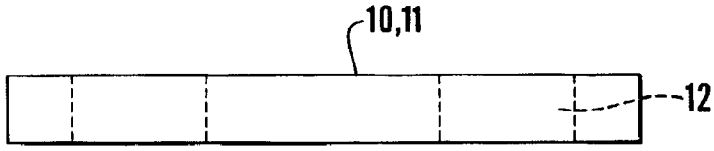
Figure 38:
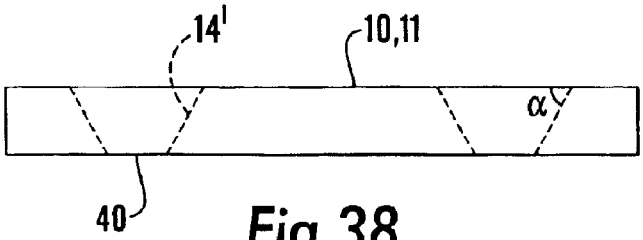

FIGS. 36–38 illustrate various designs of the magnetic field connector 10, 11, which are based on the fact that the connecting surfaces 14' of the magnetic field connector 10, 11 are at the same angle as the end surfaces 14 to the core part 16.

FIG. 36 illustrates a magnetic field connector 10, 11 in which different hole shapes 12 are indicated for the main winding 2 on the basis of the shape of the core part 16 (round, triangular, etc.).

In FIG. 37 the magnetic connector 10, 11 is flat. It is adapted for use with core parts 16 with right-angled end surfaces 14.

In FIG. 38 an angle $\alpha'$ is indicated to the magnetic field connector 10, 11, which is adapted to the angle $\alpha$ to the core part (FIG. 35), thus causing the end surface 14 and the connecting surface 14' to coincide.

Figure 39A:
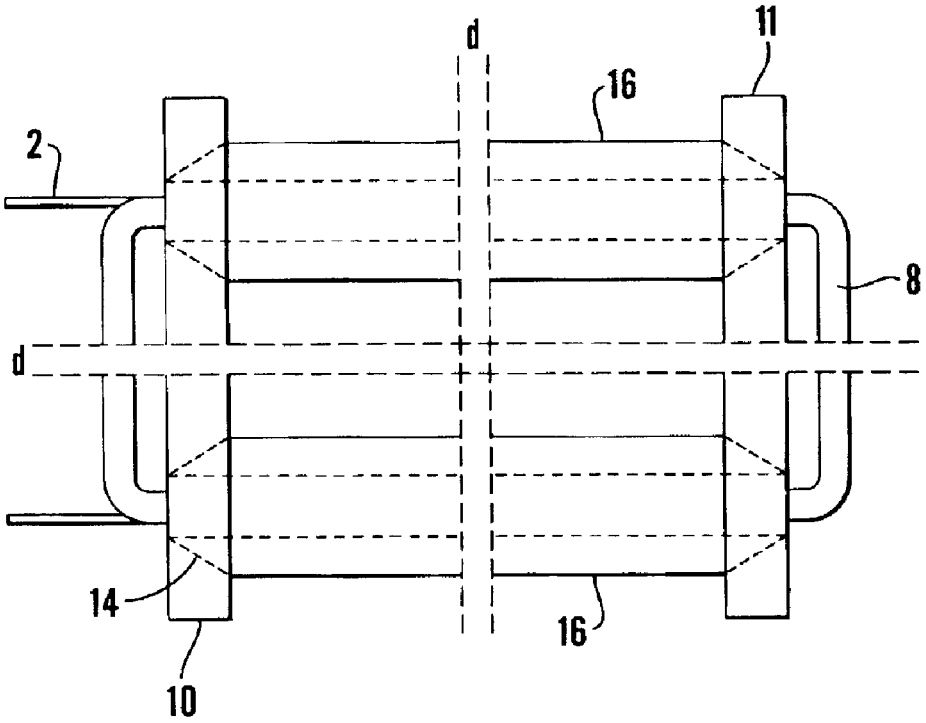
FIG. 39 illustrates an assembled device according to the second embodiment of the invention.
Figure 39B:
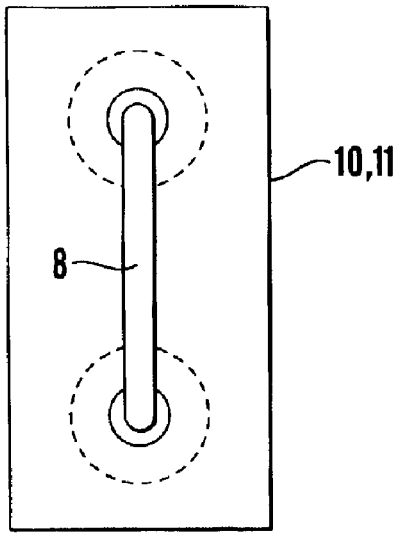

In FIG. 39 a an embodiment of the invention is illustrated with an assembly of magnetic field connectors 10, 11 and core parts 16. FIG. 39*b* illustrates the same embodiment viewed from the side.

Even though only individual combinations of magnetic field connectors and core parts are described in order to illustrate the invention, it will be obvious to a person skilled in the art that other combinations are entirely possible and will thus fall within the scope of the invention.

It will also be possible to switch the positions of the control winding and the main winding.

Figure 40A:
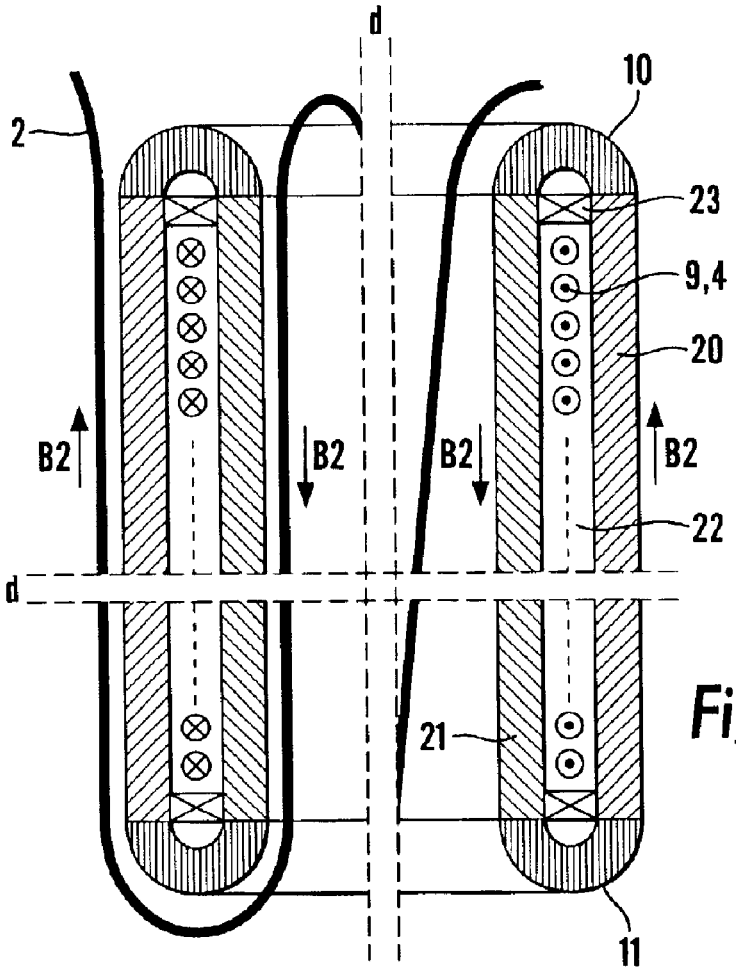
FIGS. 40 and 41 are a section and a view of a third embodiment of the invention.
Figure 40B:
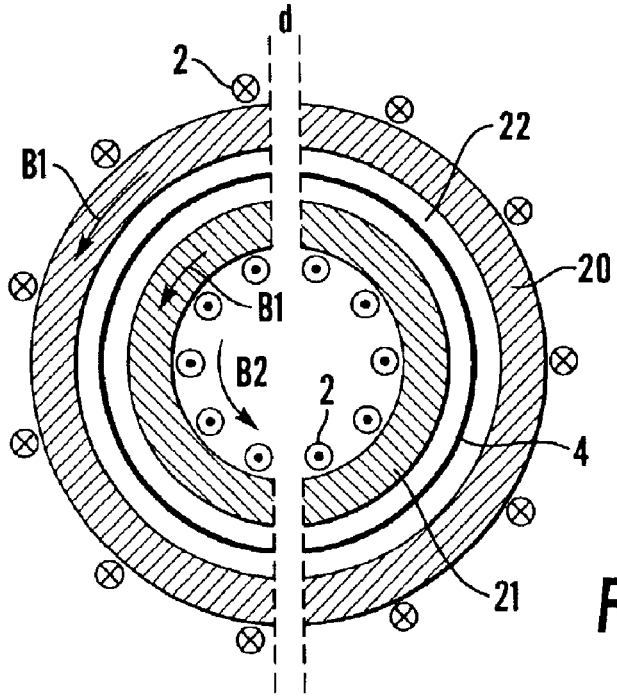
Figure 41A:
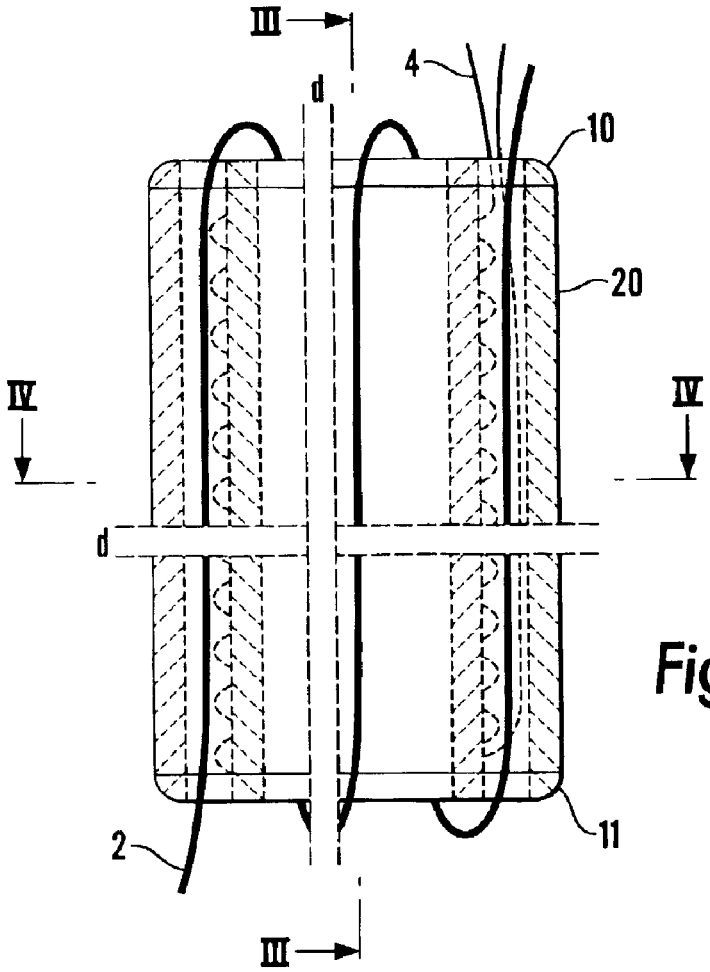
Figure 41B:
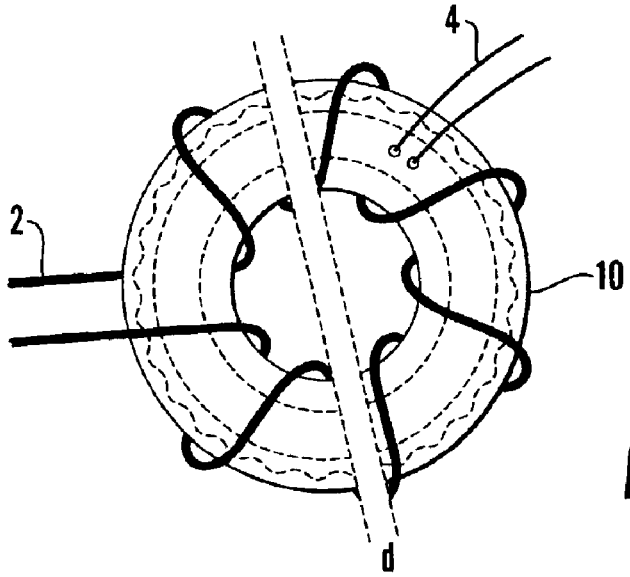

FIGS. 40 and 41 are a sectional illustration and view respectively of a third embodiment of a magnetically influenced voltage connector device. The device comprises (see FIG. 40*b*) a magnetisable body 1 comprising an external tube 20 and an internal tube 21 (or core parts 16, 16') which are concentric and made of a magnetisable material with a gap 22 between the external tube's 20 inner wall and the internal tube's 21 outer wall. Magnetic field connectors 10, 11 between the tubes 20 and 21 are mounted at respective ends thereof (FIG. 40*a*). A spacer 23 (FIG. 40*a*) is placed in the gap 22, thus keeping the tubes 20, 21 concentric. A combined control and magnetisation winding 4 composed of conductors 9 is wound round the internal tube 21 and is located in the said gap 22. The winding axis A2 for the control winding therefore coincides with the axis A1 of the tubes 20 and 21. An electrical current-carrying or main winding 2 composed of the current conductor 8 is passed through the internal tube 21 and along the outside of the external tube 20 N1 number of times, where N1=1, . . . r. With the combined control and magnetisation winding 4 in co-operation with the main winding 2 or the said current-carrying conductor 8, an easily constructed but efficient magnetically influenced voltage connector is obtained. This embodiment of the device may also be modified in such a manner that the tubes 20, 21 do not have a circular cross section, but a cross section which is square, rectangular, triangular, etc.

It is also possible to wind the main winding round the internal tube 21, in which case the axis A2 of the main winding will coincide with the axis A1 of the tubes, while the control winding is wound about the tubes on the inside of 21 and the outside of 20.

Figure 42A:
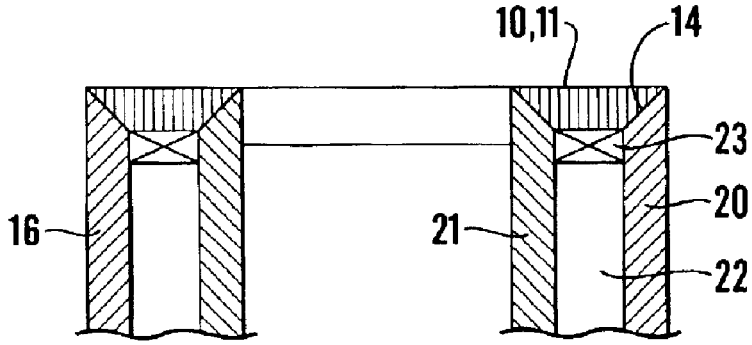
FIGS. 42, 43 and 44 illustrate special embodiments of magnetic field connectors for use in the third embodiment of the invention.
Figure 42B:
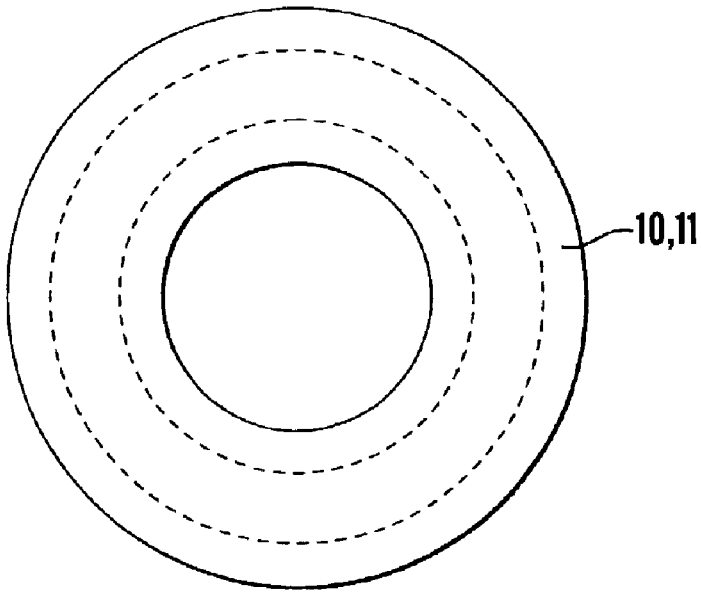
Figure 43:
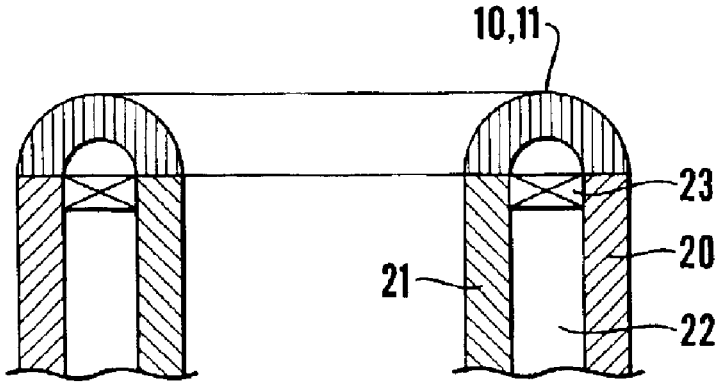
Figure 44:
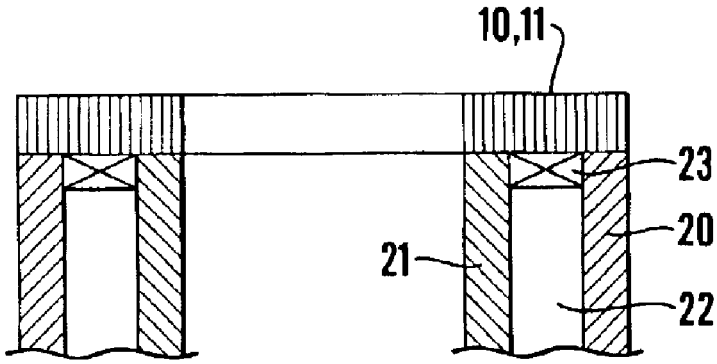

FIGS. 42–44 illustrate various embodiments of the magnetic field connector 10, 11 which are specially adapted to the latter design of the invention, i.e. as described in connection with FIGS. 40 and 41.

FIG. 42*a* illustrates in section and FIG. 42*b* in a view from above a magnetic field connector 10, 11 with connecting surfaces 14' at an angle relative to the axis of the tubes 20, 21 (the core parts 16) and it is obvious that the internal 21 and external 20 tubes should also be at the same angle to the connecting surfaces 14.

FIGS. 43 and 44 illustrate other variants of the magnetic field connector 10, 11, where the connecting surfaces 14' of the control field H2 (B2) are perpendicular to the main axis of the core parts 16 (tubes 20, 21). FIG. 43 illustrates a hollow semi-toroidal magnetic field connector 10, 11 with a hollow semi-circular cross section, while FIG. 44 illustrates a toroidal magnetic field connector with a rectangular cross section.

Figure 45A:
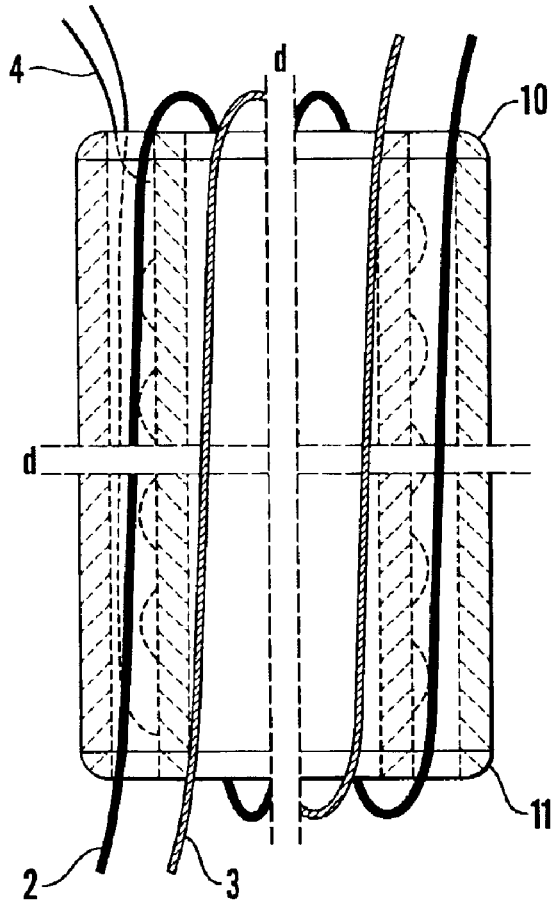
FIG. 45 illustrates the third embodiment of the invention adapted for use as a transformer.
Figure 45B:
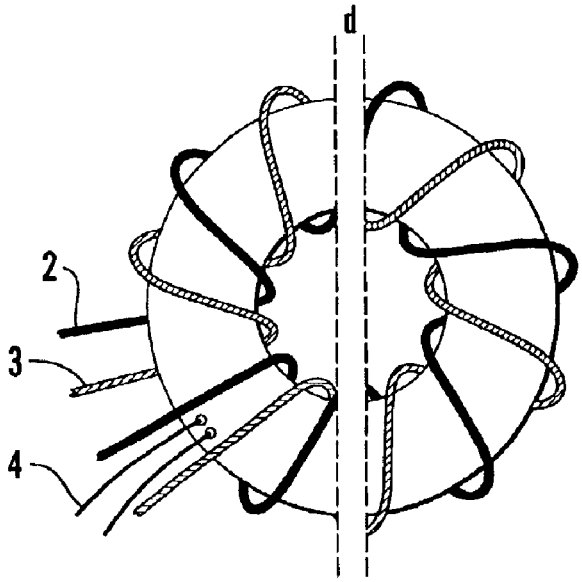

A variant of the device illustrated in FIGS. 40 and 41 is illustrated in FIG. 45, where FIG. 45*a* illustrates the device from the side while 45*b* illustrates it from above. The only difference from the voltage connector in FIGS. 40–41 is that a second main winding 3 is wound in the same course as the main winding 2. By this means an easily constructed, but efficient magnetically influenced voltage converter is obtained.

Figure 46A:
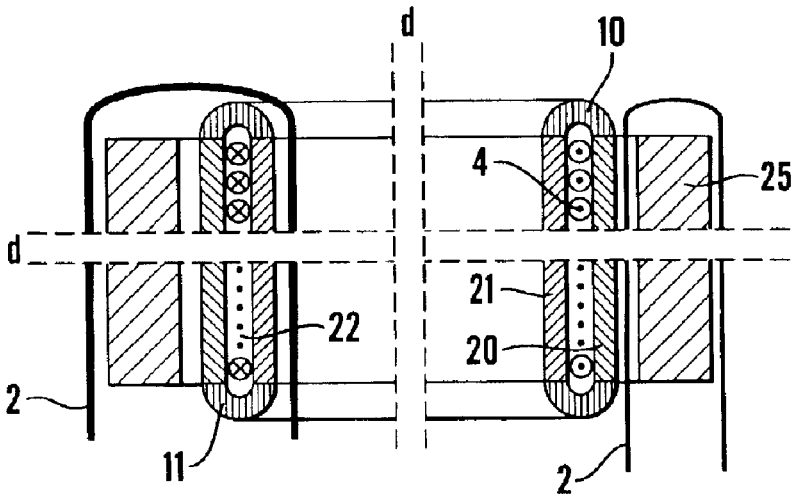
FIGS. 46 and 47 are a section and a view of a fourth embodiment of the invention for use as a reluctance-controlled, flux-connected transformer.
Figure 46B:
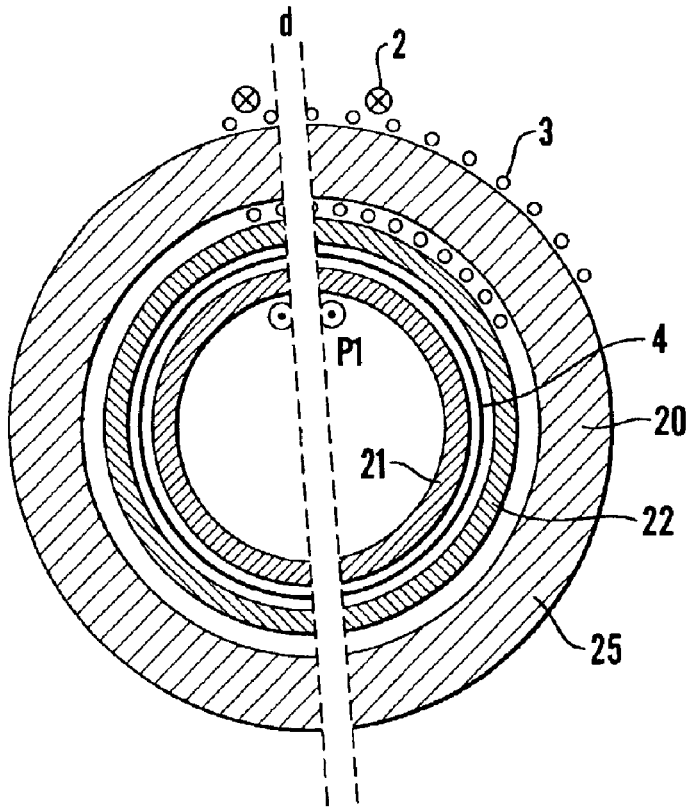
Figure 47A:
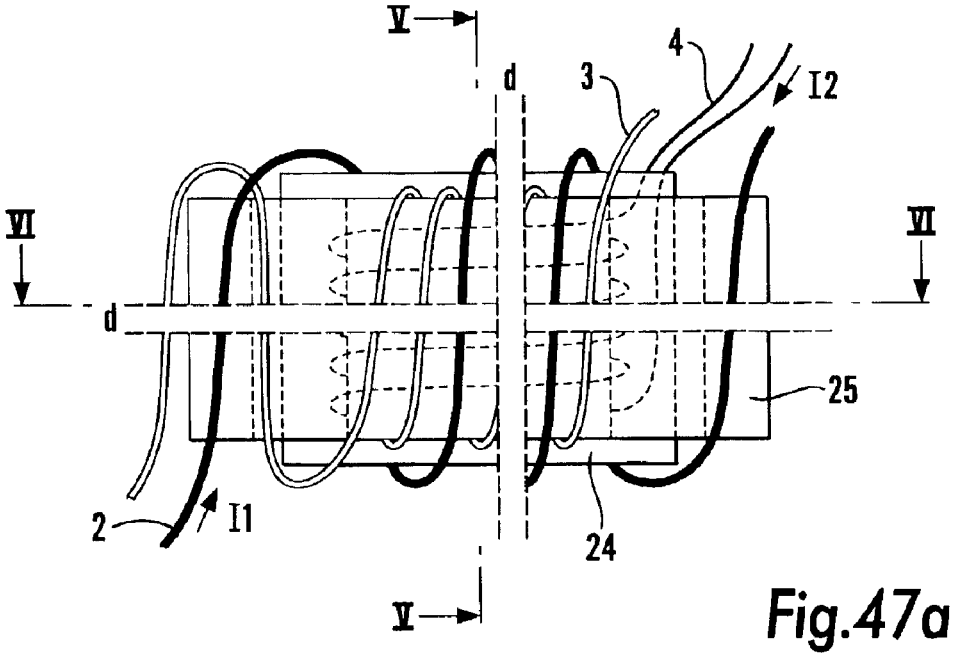
Figure 47B:
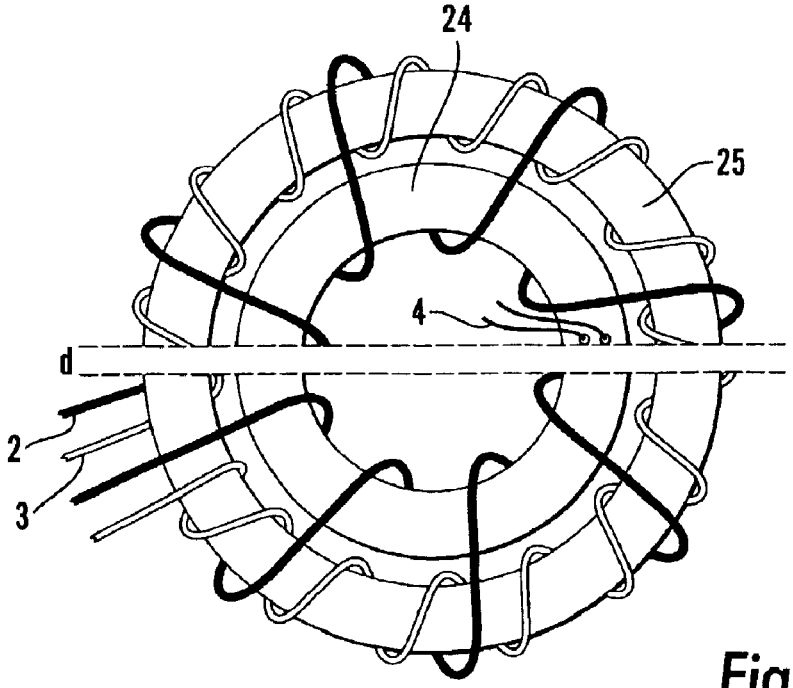

FIGS. 46 and 47 are a section and a view illustrating a fourth embodiment of the voltage connector with concentric tubes.

FIGS. 46 and 47 illustrate the voltage connector which acts as a voltage converter with joined cores. An internal reluctance-controlled core 24 is located within an external core 25 round which is wound a main winding 2. The reluctance-controlled internal core 24 has the same construction as mentioned previously under the description of FIGS. 40 and 41, but the only difference is that there is no main winding 2 round the core 24. It has only a control winding 4 which is located in the gap 22 between the inner 21 and outer parts forming the internal reluctance-controlled core 24, with the result that only core 24 is magnetically reluctance-controlled under the influence of a control field H2 (B2) from current in the control winding 4.

The main winding 2 in FIGS. 46 and 47 is a winding which encloses both core 24 and core 25.

The mode of operation of the reluctance-controlled voltage connector or converter-according to the invention and described in connection with FIGS. 46 and 47 will now be described.

Figure 55:
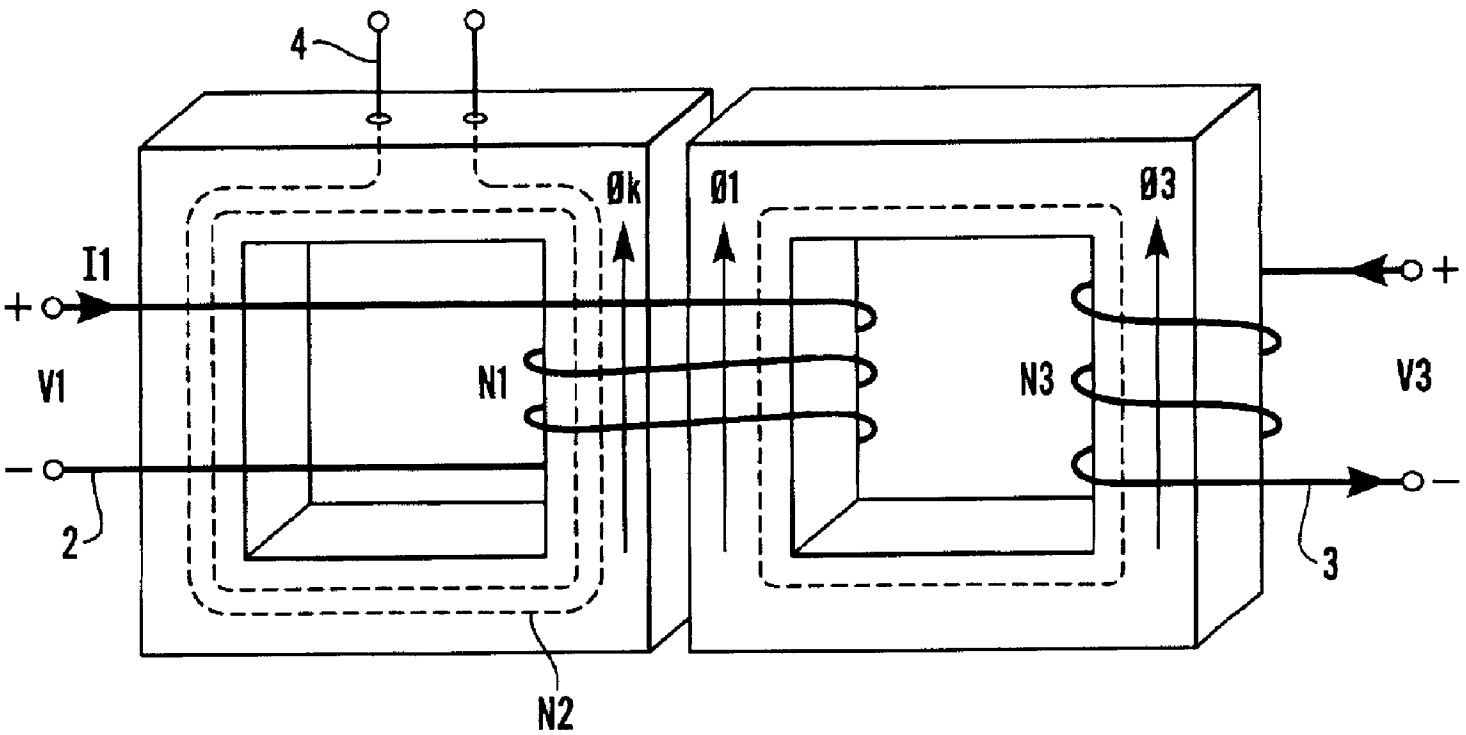
FIG. 55 illustrates a second variant of the device according to the invention together with the principle behind a possibility for transformer connection.
Figure 65B:
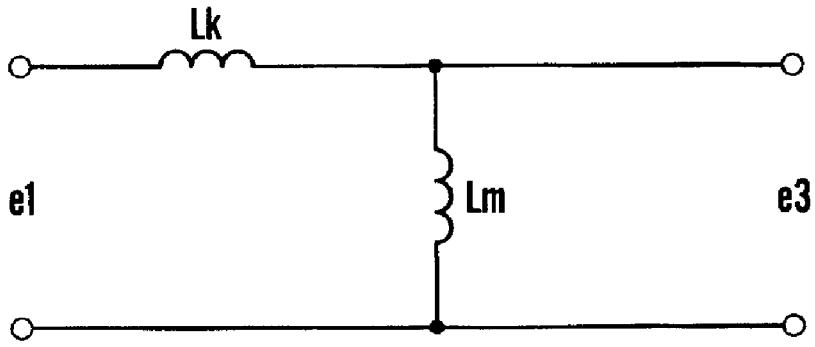

We shall also refer to FIG. 55 which illustrates the principle of the connection, FIG. 65 with a simplified equivalent diagram for the reluctance model where Rmk is the variable reluctance which controls the flux between the windings 2 and 3, and FIG. 65*b* which illustrates an equivalent electrical circuit for the connection where Lk is the variable inductance.

An alternating voltage V1 over winding 2 will establish a magnetisation current I1 in winding 2. This is generated by the flux $\phi 1+\phi 1'$ in the cores 24 and 25 which requires to be established in order to provide the bucking voltage which according to Faraday's Law is generated in 2. When there is no control current in the reluctance-controlled core 24, the flux will be divided between the cores 24 and 25 based on the reluctance in the respective cores 24 and 25.

In order to bring energy through from one winding to the other, the internal reluctance-controlled core 24 has to be supplied with control current I2.

By supplying control current I2 in the positive half-period of the alternating voltage V1 in 2, we shall obtain a half-period voltage over 2. Since the energy is transferred by flux displacement between the reluctance-controlled core 24 and the external (secondary) core 25, the reluctance-controlled core 24 will essentially be influenced by the control current I2 during the period when it is controlled in saturation, while the working flux will travel in the secondary external core 25 and interact with the primary winding 2 during the energy transfer.

When the reluctance-controlled core 24 is brought out of saturation by resetting the control flux B2 (H2) which is orthogonal to the working flux B1 (H1), the flux from the primary side will again be divided between the cores 24 and 25, and a load connected to the secondary winding 3 will only see a low reluctance and thereby high inductance and little connection between primary (V1) and secondary (V3) voltage. A voltage will be generated over the secondary winding 3, but on account of the magnitude of Lk compared to the magnetisation impedance Lm, most of the voltage (V1) from the primary winding 2 will overlay Lk. The flux from the primary winding 2 will essentially go where there is the least reluctance and where the flux path is shortest (FIG. 65*b*).

It may also be envisaged that the external core 25 could be made controllable, in addition to having a fourth main winding wound round the internal controllable core 24. This is to enable the voltage between the cores 24 and 25 to be controlled as required.

Figure 48:
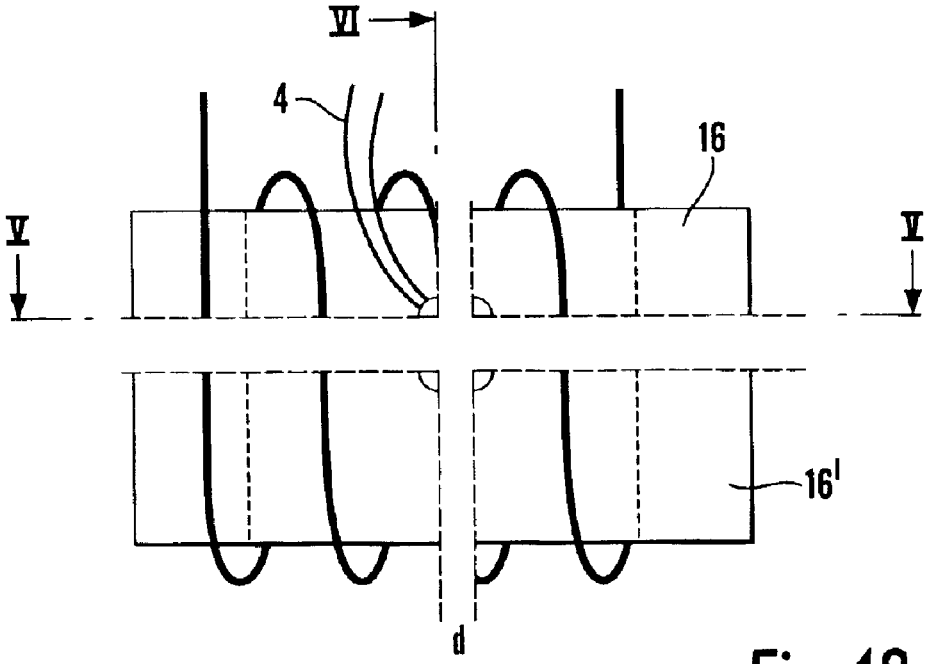
FIGS. 48 and 49 illustrate the fourth embodiment of the invention adapted to suit a powder-based magnetic material, and thereby without magnetic field connectors.

FIG. 48 describes a further variant of the fourth embodiment of a magnetically influenced voltage connector or voltage converter according to the invention, where the magnetisable body 1 is so designed that the control flux B2 (H2) is connected directly without a separate magnetic field connector through the main core 16.

FIG. 48 illustrates a voltage connector in the form of a toroid viewed from the side. The voltage connector comprises two core parts 16 and 16', a main winding 2 and a control winding 4.

Figure 49:
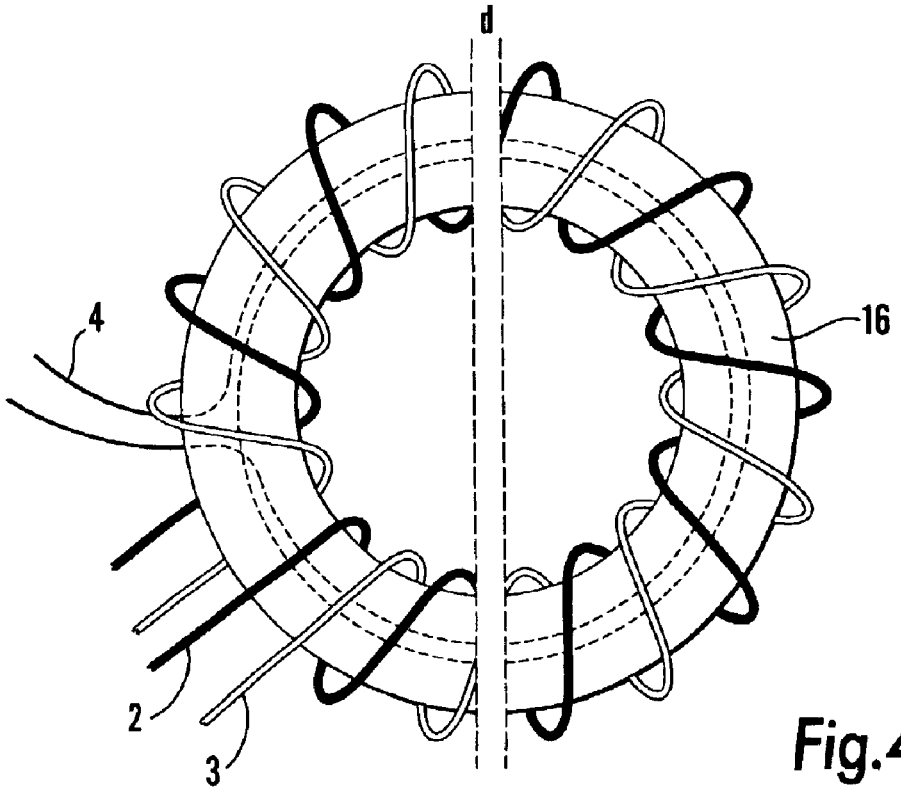

FIG. 49 illustrates a voltage connector according to the invention equipped with an extra main winding 3 which offers the possibility of converting the voltage.

Figure 50:
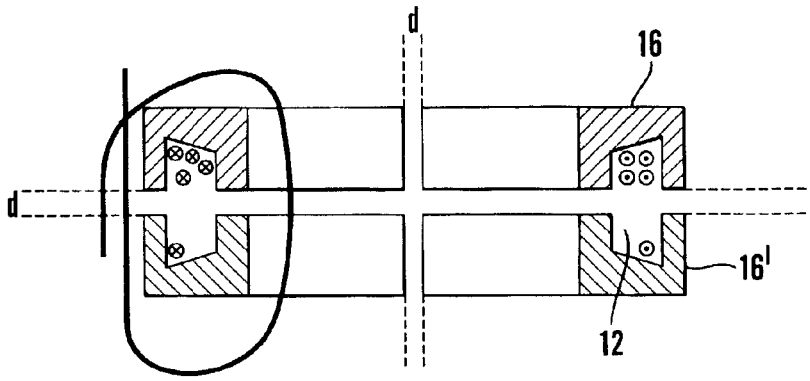
FIGS. 50 and 51 are sections along lines VI—VI and V—V in FIG. 48.
Figure 51A:
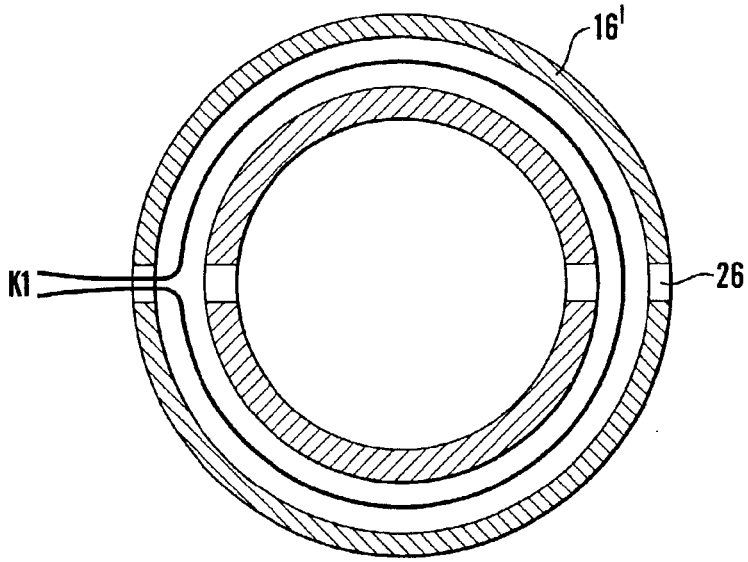
Figure 51B:
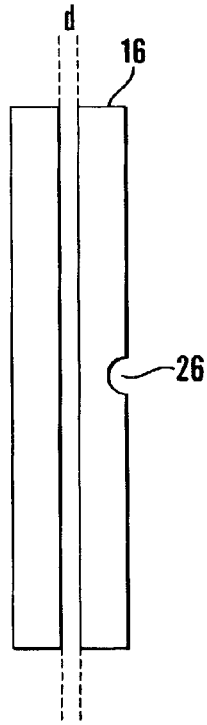

FIG. 50 illustrates the device in FIG. 48 in section along line VI—VI in FIG. 48 and FIG. 51 illustrates a section along line V—V. In FIG. 50 a circular aperture 12 is illustrated for placing the control winding 4.

FIG. 51 illustrates an additional aperture 26 for passing through wiring.

Figure 52A:
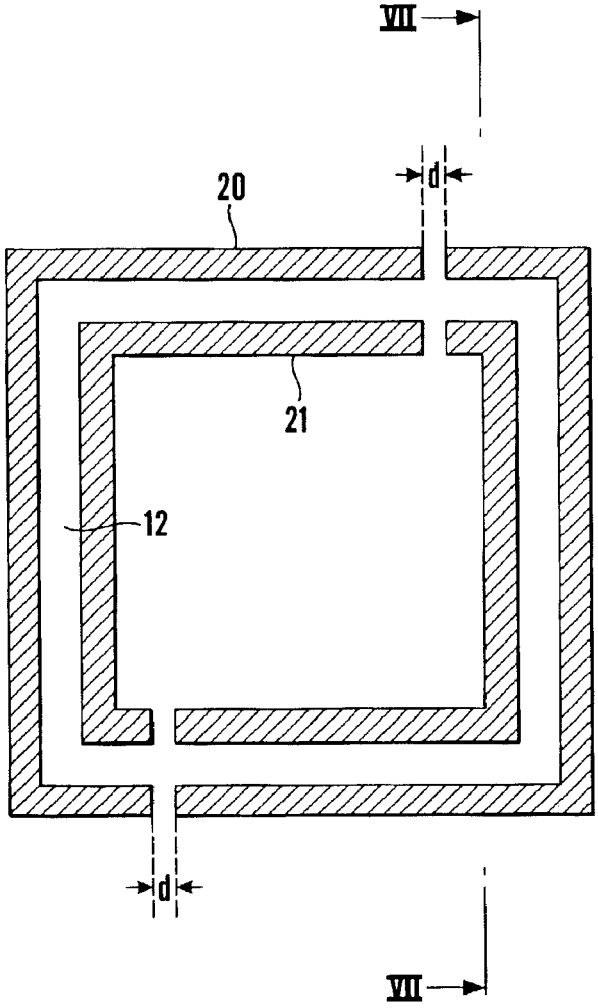
FIGS. 52 and 53 illustrate a core adapted to suit a powder-based magnetic material, and thereby without magnetic field connectors.
Figure 52B:
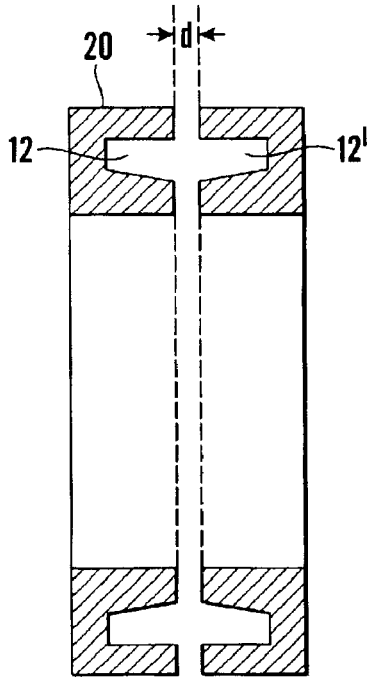
Figure 53A:
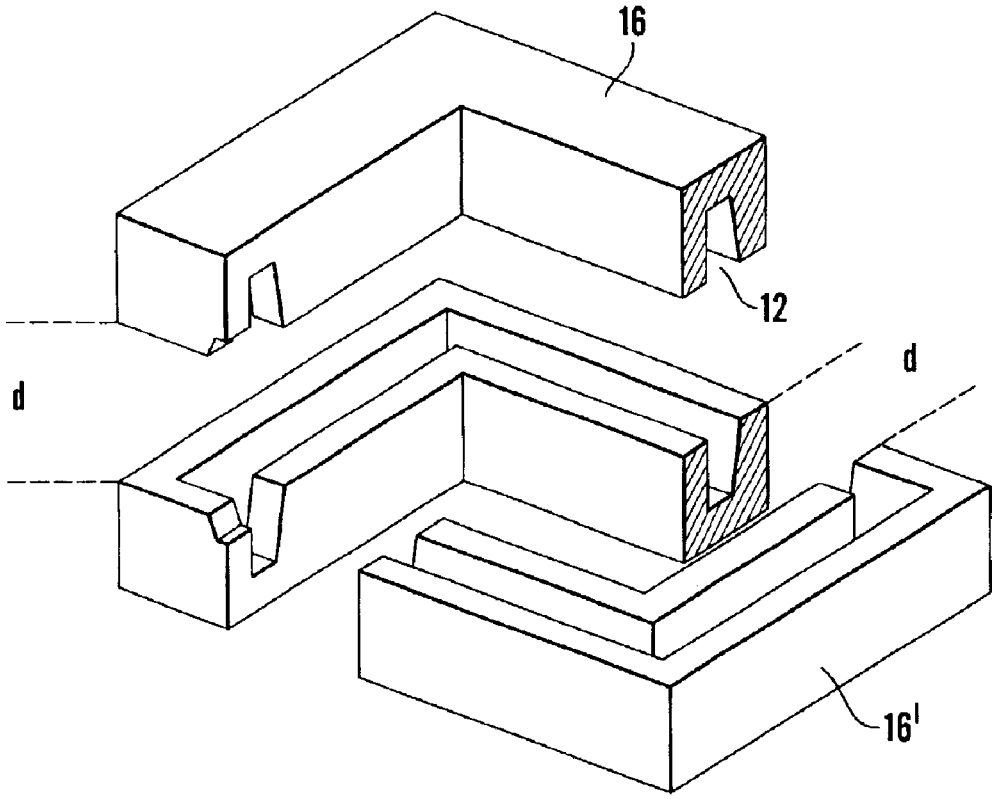
Figure 53B:
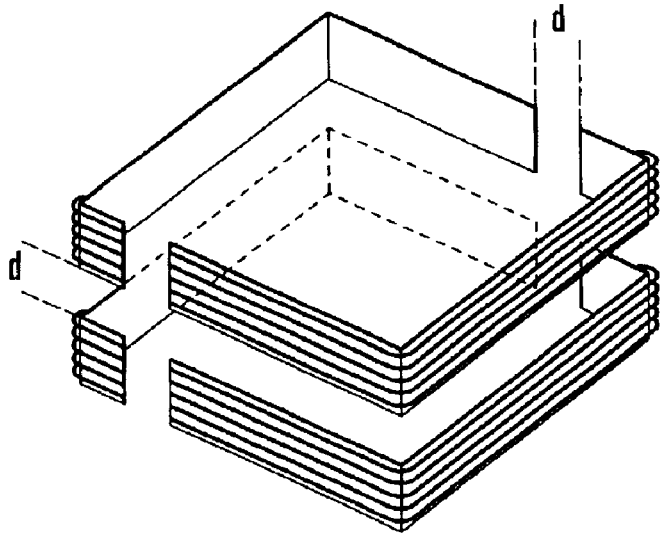

FIGS. 52 and 53 illustrate the structure of a core 16 without windings and where the core 16 is so designed that there is no need for an extra magnetic field connector for the control field. The core 16 has two core parts 16, 16' and an aperture 12 for a control winding 4. This design is intended for use where the magnetic material is sintered or compressed powder-moulded material. In this case it will be possible to insert closed magnetic field paths in the topology, with the result that what were previously separate connectors which were required for foil-wound cores form part of the actual core and are a productive part of the structure. The core, which forms the closed magnetic circuit without separate magnetic field connectors and which is illustrated in these FIGS. 52 and 53, will be able to be used in all the embodiments of the invention even though the figures illustrate a body 1 adapted for the first embodiment of the invention (illustrated inter alia in FIGS. 1 and 2).

Figure 54:
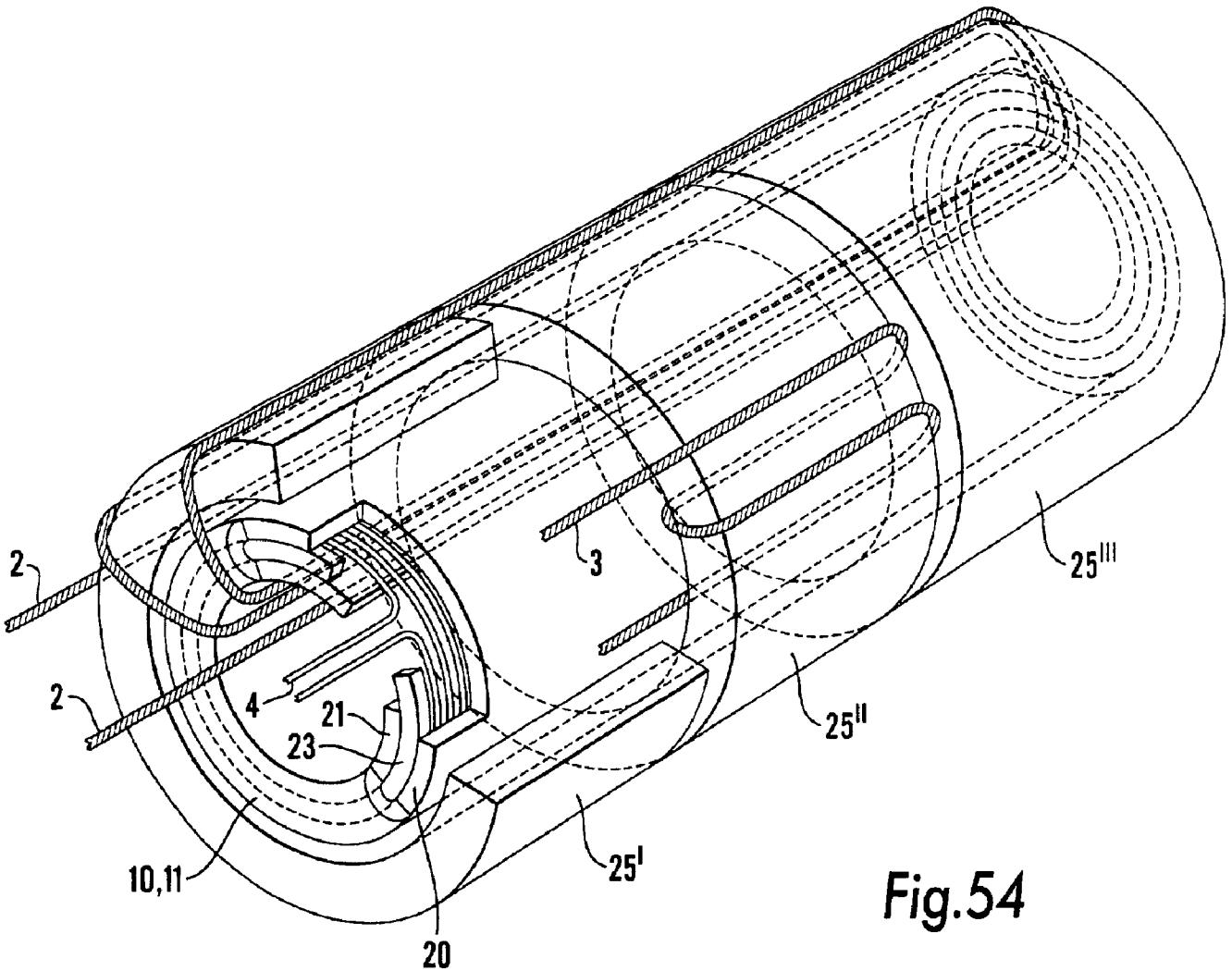
FIG. 54 is an "X-ray picture" of a variant of the fourth embodiment of the invention.

FIG. 54 illustrates a magnetically influenced voltage converter device, where the device has an internal control core 24 consisting of an external tube 20 and an internal tube 21 which are concentric and made of a magnetisable material with a gap 22 between the external tube's 20 inner wall and the internal tube's 21 outer wall. Spacers 23 are mounted in the gap between the external tube's 20 inner wall and the internal tube's 21 outer wall. Magnetic field connectors 10, 11 are mounted between the tubes 20 and 21 at respective ends thereof. A combined control and magnetisation winding 4 is wound round the internal tube 21 and is located in the said gap 22. The device further consists of an external secondary core 25 with windings comprising a plurality of ring core coils 25', 25", 25'" etc. placed on the outside of the control core 24. Each ring core coil 25', 25", 25'" etc. consists of a ring of a magnetisable material wound round by a respective second main winding or secondary winding 3, only one of which is illustrated for the sake of clarity. A first main winding or primary winding 2 is passed through the internal tube 21 in the control core 24 and along the outside of the external cores 25 N1 number of times, where N1=1, . . . r.

It is also possible to envisage the secondary core device being located within the control core 24, in which case the primary winding 2 will have to be passed through the ring cores 25 and along the outside of the control core 24.

FIG. 55 is a schematic illustration of a second embodiment of the magnetically influenced voltage regulator according to the invention with a first reluctance-controlled core 24 and a second core 25, each of which is composed of a magnetisable material and designed in the form of a closed, magnetic circuit, the said cores being juxtaposed. At least one first electrical conductor 8 is wound on to a main winding 2 about both the first and the second core's cross-sectional profile along at least a part of the said closed circuit. At least one second electrical conductor 9 is mounted as a winding 4 in the reluctance-controlled core 24 in a form which essentially corresponds to the closed circuit. In addition, at least one third electrical conductor 27 is wound round the second core's 25 cross-sectional profile along at least a part of the closed circuit. The field direction from the first conductor's 8 winding 2 and the second conductor's 9 winding is orthogonal. By means of this solution, the first conductor 8 and the third conductor 27 form a primary winding 2 and a secondary winding 3 respectively.

Figure 56:
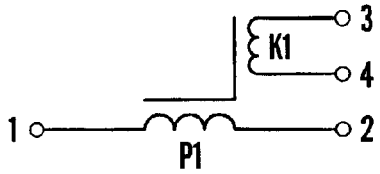
FIG. 56 illustrates a proposal for an electro-technical schematic symbol for the voltage connector according to the invention.
Figure 57:
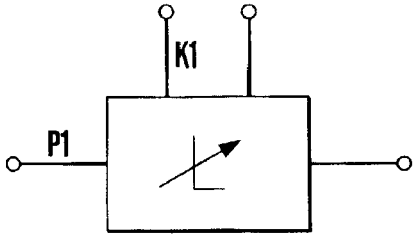
FIG. 57 illustrates a proposal for a block schematic symbol for the voltage connector.

FIG. 56 illustrates a proposal for an electro-technical schematic symbol for the voltage connector according to the invention. FIG. 57 illustrates a proposal for a block schematic symbol for the voltage connector.

Figure 58:
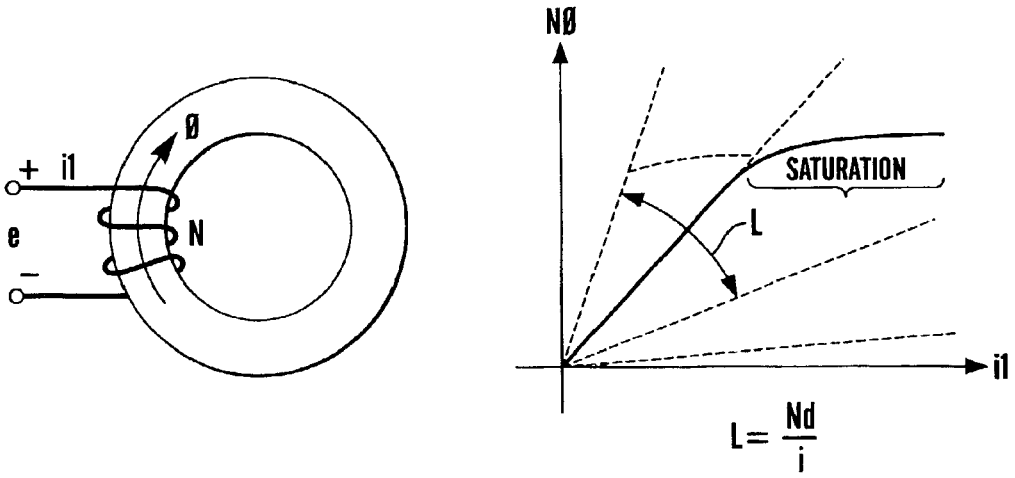
FIG. 58 illustrates a magnetic circuit where the control winding and control flux are not included.

FIG. 58 illustrates a magnetic circuit where the control winding 4 and control flux B2 (H2) are not included.

In FIGS. 59 and 60 there is a proposal for an electro-technical schematic symbol for the voltage converter where the reluctance in the control core 24 shifts magnetic flux between a core with fixed reluctance 25 and a second core with variable reluctance 24 (see for example FIG. 55).

There is, of course, no restriction to having two cores with variable reluctance. The fact that we can shift flux between two cores within the same winding will be employed in order to make a magnetic switch which can switch a voltage off and on independently of the course of magnetisation in the main core. This means that we have a switch which has the same function as a GTO, except that we can choose whatever switching time we wish.

The device according to the invention will be able to be used in many different connections and examples will now be given of applications in which it will be particularly suitable.

FIG. 61 illustrates the use of the invention in an alternating current circuit in order to control the voltage over a load RL, which may be a light source, a heat source or other load.

FIG. 62 illustrates the use of the invention in a three-phase system where such a voltage connector in each phase, connected to a diode bridge, is used for a linear regulation of the output voltage from the diode bridge.

FIG. 63 illustrates a use as a variable choke in DC—DC converters.

FIG. 64 illustrates a use as a variable choke in a filter together with condensers. Here we have only illustrated a series and a parallel filter (64*a* and 64*b* respectively), but it is implicit that the variable inductance can be used in a number of filter topologies.

A further application of the invention is that described inter alia in connection with FIGS. 14 and 45, where proposals for schematic symbols were given in FIG. 59. In this application, the voltage connector has a function as a voltage converter where a secondary winding is added. An application as a voltage regulator is also illustrated here, where the magnetisation current in the transformer connection and the leakage reactance are controllable via the control winding 4. The special feature of this system is that the transformer equations will apply, while at the same time the magnetisation current can be controlled by changing $\mu r$. In this case, therefore, the characteristic of the transformer can be regulated to a certain extent. If there is a DC excitation of one winding 2, it will be possible to obtain transformed energy through the transformer by varying $\mu r$ and thereby the flux in the reluctance-controlled core instead of varying the excitation. Thus it is possible in principle to generate an AC voltage from a DC voltage by means of the fact that an alteration of the magnetisation current from the DC generator into this system will be able to be transformed to a winding on the secondary side.

Another application of the invention is illustrated in FIGS. 46 and 47, where a variable reluctance as control core is surrounded or enclosed by one or more separate cores with separate windings, as well as FIG. 55 where a first reluctance-controlled core and a second core are designed as closed magnetic circuits and are juxtaposed. We also refer to FIG. 65 which illustrates an equivalent electrical circuit.

FIG. 55 illustrates how the fluxes in the invention travel in the cores. We wish to emphasise that the flux in the control core is connected to the flux in the working core via the windings enclosing both cores. In this system transformation of electrical energy will be able to be controlled by flux being connected to and disconnected from a control core and a working core. Since the fluxes between the cores are interconnected through Faraday's induction law, the functional dependence of the equations for the primary side and the equations for the secondary side will be controlled by the connection between the fluxes. In a linear application we will be able to control a transformation of voltages and currents between a primary winding and a secondary winding linearly by altering the reluctance in the control core, thus permitting us to introduce here the term reluctance-controlled transformer. For a switched embodiment we will be able to introduce the term reluctance-controlled switch.

The flux connection between the primary or first main winding 2 and the secondary winding or second main winding 3 will now be explained. Winding 2 which now encloses both the reluctance-controlled control core 24 and the main core 25 will establish flux in both-cores. The self-inductance L1 to 2 tells how much flux, or how many flux turns are produced in the cores when a current is passed in I1 in 2. The mutual inductance between the primary winding 2 and the secondary winding 3 indicates how many of the flux turns established by 2 and I1 are turned about 2 and about the secondary winding 3.

We may, of course, also envisage the main core 25 being reluctance-controlled, but for the sake of simplicity we shall refer here to a system with a main core 25 where the reluctance is constant, and a control core 24 where the reluctance is variable.

The flux lines will follow the path which gives the highest permanence (where the permeability is highest), i.e. with the least reluctance.

In FIGS. 55 and 65 we have not taken into consideration the leakage fields in the main windings 2 and 3. FIG. 55 illustrates a simplified model of the transformer where the primary 2 and secondary 3 windings are each wound around a transformer leg, while in practice they will preferably be wound on the same transformer leg, and in our case, for example, the outer ring core which is the main core 25 will be wound around the secondary winding 3 distributed along the entire core 25. Similarly, the primary winding 2 will be wound around the main core 25 and the control core 24 which may be located concentrically and within the main core.

FIG. 65 illustrates a simplified reluctance model for the device according to the invention.

FIG. 65*b* illustrates a simplified electrical equivalent diagram for the connector according to the invention, where the reluctances are replaced by inductances.

A current in 2 generates flux in the cores 24 and 25:

$$\Phi=\Phi_k+\Phi_1 \qquad 40)$$

where:

$\Phi_p$=total flux established by the current in 2.

$\Phi_k$=the total flux travelling through the control core 24.

$\Phi_1$=part of the total flux travelling through the main core 25.

Since the leakage flux in main core 24 and control core 25 are disregarded, $$\Phi_1=-\Phi_2 \qquad 41)$$

In a way $\Phi_k$ may be regarded as a controlled leakage flux.

On the basis of FIG. 65 we can formulate the highly simplified electrical equivalent diagram for the magnetic circuit illustrated in FIG. 65*b*.

FIG. 65*b* therefore illustrates the principle of the reluctance-controlled connector, where the inductance $L_k$ absorbs the voltage from the primary side.

$$L_k = \frac{\lambda_k}{I} = \frac{NI^2}{R_{mk}} \qquad 42)$$

This inductance is controlled through the variable reluctance in the control core 24, with the result that the connection or the voltage division for a sinusoidal steady-state voltage applied to the primary winding will be approximately equal to the ratio between the inductance in the respective cores as illustrated in equation 43.

$$\frac{e_2}{e_1} = \frac{Lm}{L_k + Lm} \quad 43)$$

When the control core 24 is in saturation, $L_k$ is very small compared to $L_m$ and the voltage division will be according to the ratio between the number of turns N1/N3. When the control core is in the off state, $L_k$ will be large and to the same extent will block voltage transformation to the secondary side.

The magnetisation of the cores relative to applied voltage and frequency is so rated that the main core 25 and the control core 24 can each separately absorb the entire time voltage integral without going into saturation. In our model the area of iron on the control and working cores is equal without this being considered as limiting for the invention.

Since the control core 24 is not in saturation on account of the main winding 2, we shall be able to reset the control core 24 independently of the working flux B1 (H1), thereby achieving the object by means of the invention of realising a magnetic switch. If necessary the main core 25 may be reset after an on pulse or a half on period by the necessary MMF being returned in the second half-period only in order to compensate-for any distortions in the magnetisation current.

In a switched application, when the switch is off, i.e. when the flux on the primary winding 2 is distributed between the control core 24 and the working core 25, the flux connection between the primary 2 and the secondary 3 winding will be slight and very little energy transfer takes place between primary 2 and secondary 3 winding.

When the switch is on, i.e. when the reluctance in the control core 24 is very low ($\mu r$=10–50) and approaching the reluctance of an air coil, we will have a very good flux connection between primary 2 and secondary 3 winding and transfer of energy.

An important application of the invention will thus be as a frequency converter with reluctance-controlled switches and a DC-AC or AC-DC converter by employing the reluctance-controlled switch in traditional frequency converter connections and rectifier connections.

A frequency converter variant may be envisaged realised by adding bits of sinus voltages from each phase in a three-phase system, each connected to a separate reluctance-controlled core which in turn is connected to one or more adding cores which are magnetically connected to the reluctance-controlled cores through a common winding through the adding cores and the reluctance-controlled cores. Parts of sinus voltages can then be connected from the reluctance-controlled cores into the adding core and a voltage with a different frequency is generated.

A DC-AC converter may be realised by connecting a DC voltage to the main winding enclosing the working core, where this time the working core is also wound round a secondary winding where we can obtain a sinus voltage by changing the flux connection between working core and control core sinusoidally.

FIG. 66 illustrates the connection for a magnetic switch. This may, of course, also act as an adjustable transformer.

Figure 67A:
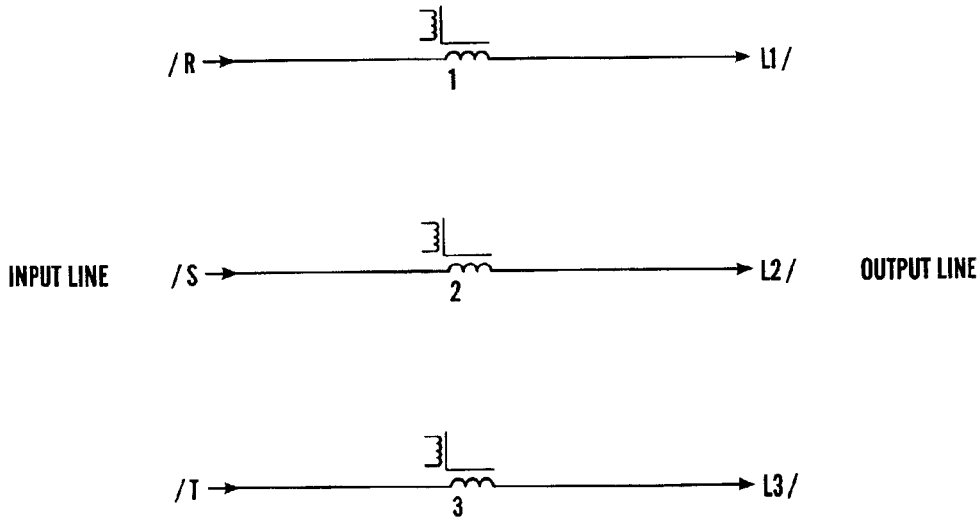

FIGS. 67 and 67*a* illustrate an example of a three-phase design. All the other three-phase rectifier connectors are, of course, also feasible. By means of connection to a diode bridge or individual diodes to the respective outlets in a 12-pulse connector, an adjustable rectifier is obtained.

In the application as an adjustable transformer, it must be emphasised that the size of the reluctance-controlled core is determined by the range of adjustment which is required for the transformer, (0–100% or 80–110%) for the voltage.

Figure 67B:
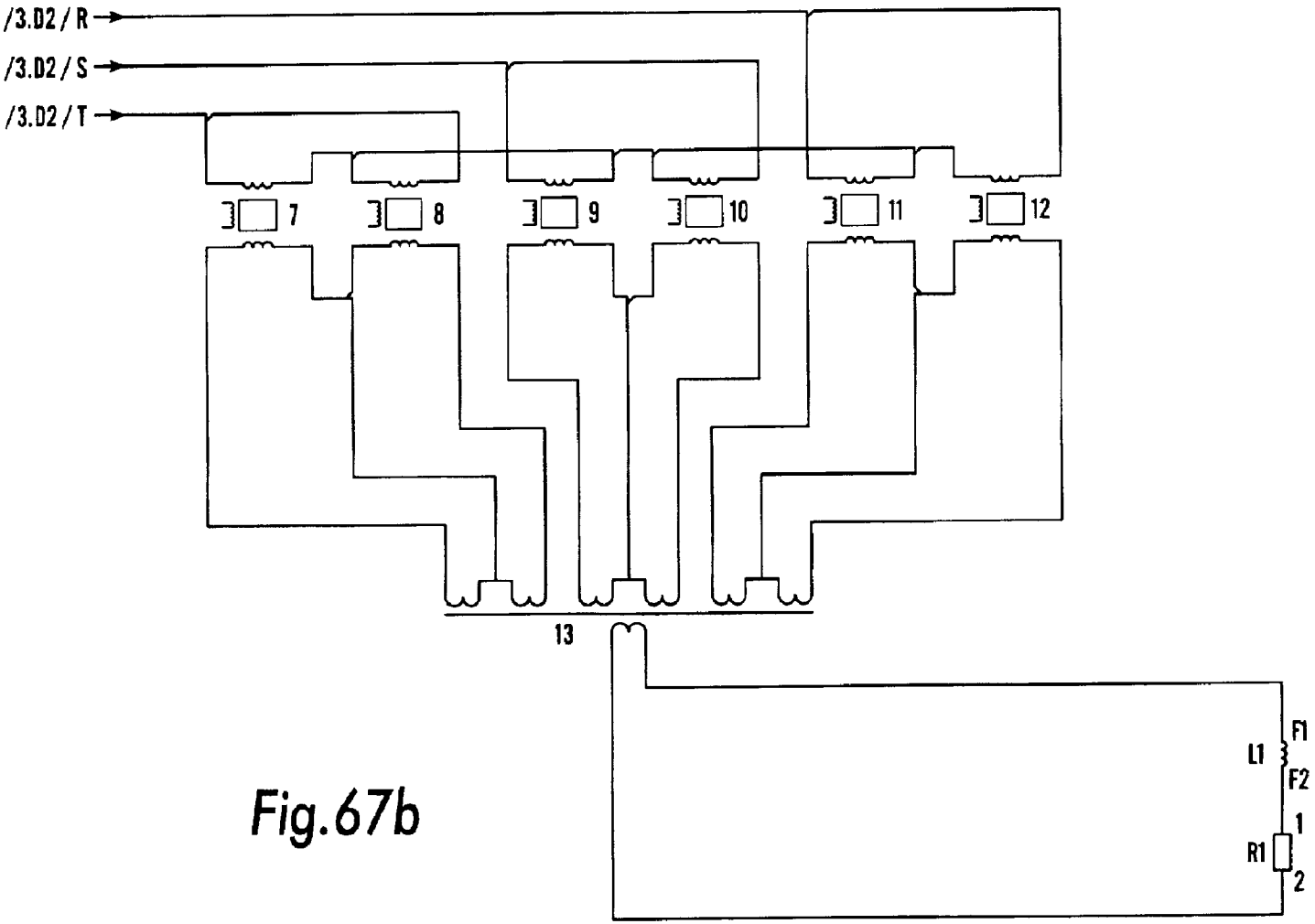

FIG. 67*b* illustrates the use of the device according to the invention as a connector in a frequency converter for converting input frequency to randomly selected output frequency and intended for operation of an asynchronous motor, for adding parts of the phase voltage generated from a 6 or 12-pulse transformer to each motor phase (FIG. 67*b*).

FIG. 68 illustrates the device used as a switch in a UFC (unrestricted frequency changer with forced commutation).

FIG. 69 illustrates a circuit comprising 6 devices 28–33 according to the invention. The devices 28–33 are employed as frequency converters where the period of the voltages generated is composed of parts of the fundamental frequency. This works by "letting through" only the positive half-periods or parts of the half-periods of a sinus voltage in order to make the positive new half-period in the new sinus voltage, and subsequently the negative half-periods or parts of the negative half-periods in order thereby to make the negative half-periods in the new sinus voltage. In this way a sinus voltage is generated with a frequency from 10% to 100% of the fundamental frequency. This converter also acts as a soft start since the voltage on the output is regulated via the reluctance control of the connection between the primary and the secondary winding.

In FIG. 69, if the first half-period is allowed through connector no. 28 (main winding 2), the current through the secondary winding (main winding 3) in the same connector will commutate to the secondary winding (main winding 3) in connector no. 29, and on from 29 to 28, etc.

FIG. 70 illustrates the use of the device according to the invention as a DC to AC converter. Here the main winding 2 in the connector is excited by a DC voltage U1 which establishes a field H1 (B1) both in the control core 24 and in the main core 25 (these are not shown in the figure). The number of turns N1, N2, N3 and the area of iron are designed in such a manner that none of the cores are in saturation in steady state. In the event of a control signal (i.e. excitation of the control winding 4) into the control core 24, the flux B2 (H2) therein will be transferred to the main core 25 and a change in the flux B1 (H1) in this core 25 will induce a voltage in the secondary winding (main winding 3). By having a sinusoidal control current I2, a sinusoidal voltage will be able to be generated on the secondary side (main winding 3), with the same frequency as the control voltage U1.

FIG. 70*b* illustrates the use of the invention as a converter with a change of reluctance.

FIG. 71 illustrates a use of the device according to the invention as an AC-DC converter. The same control principle is used here as that explained above in the description of a frequency converter in FIG. 69. FIG. 71*b* illustrates a diagram of the time of the device's input and output voltage.

As mentioned previously, the voltage connector according to the invention is substantially without movable parts for the absorption of electrical voltage between a generator and a load. The function of the connector is to be able to control the voltage between the generator and the load from 0–100% by means of a small control current. A second function will be purely as a voltage switch. A further function could be forming and transforming of a voltage curve.

The new technology according to the invention will be capable of being used for upgrading existing diode rectifiers, where there is a need for regulation. In connection with 12-pulse or 24-pulse rectifier systems, it will be possible to balance voltages in the system in a simple manner while having controllable rectification from 0–100%.

With regard to the magnetic materials involved in the invention, these will be chosen on the basis of a cost/benefit function. The costs will be linked to several parameters such as availability on the market, produceability for the various solutions selected, and price. The benefit functions are based on which electro-technical function the material requires to have, including material type and magnetic properties. Magnetic properties considered to be important include hysteresis loss, saturation flux level, permeability, magnetisation capacity in the two main directions of the material and magnetostriction. The electrical units frequency, voltage and power to the energy sources and users involved in the invention will be determining for the choice of material. Suitable materials include the following:

a) Iron-silicon steel: produced as a strip of a thickness approximately 0.1 mm–0.3 mm and width from 10 mm to 1100 mm and rolled up into coils. Perhaps the most preferred for large cores on account of price and already developed production technology. For use at low frequencies.

b) Iron-nickel alloys (permalloys) and/or iron-cobalt alloys (permendur) produced as a strip rolled up into coils. These are alloys with special magnetic properties with subgroups where very special properties have been cultivated.

c) Amorphous alloys, Metglas: produced as a strip of a thickness of approximately 20 $\mu$m–50 $\mu$m, width from 4 mm to 200 mm and rolled up into coils. Very high permeability, very low loss, can be made with almost 0 magnetostriction. Exists in a countless number of variants, iron-based, cobalt-based, etc. Fantastic properties but high price.

d) Soft ferrites: Sintered in special forms developed for the converter industry. Used at high frequencies due to small loss. Low flux density. Low loss. Restrictions on physically realisable size.

e) Compressed powder cores: Compressed iron powder alloy in special shapes developed for special applications. Low permeability, maximum approximately 400–600 to-day. Low loss, but high flux density. Can be produced in very complicated shapes.

All sintered and press-moulded cores can implement the topologies which are relevant in connection with the invention without the need for special magnetic field connectors, since the actual shape is made in such a way that closed magnetic field paths are obtained for the relevant fields.

If cores are made based on rolled sheet metal, they will have to be supplemented by one or more magnetic field connectors.

What is claimed is:

1. A magnetically influenced device, comprising;

a body comprising a closed magnetic circuit, the magnetic circuit comprising an anisotropic magnetisable material;

at least one first electrical conductor wound around the body along at least a part of the closed circuit for at least one turn which forms a first main winding; and at least one second electrical conductor wound around the body along at least a part of the closed circuit for at least one turn which forms a control winding, wherein a winding axis for the turn in the main winding is at right angles to a winding axis for the turn in the control winding, wherein orthogonal magnetic fields are generated in the body when the first main winding and the control winding are excited, and wherein a characteristic of the anisotropic magnetisable material relative to a field in the main winding is controlled by means of a field in the control winding.

2. A device as indicated in claim 1, wherein the axis for the turn in the main winding is parallel to a longitudinal direction of the body, wherein the turn in the control winding extends substantially along the magnetisable body, and wherein the axis for the control winding is at right angles to the longitudinal direction.

3. A device as indicated in claim 1, wherein the axis for the turn in the control winding is parallel to a longitudinal direction of the body, wherein the turn in the main winding extends substantially along the magnetisable body, and wherein the axis for the main winding is at right angles to the longitudinal direction.

4. A device as claimed in one of claims 1–3, further comprising a third electrical conductor wound round the body along at least a part of the closed circuit for at least one turn which forms a third main winding, wherein a winding axis for the turn in the third main winding is parallel to the winding axis for the turn in the first main winding, and wherein a transformer effect between the first and the third main windings results when at least one of the first main winding and the third main winding is excited.

5. A device as claimed in one of claims 1–3, further comprising a third electrical conductor wound round the body along at least a part of the closed circuit for at least one turn which forms a third main winding, wherein a winding axis for the turn in the third main winding is parallel to the winding axis for the turn in the first control winding, and wherein a transformer effect between the third main winding and the control winding results when at least one of the first main winding and the third main winding is excited.

6. A magnetically influenced device, comprising:

a first body and a second body each comprising a magnetic circuit, the magnetic circuit comprising an anisotropic magnetisable material, the said bodies being juxtaposed;

at least one first electrical conductor wound along at least a part of the magnetic circuit for at least one turn to form a first main winding; and at least one second electrical conductor wound around at least a part of at least one of the first body and the second body for at least one turn to form a control winding, wherein a winding axis for the turn in the main winding is at right angles to a winding axis for the turn in the control winding, wherein orthogonal magnetic fields are generated in at least one of the first body and the second body when the first main winding and the control winding are excited, and wherein a characteristic of the anisotropic magnetisable material relative to a field in the main winding is controlled by means of a field in the control winding.

7. A magnetically influenced device, comprising:

a first body and a second body, each comprising an anisotropic magnetisable material;

a first magnetic field connector;

a second magnetic field connector;

a closed magnetic circuit formed by a combination of the first and second magnetic field connectors and the first and second bodies;

at least one first electrical conductor wound around at least a part of at least one of the first body and the second body for at least one turn to form a first main winding; and at least one second electrical conductor wound along at least a part of the closed circuit for at least one turn to form a control winding, wherein the first and second bodies are juxtaposed, wherein a winding axis for the turn in the main winding is at right angles to a winding axis for the turn in the control winding, wherein orthogonal magnetic fields are generated in at least one of the first body and the second body when the first main winding and the control winding are excited, and wherein a characteristic of the anisotropic magnetisable material relative to a field in the main winding is controlled by means of a field in the control winding.

8. A device as indicated in claim 6, further comprising magnetic field connectors which together with the bodies form the magnetic circuit.

9. A device as indicated in claims 6, 7 or 8, further comprising:

a third electrical conductor wound for at least one turn to form a third main winding, wherein a winding axis for the turn in the third main winding is parallel to the winding axis for the turn in the first main winding, and wherein a transformer effect between the first and the third main windings results when at least one of the first and third main windings is excited.

10. A device as claimed in one of claims 7 or 8, further comprising:

a third electrical conductor wound for at least one turn to form a third main winding, wherein a winding axis for the turn in the third main winding is parallel to the winding axis for the turn in the control winding, and wherein a transformer effect between the third main winding and the control winding results when at least one of the third main winding and the control winding is excited.

11. A device according to claims 7 or 8, wherein the first and the second body are tubular in shape, wherein at least one of the first conductor and the second conductor extend through the first and the second bodies, and wherein the magnetic field connectors comprise apertures for the conductors.

12. A device according to claim 11, wherein the magnetic field connectors each comprise a gap that facilitates insertion of at least one of the first and the second conductors, and wherein the gap interrupts a magnetic field path of at least one of the orthogonal magnetic fields.

13. A device according to claim 11, wherein an insulating film is located between end surfaces of the first and second bodies, and the magnetic field connectors.

14. A device according to claim 11, wherein each of the first and second bodies comprise a plurality of core parts.

15. A device according to claim 14, further comprising an insulating layer arranged between the core parts.

16. A device according to one of claims 6–8, wherein the first and second bodies have a cross section comprising a shape that is selected from the group consisting of circular, square, rectangular, triangular and hexagonal.

17. A magnetically influenced device, comprising:

a first, external tubular body and a second, internal tubular body located concentric to each other around a common axis, each body comprising an anisotropic magnetisable material that provides a magnetic circuit;

at least one first electrical conductor wound round the tubular bodies for at least one turn to form a first main winding; and at least one second electrical conductor provided in a gap between the tubular bodies and wound around the common axis for at least one turn to form a control winding, wherein a winding axis for the turn in the main winding is at right angles to a winding axis for the turn in the control winding, wherein orthogonal magnetic fields are generated in the body when the first main winding and the control winding are excited, and wherein a characteristic of the anisotropic magnetisable material relative to a field in the main winding is controlled by means of a field in the control winding.

18. A magnetically influenced device, comprising:

a first, external tubular body and a second, internal tubular body located concentric to each other around a common axis, each body comprising an anisotropic magnetisable material;

a first magnetic field connector;

a second magnetic field connector, a closed magnetic circuit formed by the tubular bodies and the first and second connectors;

at least one first electrical conductor provided in a gap between the tubular bodies, the first electrical conductor wound around the common axis for at least one turn to form a first main winding; and at least one second electrical conductor wound round the tubular bodies for at least one turn to form a control winding, wherein a winding axis for the turn in the main winding is at right angles to a winding axis for the turn in the control winding, wherein orthogonal magnetic fields are generated in at least one of the first body and the second body when the first main winding and the control winding are excited, and wherein a characteristic of the anisotropic magnetisable material relative to a field in the main winding is controlled by means of a field in the control winding.

19. A device according to claim 17, comprising:

a first magnetic field connector; and a second magnetic field connector, wherein a closed magnetic circuit is formed by the tubular bodies and the first and second connectors.

20. A device according to claims 17, 18 or 19, comprising:

a third electrical conductor wound for one turn to form a third main winding, wherein a winding axis for the turn in the third main winding is parallel to the winding axis for the turn in the first main winding, and wherein a transformer effect between the first and the third main windings results when at least one of the first and third main windings is excited.

21. A device according to claims 17, 18 or 19, comprising:

a third electrical conductor wound for at least one turn to form a third main winding, wherein a winding axis for the turn in the third main winding is parallel to the winding axis for the turn in the control winding, and wherein a transformer effect between the third main winding and the control winding results when at least one of the third main winding and the control winding is excited.

22. A magnetically influenced device, comprising:

a first, external tubular body comprising an anisotropic magnetisable material;

a second, internal tubular body comprising the anisotropic magnetisable material;

an additional tubular body which provides an external core which is mounted outside of and concentric with the first, external tubular body along a common axis;

at least one first electrical conductor wound round the tubular bodies for at least one turn to form a first main winding; and at least one second electrical conductor mounted in a gap between the first and the second bodies and wound around the common axis for at least one turn to form a control winding, wherein the tubular bodies each provide a closed magnetic circuit, wherein a winding axis for the turn in the main winding is at right angles to a winding axis for the turn in the control winding, wherein orthogonal magnetic fields are generated in at least one of the first body and the second body when the first main winding and the control winding are excited, and wherein a characteristic of the anisotropic magnetisable material relative to the field in the main winding is controlled by means of a field in the control winding.

23. A magnetically influenced device, comprising:

a first, external tubular body comprising an anisotropic magnetisable material;

a second, internal tubular body comprising the anisotropic magnetisable material;

an additional tubular body which provides an external core mounted outside of and concentric with the first, external tubular body along a common axis;

at least one first electrical conductor wound around the tubular bodies for at least one turn to form a first main winding; and at least one second electrical conductor mounted in a gap between the first and the second bodies and wound round the common axis for at least one turn to form a control winding, wherein the tubular bodies each provide a closed magnetic circuit, wherein a winding axis for the turn in the main winding is at right angles to a winding axis for the turn in the control winding, wherein orthogonal magnetic fields are generated in at least one of the first body and the second body when the first main winding and the control winding are excited, and wherein a characteristic of the anisotropic magnetisable material relative to a field in the main winding is controlled by means of a field in the control winding.

24. A device according to claims 22 or 23, comprising:

a first magnetic field connector; and a second magnetic field connector, wherein the first and second magnetic field connectors together with the tubular bodies provide the closed magnetic circuit.

25. A device according to claims 22 or 23, comprising:

a third electrical conductor wound around the external core for one turn to form a third main winding, wherein a winding axis for the turn in the third main winding is parallel to the winding axis for the turn in the first main winding, and wherein a transformer effect between the first and the third main windings results when at least one of the first and the third main winding is excited.

26. A device according to claims 22 or 23, comprising:

a third electrical conductor wound around the external core for at least one turn to form a third main winding, wherein a winding axis for the turn in the third main winding is parallel to the winding axis for the turn in the control winding, and wherein a transformer effect between the third main winding and the control winding results when at least one of the third main winding and the control winding is excited.

27. A device according to one of claims 22 or 23, the external core comprising:

several annular parts, wherein at least one of the first and the third main windings form an individual winding around each annular part.

28. A device according to one of claims 22 or 23, wherein the external core comprises:

several annular parts, wherein at least one of the control winding and the third main winding form an individual winding around each annular part.

29. A frequency converter comprising the device of claim 1, wherein the frequency converter operates on a synchronous motor, and wherein the frequency converter sums phase voltage components generated by a multi-pulse transformer for a plurality of motor phases.

30. A DC to AC converter comprising the device of claim 1, the device of claim 1 further comprising:

a third winding, wherein an input signal is converted to an AC output signal at a randomly selected output frequency, wherein at least one of a stored magnetic energy in a DC-fed first main winding and an inductance of a primary winding is varied by means of an orthogonal control field which influences the inductance, wherein an AC voltage is generated in the third winding, and wherein a frequency of the AC voltage equals a frequency of at least one of a flux variation and an inductance variation.

31. A reluctance controlled transformer comprising the device of claim 1, wherein the transformer is a component in an adjustable reactive power compensator, wherein the transformer creates a linear variable inductance in connection with at least one known filter circuit, wherein at least one condenser is also included as a circuit element, and wherein the device is employed as an element in a compensator connection where at least one of a capacitance and an inductance are automatically coupled in and adjusted as required for reactive power compensation.

32. A controllable magnetic structure comprising:

an anisotropic magnetic body comprising a closed magnetic circuit;

a main winding wound around a portion of the anisotropic magnetic body defining a first axis; and a control winding in conjunction with the portion of the anisotropic magnetic body, said control winding wound about a second axis orthogonal to the first axis, wherein a main field is generated by the main winding in the closed magnetic circuit in a high permeability direction when the main winding is energized, wherein a control field, orthogonal to the main field, is generated by the control winding in the closed magnetic circuit in a low permeability direction when the control winding is energized, and wherein the main field is controllable by the control field.

33. A current regulator comprising the controllable magnetic structure of claim 32.

34. A voltage regulator comprising the controllable magnetic structure of claim 32.

35. The magnetic structure of claim 32 wherein each of the main field and the control field are generated in substantially all of the closed magnetic circuit.

36. A method of employing a second field to control a first field in a closed magnetic circuit, the closed magnetic circuit comprising an anisotropic magnetic material, the method comprising the steps of:

generating the first field in the closed magnetic circuit in a high permeability direction;

generating the second field, orthogonal to the first field, in the closed magnetic circuit in a low permeability direction; and adjusting the second field to control the first field.

37. The method of claim 36 wherein the step of adjusting comprises adjusting a magnitude of the second field.

38. The method of claim 36 wherein both the first field and the second field are generated in substantially all of the closed magnetic circuit.

39. The device according to one of claims 22 and 23 wherein the closed magnetic circuit is an internal core.

40. The device as claimed in claim 2 wherein the axis for the turn in the main winding is coincident with the longitudinal direction of the body.

41. The device as claimed in claim 3 wherein the axis for the turn in the control winding is coincident with a longitudinal direction of the body.

42. The device as claimed in claim 4 wherein the axis for the third main winding is coincident with the axis for the first main winding.

43. The device as claimed in claim 5 wherein the axis for the third winding is coincident with the axis for the control winding.

44. The device as claimed in claim 1 wherein the characteristic is a magnetic permeability.

* * * * *